US010837166B2

(12) United States Patent
Yang

(10) Patent No.: US 10,837,166 B2
(45) Date of Patent: Nov. 17, 2020

(54) BUILDING STRUCTURE AND CONSTRUCTION METHOD FOR SAME

(71) Applicant: Dongzuo Yang, Dongguan (CN)

(72) Inventor: Dongzuo Yang, Dongguan (CN)

(73) Assignee: DONGGUAN SHIXI INTELLIGENT MACHINE MANUFACTURING CO. LTD., Dongguan (CN)

( * ) Notice: Subject to any disclaimer, the term of this patent is extended or adjusted under 35 U.S.C. 154(b) by 698 days.

(21) Appl. No.: 15/564,066

(22) PCT Filed: Mar. 3, 2015

(86) PCT No.: PCT/CN2015/073538
§ 371 (c)(1),
(2) Date: Jun. 20, 2018

(87) PCT Pub. No.: WO2015/131792
PCT Pub. Date: Sep. 11, 2015

(65) Prior Publication Data

US 2018/0355600 A1 Dec. 13, 2018

Related U.S. Application Data

(63) Continuation of application No. PCT/CN2014/072865, filed on Mar. 4, 2014.

(51) Int. Cl.
*E04B 1/00* (2006.01)
*E04B 1/20* (2006.01)
(Continued)

(52) U.S. Cl.
CPC ..... *E04B 1/24* (2013.01); *E04B 5/10* (2013.01); *E04B 5/14* (2013.01); *E04B 5/40* (2013.01);
(Continued)

(58) Field of Classification Search
CPC ..... E04B 1/04; E04B 1/20; E04B 1/24; E04B 1/165; E04B 2103/02; E04B 5/43; E04B 5/44; E04C 3/20; E04C 5/0622
(Continued)

(56) References Cited

U.S. PATENT DOCUMENTS 938,458 A * 11/1909 Brockhausen ..... E04B 5/43 52/283
2,871,544 A * 2/1959 Youtz ..... E04B 1/35 52/745.13

(Continued)

*Primary Examiner* — Brian E Glessner
*Assistant Examiner* — James J Buckle, Jr.
(74) *Attorney, Agent, or Firm* — WPAT, PC

(57) ABSTRACT

The invention relates to a building structure comprising pillar units, beam units including main beam units and floor slab units, the floor slab unit comprises a floor slab template layer and a floor slab framework unit; the beam unit comprises a beam template layer of concrete and the beam framework unit; the pillar unit comprises a pillar framework unit, the pillar framework unit comprises a pillar keel unit and support legs; the pillar framework unit comprises a pillar keel unit and support legs; the longitudinal section steel major keels supported on the main beam major keels and the steel bars protruding out of the floor slab template layer in the side direction are placed above the main beam units; the cells are formed between the adjacent beam units; more than one floor slab units are installed in each cell. The advantages of the invention are no support frames, no removing the template.

23 Claims, 25 Drawing Sheets

(51) Int. Cl.

| | |
|---|---|
| ***E04B 1/24*** | (2006.01) |
| ***E04B 5/10*** | (2006.01) |
| ***E04B 5/14*** | (2006.01) |
| ***E04B 5/40*** | (2006.01) |
| ***E04C 3/32*** | (2006.01) |
| *E04B 5/32* | (2006.01) |

(52) U.S. Cl.
CPC ..... *E04C 3/32* (2013.01); *E04B 2001/2415* (2013.01); *E04B 2001/2472* (2013.01); *E04B 2001/2484* (2013.01); *E04B 2005/322* (2013.01)

(58) Field of Classification Search
USPC ..... 52/79.1, 745.13
See application file for complete search history.

(56) References Cited

U.S. PATENT DOCUMENTS 3,179,374 A * 4/1965 Ernst ..... E04B 1/3511 254/109
3,354,593 A * 11/1967 Zukas ..... E04B 5/43 52/251
3,429,092 A * 2/1969 Hart ..... E04B 1/4157 52/653.1
3,490,191 A * 1/1970 Ekblom ..... E04B 1/35 52/745.13
3,524,293 A * 8/1970 Leyten ..... E04G 11/06 52/745.13
3,613,325 A * 10/1971 Yee ..... E04B 1/20 52/236.8
4,081,935 A * 4/1978 Wise ..... E04B 1/21 52/236.8
5,161,340 A * 11/1992 Wetton ..... E04B 1/21 52/236.7
6,293,063 B2 * 9/2001 Van Doren ..... E04B 1/165 52/250
6,920,728 B2 * 7/2005 Powers ..... E04B 1/22 52/236.5
8,549,805 B2 * 10/2013 Kim ..... E04C 5/0645 52/253
8,671,634 B2 * 3/2014 Morcous ..... E04B 5/16 52/252
8,844,223 B2 * 9/2014 Zhong ..... E04B 1/161 52/259
9,371,648 B1 * 6/2016 Tikhovskiy ..... E04B 5/18
10,094,101 B1 * 10/2018 Jazzar ..... E04G 11/38
10,260,224 B1 * 4/2019 Jazzar ..... E04B 1/164
2012/0047816 A1 * 3/2012 Zhong ..... E04B 1/164 52/11
2012/0167501 A1 * 7/2012 Tikhovskiy ..... E04B 1/04 52/251
2012/0233936 A1 * 9/2012 Zhong ..... E04B 1/165 52/173.1
2015/0135632 A1 * 5/2015 Dhillon ..... E04B 1/3404 52/741.1
2018/0291611 A1 * 10/2018 Sugaya ..... E04B 1/5837
2019/0078314 A1 * 3/2019 Yin ..... E04B 1/20

* cited by examiner

BUILDING STRUCTURE AND CONSTRUCTION METHOD FOR SAME

CROSS REFERENCE TO RELATED APPLICATIONS

This application is a national stage filing under section 371 of International Application No. PCT/2015CN/073538 filed on Mar. 3, 2015, which claims the priority of PCT/CN2014/072865 and published in Chinese on Sep. 11, 2015 as WO2015/131792.

TECHNICAL FIELD

The invention involves a building structure, such as bridge structure, passenger foot-bridge structure and house structure, and the construction method thereof, especially the house structure and the construction method thereof.

BACKGROUND OF THE INVENTION

Nowadays, most buildings have adopted reinforced concrete frame structures to meet the requirement for high-rise buildings, and the loads of buildings are mainly borne by the frame structure. Thus, the requirements on walls are low, which results in low material consumption and high construction efficiency.

The existing frame structure of a house mainly comprises pillars, beams and floor slabs. The pillars are either section steel pillars or reinforced concrete pillars. The reinforced concrete pillars are formed by binding steel bars, installing templates and then pouring concrete into the templates before removing the templates to form the reinforced concrete pillars upon concrete setting. The beams and the floor slabs are formed by binding steel bars, installing templates and then pouring concrete into the templates before removing the templates to form the reinforced concrete beams and floor slabs upon concrete setting. The above methods for forming the reinforced concrete pillars, beams and floor slabs require laying steel bars and installing and removing the templates at the construction sites. Therefore, the construction is of low speed, low efficiency and high labor intensity. Scaffolds and support frames are needed during template installation and removal at the construction sites, and the labor intensity of template installation is especially high. In particular, because the steel bars are easy to deform due to poor rigidity, plus their low structural precision and low stability, the precision cannot be controlled as with mechanical parts. As a result, neither can the reinforced concrete pillars, beams and floor slabs be processed in a factory nor can the templates for forming beams and floor slabs be fixed with steel bars in the factory in advance.

Nowadays, during construction works, wood templates are generally supported by a large number of square timbers plus steel tubes or by portal frames or sometimes by a support system combining adjustable supports and retractable steel beams. The structure has the following disadvantages: a large number of sawn and nailed wood templates are adopted during original construction, and wood templates with good quality can usually only be reused for about 6-7 times; wood templates are subject to damage due to repeated nailing and removal; used wood templates and supports are too worthless to sell and too good to throw away, time and man-hour are needed to saw off damaged portions for reuse, which means that time, man-hour and timbers are consumed; even if steel templates or other non-wood templates are used, templates for beams and floor slabs will still need to be supported by support frames in the pouring process, and scaffolds will also be necessary during installation of beam and floor slab templates.

The utility model patent with the Chinese application number 200920141210.7 discloses a modular assembly type building template device. Multiple polygonal major tubes are permanently connected to form square or rectangular borders, multiple polygonal minor tubes are mutually and permanently connected inside the frames to form groined frameworks, and four edges of the frameworks are permanently arranged at inner sides of the borders; wood templates are permanently installed on the frameworks; multiple first connecting holes are evenly arranged on the polygonal major tubes of the borders, every two borders are mutually and movably connected the multiple first connecting holes to form the template devices for floor slabs, beams, pillars, etc. For a building; multiple second connecting holes are arranged at four corners of the borders, and the borders are movably connected with adjustable support tube devices the multiple second connecting holes; The polygonal major tubes on the borders are movably connected with the retractable beam template devices. In this utility model, only the template structures are processed into unit modules in a factory, while beams and floor slabs still adopt the site reinforced structure, which demands for site construction. The template device also requires scaffolds and support frames during construction.

Therefore, site construction demands for a long construction period and a high labor intensity.

The invention with Chinese application number 200410013554.1 discloses a self-supporting cast-in-place concrete structure. A built-in steel truss and concrete composite beam comprises steel trusses, steel bottom dies, side dies and tie bars. One group of tie bars are respectively on lower chords at both sides of steel trusses, the steel bottom dies are welded on the two groups of tie bars, and the side dies and the steel bottom dies are mutually and permanently connected. In this invention, only all loads of beams are finally transferred to frame pillars, and beam templates may not be installed at the construction sites. In the construction stage however, floor slab templates still need to be installed at the construction site, scaffolds are still needed during installation of the floor slab templates, the floor slab templates also need to be supported by support frames, and floor slab steel bars also need to be installed at the construction site. Therefore, only the quantity of support frames and part of site construction quantity are reduced in the invention, while the site construction period is still long, and the construction labor intensity is still high.

Precast concrete slabs can also be adopted as templates. The invention with the Chinese application number 201210009856.6 discloses a composite floor slab for steel structure building. The composite floor slab comprises a bottom precast concrete slab, middle keels and a top cast-in-place concrete layer. The bottom precast concrete slab comprises a hot dip galvanized steel mesh, transverse channel slot steel strips, side plates and a casting concrete layer; The middle keels are longitudinally arranged at intervals and are permanently connected with the transverse channel steel strips for the bottom precast concrete slabs, and the middle keels are completely embedded into the top cast-in-place concrete layers. In the invention, although the bottom precast concrete slabs substitute for templates and site installation of templates is not needed, the middle keels still need to be fixed with the bottom precast concrete slabs after the bottom precast concrete slabs are formed, both ends of the middle keel need to be flush with the bottom precast concrete slabs and the top cast-in-place concrete layers, and thus, the installation of composite floor slabs and beam units is very inconvenient. The invention only discloses a composite floor slab and doesn't disclose any beam unit.

The utility model patent with the Chinese application number 00100182.5 dated Aug. 1, 2001 discloses a new type steel rib floor slab structure. It is composed of a pillar, a main steel rib of the beam, some brackets, a connector, some flexural components, a floor steel bar and a mesh patch. Here, multiple stiffening connectors are set on the side wall of the main steel rib of the beam; the brackets are set across main steel ribs of the beams horizontally. The connector is composed of a vertical bar and a fastening and connecting bar. The connector connects the bracket and the main steel rib of the beam. The flexural component penetrates through all brackets, with its two ends connected to stiffening connectors of the main steel rib of the beam respectively; the floor steel bars penetrate through and are arranged between all the brackets; the mesh patches are laid on surfaces of all the above-mentioned composition structures.

During assembling and lapping, firstly, section steel is used as the main body of the constructional structure of the main steel rib. Several pieces of Temporary Suspending Component J are installed on the side end of the beam temporarily. Secondly, after assembling connectors at two ends of the horizontal bracket, hang it on Temporary Suspending Component J temporarily installed on the side end of the beam, and then penetrate the flexural components through and set them on the brackets orderly arranged on Temporary Suspending Component J. Moreover, the joining end shall perfectly fit the corresponding stiffening connector on the side plate of the main steel rib. Thus, the joining pores can mutually justify. Use screws to screw them together. Then set the horizontal brackets hanging on Temporary Suspending Component J on the flexural component according to the design scheme. Two ends of the horizontal bracket are fixed to the splicing component on the main steel rib of the beam by Connector 3. Assemble and set the wrapping frame on the edge of the vertical frame and the lower edge of the beam. Moreover, connect tie connecting members of the wrapping frame between the corner brackets and corresponding connector plates. Then make the floor steel bar perforate the horizontal bracket and lay it on the main steel rib of the beam. Set anchoring steel bars at two ends of the floor steel bar respectively to the outer side of the main steel rib of the beam. In addition, set rebar strengthening structures through straight bars under the horizontal brackets. Connect the grip steel bar with the splicing component at the inner side of the main steel bar, with the hook end stretching into the horizontal bracket structure. Lay the mesh patches on surfaces of the composition structures and use blocking elements for blocking. Then concrete pouring can be done. After concrete setting, painting (or other surface decorations) can be done on the surface of the floor slab.

There are mainly the following deficiencies in this patent: 1) All components of the steel rib floor slab structure shall be made at the construction site, which means that the floor lab unit, the Beam unit and the pillar unit are not assembled in the factory, thereby resulting in high workload at the construction site; 2) It is hard to make alignment—even if we screw up, it is hard to make the pillar perpendicular to the horizontal plane, and it is impractical to fix up all components only by screwing or riveting; 3) Force bearing points are formed at the screwing positions to create the shearing force, which is not safe enough; 4) In order to prevent blisters, there shall be vibration during concrete pouring, which might result in the spilling of a large amount of cement paste out of the mesh. This is often the case for self-leveling concrete pouring.

Considering structures of the floor slab unit and the Beam unit, the ratio of sand, stone and cement paste of the concrete will change when some cement paste in the concrete spill out of the mesh, which will further affect the architectural quality.

SUMMARY OF THE INVENTION

The first technical problem the invention aims to settle is to provide a building structure and a construction method thereof, in which support frames are not needed during construction; modular pillar framework units, beam units and floor slab units of the building structure are respectively lapped together at the construction site, the labor cost and construction strength at the construction site are greatly reduced, and the construction period is greatly shortened.

The second technical problem the invention aims to settle is to provide a building structure and a construction method thereof, in which support frames are not needed during construction, modular pillar framework units, beam units and floor slab units of the building structure are respectively lapped together at the construction site, floor slab templates and beam templates do not need removing, the labor cost and construction strength at the construction site are greatly reduced, and the construction period is greatly shortened.

A building structure, which comprises pillar units, beam units including main beam units and floor slab units; the floor slab unit comprise a meshed floor slab framework unit and floor slab templates; Wherein the floor slab framework unit comprise longitudinal section steel major keels for load-bearing and arrayed transverse section steel keels fixed with the longitudinal section steel major keels, and the floor slab templates are fixed with the floor slab framework unit, with a gap between the top surface of the floor slab template and the bottom surface of the longitudinal section steel major keels; the beam unit comprise a beam framework unit and beam templates fixed on the beam framework unit, the beam framework unit comprise section steel beam keels for load-bearing, and a space is set between the top surfaces of the beam template and the bottom surface of the main major keels; the pillar unit comprise a pillar framework unit, the pillar framework unit comprise a pillar keel unit and support legs fixed on the pillar keel unit and used for supporting the beam framework unit of the beam unit; suspension parts are arranged at the end faces of the both ends of the major longitudinal section steel keel, suspension parts are of inverted L shape or reversed inverted L shape; pillar units, beam units and floor slab units are pre-assembled modular structures; both ends of the beam unit are placed on two corresponding support legs of two adjacent pillar units and fixed with the support legs; the cell is formed between two adjacent beam units; more than one floor slab unit are installed in each of cells, and the floor slab units are supported on the beam framework units the suspension parts, and two opposite sides of two suspension parts fixed on the same longitudinal section steel keel are stopped by the beam framework units; combined the pillar units, the beam unit templates and floor slab templates are spliced together to form a concave cavity with an upward opening, concrete is poured into the concave cavity; with the beam framework units and floor slab framework units being embedded into the concave cavity, and integral floor slabs and beams are formed by the beam framework units, the floor slab framework units and the concrete.

Furthermore, the building structure is a slab-pillar structure; beam unit comprise side beam units; a beam framework unit of the side beam unit comprise more than two arrayed the beam keels and also comprises arrayed section steel beam minor keels with small cross sectional area placed below the beam keels and perpendicular and fixed with the beam keels; The side beam unit also comprises end plates, and the end plates are fixed at both ends of the beam keel; The beam template of the side beam unit comprise a bottom plate parallel to the horizontal plane and an outer side plate perpendicular to the bottom plates, the bottom plate and the outer side plate form an L shape, the top face of the bottom plate is attached to the bottom faces of the beam minor keels, the top face of the outer side plate is higher than the top face of the beam framework unit, and the bottom plate is flush with and attached to the floor slab template.

Furthermore, the beam unit also comprises a middle beam unit; a beam framework unit of the middle beam unit comprise more than two arrayed the beam keels and also comprises arrayed section steel beam minor keels with small cross sectional area placed below the beam keels and perpendicular and fixed with the beam keels; the middle beam unit also comprises end plates, and the end plates are fixed at both ends of the beam keel; the top faces of beam templates of the middle beam units are attached to the bottom faces of the beam minor keels and are flush with and attached to the floor slab templates.

Furthermore, the building structure is a slab-pillar-beam structure; beam unit comprise side beam units; a beam framework unit of the side beam unit comprise more than two arrayed the beam keels and also comprises arrayed section steel beam minor keels with small cross sectional area placed below the beam keels and perpendicular and fixed with the beam keels; The beam unit also comprises end plates, and the end plates are fixed at both ends of the beam keel; a beam template of the side beam unit comprise a bottom plate parallel to the horizontal plane and an outer side plate and an inner side plate perpendicular to the bottom plate, the top face of the bottom plate is attached to the bottom faces of the beam minor keels, the top face of the outer side plate is higher than the top face of the beam framework unit, the top face of the inner side plate is flush with the top face of the floor slab template, and the inner side plate is attached to the floor slab template.

Furthermore, the beam framework unit of the middle beam unit comprise more than two arrayed the beam keels and also comprises arrayed section steel beam minor keels with small cross sectional area placed below the beam keels and perpendicular and fixed with the beam keels; The beam unit also comprises end plates, and the end plates are fixed at both ends of the beam keel; a beam template of the middle beam unit comprise a bottom plate parallel to the horizontal plane and two side plates perpendicular to the bottom plate, the top face of the bottom plate is attached to the bottom faces of the beam minor keels, the top faces of the side plates are flush with the top face of the floor slab template, and the side plates are attached to the floor slab template.

Furthermore, the floor slab unit also comprises a floor slab decorative panel, and a floor slab template is a metal template to be removed; The floor slab decorative panel is placed between the floor slab framework unit and the floor slab template; empty avoiding spaces matched with the support legs are arranged on the floor slab decorative panel and the floor slab template, with the beam framework unit being supported on the support legs; The floor slab decorative panel and the floor slab template are fixed on corresponding floor slab framework unit from below via fasteners; reverse hooks are arranged on the upward face of the floor slab decorative panel and are embedded into concrete.

Furthermore, the transverse section steel keels comprise upper transverse section steel keels fixed on the top faces of the longitudinal section steel major keels and lower transverse section steel keels fixed on the bottom faces of the longitudinal section steel major keels; The suspension part comprises angle brackets fixed at both ends of the longitudinal section steel major keel; The upper transverse section steel keels and the lower transverse section steel keels are staggered; The end faces of the lower transverse section steel keels are flush with the corresponding side faces of the floor slab templates, and the outer side faces of two outermost lower transverse section steel keels are flush with the corresponding side faces of the floor slab templates; The floor slab framework unit is supported on the beam framework units via horizontal parts of the angle brackets; The bottom faces of the lower transverse section steel keels are attached to the top faces of the floor slab templates.

Furthermore, the suspension part also comprises transverse section steel connecting strips connected on the bottom faces of the horizontal parts of the angle brackets; both ends of the upper transverse section steel keel protrude out of the floor slab templates, and longitudinal section steel connecting strips are connected on the bottom faces of all the upper transverse section steel keels; the bottom faces of the longitudinal connecting strips and the transverse connecting strips are flush with each other; The bottom faces of the longitudinal connecting strips and the transverse connecting strips are supported on the corresponding beam framework unit.

Furthermore, the floor slab templates are removable templates and fixed on the floor slab framework units from below via fasteners; the floor slab template unit comprises a floor slab template and stiffeners fixed at the bottom face of the floor slab template.

Furthermore, the building structure also comprises secondary beam units; The beam framework unit of the secondary beam units comprises more than two arrayed the beam keels and also comprises arrayed section steel secondary beam minor keels placed below the beam keels and perpendicular and fixed with the beam keels; the secondary beam unit also comprises end plates, and the end plates are fixed at both ends of the secondary beam keel; supporting parts are arranged on the beam framework units or suspension parts are arranged on the secondary beam framework units, the secondary beam framework units are supported on the supporting parts of the beam framework units or supported on the beam framework units the suspension parts of the secondary beam framework units; The secondary beam templates are spliced together with the corresponding floor slab templates, and the top planes of the secondary beam templates are flush with the top planes of the floor slab templates.

Furthermore, accommodating through holes for accommodating concrete are arranged in the longitudinal section steel major keels.

Furthermore, the pillar unit also comprises pillar templates, with more than two templates being arranged at the same height; The pillar keel unit comprise more than two vertical arrayed load-bearing pillar major keels; The pillar keel unit also comprises short connecting tubes with vertical axes and short spacing tubes with vertical axes, the short connecting tubes are installed between the pillar major keels and are used for spacing the pillar major keels and fixing the pillar major keels for the same pillar at the same height together, and the short spacing tubes are fixed on two relative outer side faces of different pillar major keels; support legs are fixed on the pillar major keels; The pillar templates are attached to and fixed with the short spacing tubes, a closed tubular cavity is formed by the pillar templates of the same height, and a space is set between the pillar templates and relative outer side faces of the pillar major keels; empty avoiding spaces are arranged in the positions where the pillar templates are matched with the beam units, and the tubular cavity formed by the pillar templates are intercommunicated with the concave cavity.

Furthermore, the floor slab framework unit also comprises steel bars fixed with the transverse section steel keels, and the steel bars comprise longitudinal steel bars or longitudinal steel bars and transverse steel bars.

The invention also provides a new construction method of the building structure. The construction method of the building structure, the building structure comprises pillar units, beam units including main beam units and floor slab units, which is characterized by the following steps:

1) assembling pillar framework units, beam units including main beam units and floor slab units according to design requirements or in a standardized way in a factory;

assembling floor slab snits: the floor slab unit comprise a net-shaped floor slab framework unit and a floor slab template, suspension units are fixed at both ends of longitudinal section steel major keel, the longitudinal section steel major keels are fixed with transverse section steel major keels, and the floor slab templates are fixed with the floor slab framework units, thus the floor units are assembled into a module structure in the factory;

assembling beam units: assemble the beam framework unit, and fix beam templates on the beam framework units, thus beam units are assembled into a module structure in the factory;

assembling pillar framework units: fix support legs on the pillar keel units, the faces of support legs supporting the beam keels are kept perpendicular to the pillar keel units, thus the pillar framework units are assembled into a module structure in the factory;

2) positioning and installing pillar framework units, pillar keel units are kept perpendicular to the horizontal plane;

3) hoisting, placing and fixing the beam units on the support legs of the pillar framework units, the cell is formed between two adjacent beam units;

4) hoisting and placing the floor slab units into the cells, with suspension parts of the floor slab units being supported on the beam framework units, and two opposite sides of two suspension parts fixed on the same longitudinal section steel keel are stopped by the beam framework units; combined pillar framework units, beam templates and floor slab templates are spliced together to form a concave cavity with an upward opening;

5) pouring the concrete into the concave cavity, with the beam framework units and the floor slab framework units being embedded into the concrete; after the concrete setting, integral floor slabs and beams are formed by the beam framework units, the floor slab framework units and the concrete.

A construction method of the building structure, the building structure comprises pillar units, beam units including main beam units and floor slab units, which is characterized by the following steps:

1) assembling pillar framework units, beam units including main beam units and floor slab units according to design requirements or in a standardized way in a factory;

assembling floor slab units: the floor slab unit comprise a net-shaped floor slab framework unit and a floor slab template, suspension units are fixed at both ends of longitudinal section steel major keel, the longitudinal section steel major keels are fixed with transverse section steel major keels, and the floor slab templates are fixed with the floor slab framework units, thus the floor units are assembled into a module structure in the factory;

assembling beam units: assemble the beam framework unit, and fix beam templates on the beam framework units, thus beam Units are assembled into a module structure in the factory;

assembling pillar framework units: fix support legs on the pillar keel units, the faces of support legs supporting the beam keels are kept perpendicular to the pillar keel units, thus pillar framework units are assembled into a module structure in the factory;

position and install pillar framework units, pillar keel units are kept perpendicular to the horizontal plane;

2) installation of pillar templates: the pillar templates are fixed with corresponding pillar framework units; a tubular cavity is formed by the pillar templates of the same height; Concrete is poured into tubular cavity;

3) pillar framework units above the faces of support legs supporting the beam keels are not embedded into the concrete in the concave cavity;

4) hoisting, placing and fixing the beam units are on the support legs of the pillar framework units; the cell is formed between two adjacent beam units after the installation of the beam units are completed;

5) hoisting and placing the floor slab units into the cells, with suspension parts of the floor slab units being supported on the beam framework units; combined pillar framework units, beam templates and floor slab templates are spliced together to form a concave cavity with an upward opening are spliced together to form a concave cavity with an upward opening;

6) pouring the concrete into the concave cavity and which haven't been not poured into Concrete; beam framework units and floor framework units are embedded into the concrete in the concave cavity; all the pillar keel units are embedded into the concrete in the tubular cavity, and an integral structure is formed by the concrete in the concave cavity and the concrete in the tubular cavity; after concrete setting, integral floor slabs, beams and pillars are formed by all the beam framework units, the floor slab framework units and concrete and all the pillar framework units and concrete.

A building structure, which comprises pillar units, beam units including main beam units and floor slab units; the floor slab unit comprise a semi-precast concrete floor slab template layer and a floor slab framework unit partially embedded into the semi-precast floor slab template layer; the floor framework unit comprise arrayed longitudinal load-bearing section steel major keels with large cross sectional area and transverse section steel keels installed below the longitudinal section steel major keels, as well as steel bars installed with the transverse section steel keels together, and the steel bars comprise first longitudinal steel bars or first transverse steel bars plus first longitudinal steel bars; The steel bars and the transverse section steel keels are embedded into the semi-precast floor slab template layer, the steel bars protrude out of the semi-precast floor slab template layer in the side direction, the transverse section steel keels protrude out of the semi-precast floor slab template layer in the side direction or are completely embedded into the semi-precast floor slab template layer; the longitudinal load-bearing section steel major keels protrude out of the semi-precast floor slab template layer only in the side direction and upward side; the beam unit comprise a semi-precast beam template layer of concrete and the beam framework unit partially embedded into the semi-precast beam template layer; the beam framework unit comprise section steel major keels for load-bearing; The end parts of the beam keels protrude out of the end faces of the semi-precast beam template layer; the pillar unit comprises a pillar framework unit, and the pillar framework unit comprises a pillar keel unit and support legs fixed on the pillar keel unit and used for supporting the beam framework units; floor slab unit, beam units, pillar framework units are pre-assembled modular structures. both ends of the beam unit are supported on two corresponding support legs of two adjacent pillar units and fixed with the two support legs; the cell is formed between two adjacent beam units; more than one floor slab unit is installed in each of cells formed by the pillar units and the beam units; the longitudinal section steel major keels are supported on the beam keels; the longitudinal section steel major keels and the steel bars protruding out of the semi-precast floor slab template layer in the side direction are placed above the beam units; more than one floor slab unit is installed in each of cells formed by the pillar units and the beam units; combined pillar units, semi-precast floor slab template layer and semi-precast beam template layer are spliced together to form a concave cavity with an upward opening, concrete is poured into the concave cavity, with the floor slab framework units and the beam framework units being completely embedded into the concrete, and integral floor slabs and beams are formed by the beam units, the floor slab units and the concrete.

Because the floor slab framework units adopt the combination of section steel keels and steel bars, the longitudinal section steel major keels protrude out of the semi-precast floor slab template layer in the side direction and the steel bars are placed above the beam units, the floor slab framework units have good rigidity, high strength and strong bearing capacity and are not easy to deform, and crack resistance and seismic performance are greatly improved. The semi-precast floor slab template layer is cast after the floor slab framework units are completely assembled, the semi-precast beam template layer is cast after the beam framework units are completely assembled, so the beam units and the floor slab units can be processed first in the factory according to design requirements or designed into standard parts, the construction of the main body frame and templates of the building structure can be completed by only hoisting and installing each unit in place at the construction site, and gaps at the splicing of combined pillar units, beam templates of the beam units and floor slab templates of the floor slab units can be well ensured to comply with construction requirements.

In the invention, the pillar units, the beam units and the floor slab units are respectively assembled in the factory to form components similar to mechanical devices, it is not necessary to weld the support legs of the pillar framework units on the pillar keels at the construction site, weld the longitudinal section steel major keels and the transverse section steel keels of the floor slab framework units together at the construction sites or weld the floor slab framework units and the beam framework units together at the construction site, the floor slab framework units are directly placed on the beam units and so on, so the labor cost and construction strength at the construction site are greatly reduced, the construction period is greatly shortened, and the construction cost is lowered; The pillar units, the beam units and the floor slab units are respectively assembled in the factory, so the efficiency is greatly increased, the labor intensity is greatly reduced, the labor environment is greatly improved, the quality of each unit can be better ensured, and mechanized installation can also be realized.

Suspension parts are of inverted L shape or reversed inverted L shape, floor slab unit can be placed directly on the cell; the floor slab units are supported on the beam framework units via the suspension parts, and two opposite sides of two suspension parts fixed on the same longitudinal section steel keel are stopped by the beam framework units. the floor slab framework units and the main beam units do not need to be fixed, which makes the site construction easier; the top faces of the longitudinal section steel keels are flush with or slightly higher than that of the main beam keels, so that the thickness of the floor slabs can fully meet the floor slab thickness requirement of 10 cm to 12 cm for the existing concrete slab-pillar structure, the floor slab thickness requirement of 20 cm to 22 cm for the existing concrete slab-pillar-beam structure. Because both ends of the beam unit are placed on two corresponding support legs of two adjacent pillar units and fixed with the support legs, so the installation of the main beam units will not affect the perpendicularity of the pillar units to the horizontal plane. In this way, the pillars can be definitely perpendicular to the horizontal plane and the beams can be definitely perpendicular to the pillars as long as the faces of support legs supporting the main beam major keels are kept perpendicular to the pillar keel units during the assembly of the pillar keel units in the factory and the pillar keel units are kept perpendicular to the horizontal plane during the installation of the pillars.

When the beam units and the floor slab units are installed, only the beam units are hoisted and placed on the support legs of the pillar framework units, the floor slab units are hoisted and placed into the cells, and no support frame is needed; because the semi-precast floor slab template layer and the semi-precast beam template layer are adopted, no template is needed any more during concrete pouring and no support frame is needed any more for supporting, the cost is greatly lowered, the site construction efficiency is greatly increased, and wasting of resources and contamination caused by discarded scaffolds and support frames to the environment are greatly reduced.

After cast-in-place is completed, the semi-precast floor slab template layer and the semi-precast beam template layer become an integral with the cast-in-place concrete, no template removal is needed, so the site construction efficiency is greatly increased, and the labor intensity of the construction site is greatly lowered; because the external surfaces of the semi-precast floor slab template layer and the semi-precast beam template layer have good quality, the workload of subsequence decoration is greatly reduced, and the decoration cost is lowered.

Furthermore, suspension parts are fixed at the outermost longitudinal section steel major keels, and the longitudinal section steel keels are supported on the beam keels. With the suspension parts, the floor slab units can be better supported on the beam units.

Furthermore, the transverse section steel keels protrude out of the semi-precast floor slab template layer; The transverse section steel keels protrude out of the semi-precast floor slab template layer in the side direction, and the first transverse steel bars are placed above the beam units. The floor slab framework units with this structure have relatively simple structure.

Furthermore, the longitudinal section steel major keels are round tube type section steel, and transverse section steel keels are square tube type section steel with small cross sectional area; The building structure also comprises U-shaped connectors matched with the longitudinal section steel major keels, with U-shaped grooves matched with the transverse section steel keels being arranged on the U-shaped connectors; The first transverse steel bars and the first longitudinal steel bars are fixed together to form a steel bar mesh, the first longitudinal steel bars are supported on the transverse section steel keels, the first transverse steel bars are placed between two adjacent transverse section steel keels, and the first longitudinal steel bars are placed between two connected longitudinal section steel major keels; The U-shaped connectors are suspended to the longitudinal section steel major keels, and the transverse section steel keels are installed in the U-shaped grooves of the U-shaped connectors and are fixed with the longitudinal section steel major keels and the U-shaped connectors together through welding. By using U-shaped connectors to connect the longitudinal section steel major keels with the transverse section steel keels, the connection is reliable.

Furthermore, the beam framework unit also comprises reinforces and square tube type sleeves; The beam keels of each beam unit are two pieces of relatively arranged open C-shaped section steel; The reinforces are vertically installed in the C-shaped section steel, the two pieces of C-shaped section steel penetrate through the square tube type sleeves, and the square tube type sleeves connect the two pieces of C-shaped section steel together.

Furthermore, the beam framework unit also comprises reinforces and square tube type sleeves; The beam keels of each beam unit are four pieces of relatively arranged L-shaped section steel; The reinforces are installed among the four pieces of L-shaped section steel, the four pieces of L-shaped section steel penetrate through the square tube type sleeves, and the square tube type sleeves connect the four pieces of L-shaped section steel together. By using the square tube type sleeves to connect and fix the two pieces of C-shaped section steel or the four pieces of L-shaped section steel together and adding reinforces, the rigidity, strength, bearing capacity, crack resistance and seismic performance of the beam framework units are further increased.

Furthermore, second transverse steel bars and second longitudinal steel bars are installed on the longitudinal section steel major keels.

The rigidity, strength, bearing capacity, crack resistance and seismic performance of the floor slab framework units are further increased.

A new building structure, which comprises pillar units, beam units including main beam units and floor slab units; the floor slab unit comprise a semi-precast concrete floor slab template layer and a floor slab framework unit partially embedded into the semi-precast floor slab template layer; The floor framework unit comprise arrayed longitudinal load-bearing section steel major keels with large cross sectional area and transverse section steel keels installed below the longitudinal section steel major keels, as well as steel bars installed with the transverse section steel keels together, and the steel bars comprise first longitudinal steel bars or first transverse steel bars plus first longitudinal steel bars; the steel bars and the transverse section steel keels are embedded into the semi-precast floor slab template layer, the steel bars protrude out of the semi-precast floor slab template layer in the side direction, the transverse section steel keels protrude out of the semi-precast floor slab template layer in the side direction or are completely embedded into the semi-precast floor slab template layer; the longitudinal load-bearing section steel major keels protrude out of the semi-precast floor slab template layer only in the side direction and upward side; the beam unit comprise a main the beam framework unit and a beam template fixed on the beam framework unit; The beam framework unit comprise section steel major keels for load-bearing with large cross sectional area; the end parts of the beam keels protrude out of the end faces of the beam templates; the pillar unit comprise a pillar framework unit, and the pillar framework unit comprise a pillar keel unit and support legs fixed on the pillar keel unit and used for supporting the beam framework units; both ends of the beam keel are supported on two corresponding support legs of two adjacent pillar units and fixed with the two support legs; the longitudinal section steel major keels are supported on the beam keels; the longitudinal section steel major keels and the steel bars protruding out of the semi-precast floor slab template layer in the side direction are placed above the beam units; more than one floor slab unit is installed in each of cells formed by the pillar units and the beam units; combined pillar units, semi-precast floor slab template layer and semi-precast beam template layer are spliced together to form a concave cavity with an upward opening, concrete is poured into the concave cavity, with the floor slab framework units and the beam framework units being completely embedded into the concrete, and integral floor slabs and beams are formed by the beam units, the floor slab units and the concrete.

The invention has the advantages that the keel units of the pillar framework units, the beam units and the floor slab units are section steel keels; The keel units have good rigidity and high strength and are not easy to deform in comparison with the steel bar mesh, and cannot deform subject to template weight and concrete weight and impact force during casting, etc.; in particular, the pillar framework units, the beam units and the floor slab units have high precision in length and width dimensions and good stability, the precision is as easy to control as mechanical parts, so the pillar framework units, the beam units and the floor slab units can be processed first in the factory according to design requirements or designed into standard parts, the construction of the main body frame and templates of the building structure can be completed by only hoisting and installing each unit in place at the construction site, and gaps at the splicing of combined pillar units, beam templates of the beam units and floor slab templates of the floor slab units can be well ensured to comply with construction requirements.

In the invention, the pillar framework units, the beam units and the floor slab units are respectively assembled in the factory to form components similar to mechanical devices, especially the templates are also assembled on corresponding units in the factory, it is not necessary to weld the support legs of the pillar framework units on the pillar keels at the construction site, weld the longitudinal section steel major keels and the transverse section steel keels of the floor slab framework units together at the construction sites or weld the floor slab framework units and the beam framework units together at the construction site, the floor slab framework units are directly placed on the beam units and so on, so the labor cost and construction strength at the construction site are greatly reduced, the construction period is greatly shortened, and the construction cost is lowered; The pillar framework units, the beam units and the floor slab units are respectively assembled in the factory, so the efficiency is greatly increased, the labor intensity is greatly reduced, the labor environment is greatly improved, the quality of each unit can be better ensured, and mechanized installation can also be realized.

When the beam units and the floor slab units are installed, only the beam units are hoisted and placed on the support legs of the pillar framework units, the floor slab units are hoisted and placed into the cells, and no support frame is needed; because the templates have been fixed on the corresponding keel units in advance, no template is needed during concrete pouring for supporting; The template support frames are omitted, especially the templates become one part of the building structure without removal, no scaffold is needed, the cost is greatly lowered, the site construction efficiency is greatly increased, and wasting of resources and contamination caused by discarded scaffolds and support frames to the environment are greatly reduced.

The templates can be single-use decorative panels without removal to form decorative panels of the roof, it is not necessary to decorate the roof, the decoration duration can be shortened, and the decoration cost can be lowered; The templates can also be reusable metal templates and can be fixed on the longitudinal section steel major keels via fasteners, so template removal is quick and labor-saving.

The templates can also be divided into two layers, with the upper layer as thin decorative panels without removal and the lower layer as reusable metal templates; forces acting upon the decorative panels with this structure are transferred to the metal templates during concrete pouring, so the decorative panels can be very thin, and there is no requirement for material. The decorative panels not only can have decorative function but also can save the cost. Reverse hooks are arranged on the decorative panels and embedded into concrete, so that the decorative panels can also be reliably fixed with the concrete after the metal templates are removed.

As discussed above, the invention overcomes the inertial thinking that templates must be installed at the construction sites in the prior art, instead the pillar framework units, the beam units and the floor slab units are designed into components similar to mechanical devices, and no support frame is needed; especially when the templates become one part of the building structure without removal, the construction of the building structure can be completed without any scaffold.

In the slab-pillar building structure, reinforced concrete floor slabs and reinforced concrete beams are flush. In the slab-pillar-beam building structure, reinforced concrete beams protruding out of reinforced concrete floor slabs. The beam framework units are composed of the beam keels and beam minor keels, the beam minor keels connect and fix the beam keels together, and end plates are fixed at both ends of the beam keel. Under the same strength, rigidity and force, the weight of the beam framework units is reduced, and the beam units are conveniently fixed with the pillars.

Stiffeners are arranged below the floor slab templates, so that the floor slab templates can bear a larger force during use and are not easy to deform during removal, which is good for repeated use.

In the reinforced concrete pillar units, concrete is poured into the pillar units and forms a whole with concrete in the floor slabs and the beams; the support legs are also embedded into concrete, so the firmness and seismic performance of the entire building are greatly increased.

DETAILED DESCRIPTION OF THE INVENTION

The invention will be further described below in details with reference to the figures and embodiments.

Embodiment 1

Figure 1:
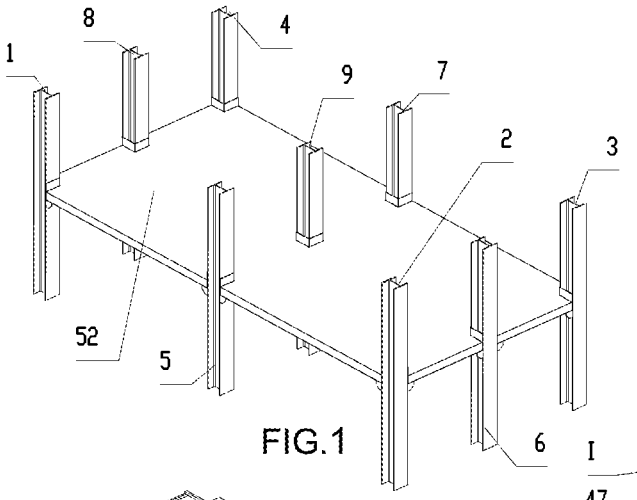
FIG. 1 is the solid view of Embodiment 1 of the invention.
Figure 2:
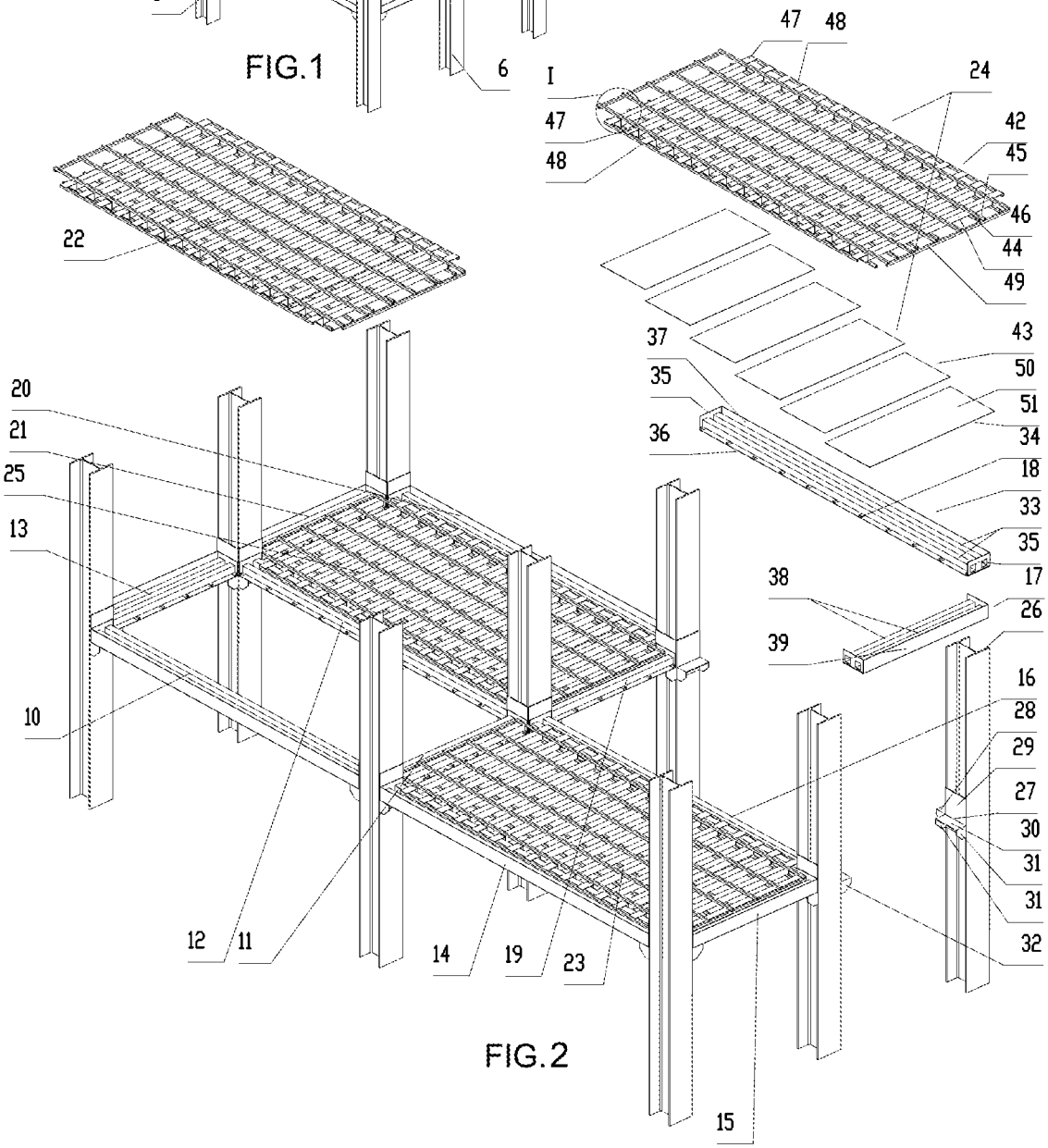
FIG. 2 is the solid breakdown view of Embodiment 1 of the invention with concrete removed.
Figures 3, 4:
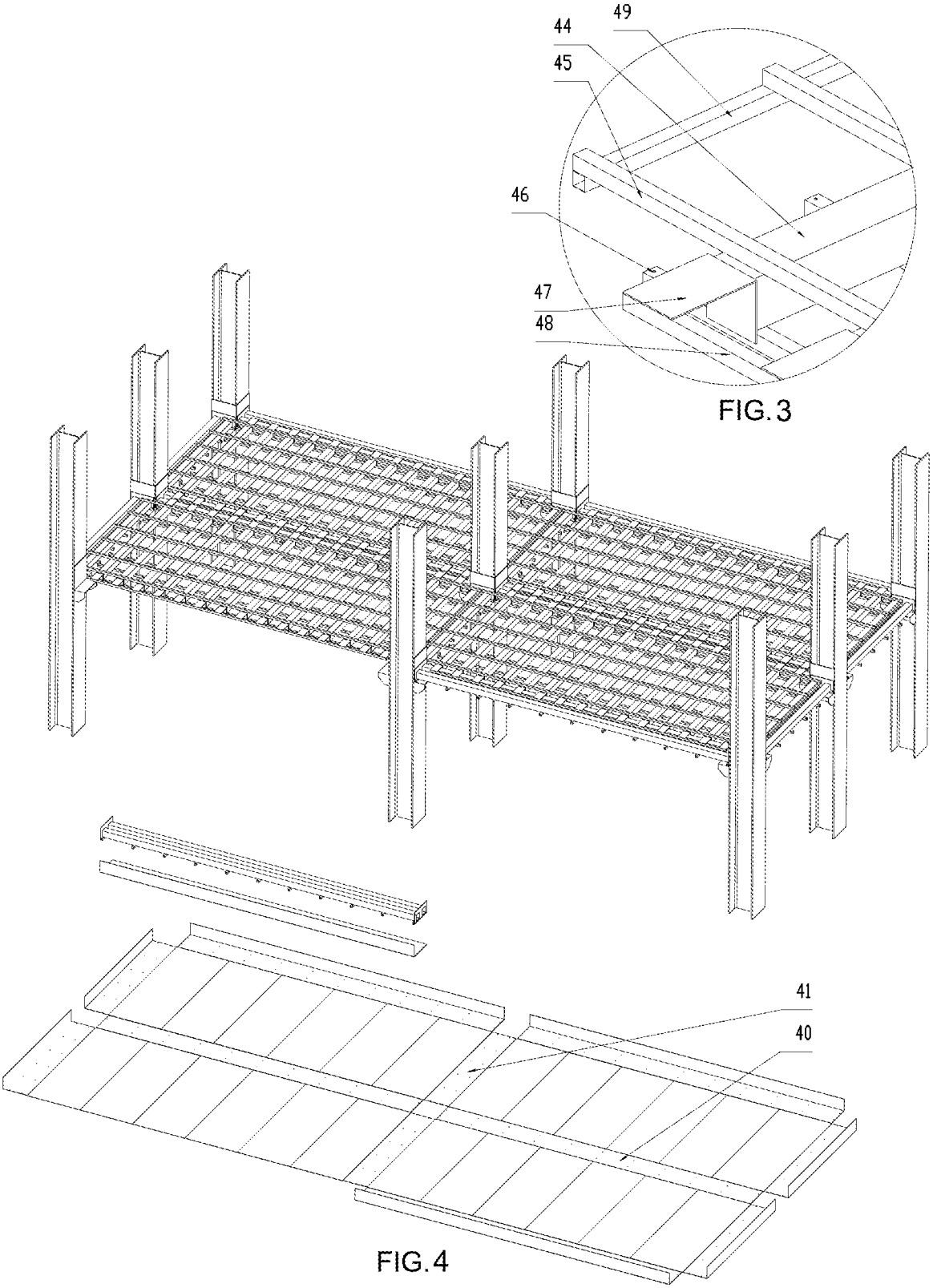
FIG. 3 is the enlarged view of the Part I of FIG. 2.
FIG. 4 is another solid breakdown view of Embodiment 1 of the invention with concrete removed.

As shown in FIGS. 1-3, a slab-pillar building structure comprises pairwise symmetrical Pillar Units 1, 2, 3 and 4 distributed at four corners of a rectangle, Pillar Unit 5 placed between Pillar Unit 1 and Pillar Unit 2, Pillar Unit 6 placed between Pillar Unit 2 and Pillar Unit 3, Pillar Unit 7 placed between Pillar Unit 3 and Pillar Unit 4, Pillar Unit 8 placed between Pillar Unit 4 and Pillar Unit 1, and Pillar Unit 9 placed between Pillar Unit 5 and Pillar Unit 7; The slab-pillar building structure also comprises beam Unit 10 installed between Pillar Unit 1 and Pillar Unit 5, beam Unit 11 installed between Pillar Unit 5 and Pillar Unit 9, beam Unit 12 installed between Pillar Unit 9 and Pillar Unit 8, beam Unit 13 installed between Pillar Unit 8 and Pillar Unit 1, beam Unit 14 installed between Pillar Unit 5 and Pillar Unit 2, beam Unit 15 installed between Pillar Unit 2 and Pillar Unit 6, beam Unit 16 installed between Pillar Unit 6 and Pillar Unit 9, beam Unit 17 installed between Pillar Unit 6 and Pillar Unit 3, beam Unit 18 installed between Pillar Unit 3 and Pillar Unit 7, beam Unit 19 installed between Pillar Unit 7 and Pillar Unit 9, beam Unit 20 installed between Pillar Unit 7 and Pillar Unit 4, and beam Unit 21 installed between Pillar Unit 4 and Pillar Unit 8; and the slab-pillar building structure also comprises Floor Slab Unit 22, Floor Slab Unit 23, Floor Slab Unit 24 and Floor Slab Unit 25 with the same structure and installation method.

As shown in FIG. 2, Pillar Unit 3 only comprises a pillar framework unit, and the pillar framework unit comprise Pillar Keel 26, Support Leg 27 fixed on Pillar Keel 26 and used for supporting Main the beam framework unit 17 and Support Leg 28 used for supporting Main the beam framework unit 18. The pillar keel is H-section steel, an existing steel that can be directly used, so the method is quicker than the existing method of forming pillars by using templates, and the cost is low. Support leg 27 comprises Fixed Plate 29, Bearing Plate 30 and Two-rib Plate 31, with Bearing plate 30 welded on Fixed Plate 29, Bearing Plate 30 forming a 90° angle with Fixed Plate 29, and Two-rib Plate 31 placed below Bearing Plate 30 and welded with Fixed Plate 29 and Bearing Plate 30 together, so as to increase the strength of the support legs. Fixed Plate 29 is welded on the side face of Pillar Keel 26, and Bearing Plate 30 is used for bearing beam Unit 17. Support Leg 28 and Support Leg 27 have the same structure and are perpendicular to each other.

As shown in FIG. 2, Pillar Unit 6 has the structural difference from Pillar Unit 3 in that three support legs are arranged on Pillar Unit 6, and Support Leg 32 is also arranged on relative faces of Pillar Unit 6 and Pillar Unit 3. Pillar Unit 8 and Pillar Unit 6 are symmetrical about the vertical plane in the central position. Pillar Unit 5 and Pillar Unit 6 have the same structure, and the installation relation of Pillar Unit 5 rotates by 180° clockwise in relative to Pillar Unit 6. Pillar Unit 7 and Pillar Unit 5 are symmetrical about the vertical plane in the central position. Pillar Unit 9 has the structural difference from Pillar Unit 6 in that four support legs are arranged on Pillar Unit 9, and support legs (not shown) are also arranged on relative faces of Pillar Unit 9 and Pillar Unit 6.

As shown in FIG. 2, beam Unit 18 is a side beam unit and comprises a main the beam framework unit and a beam template fixed on the beam framework unit. The beam framework unit comprise two horizontal arrayed load-bearing square tube type section steel beam keel 33 with large cross sectional area and also comprises eleven evenly arrayed square tube type section steel beam Minor Keel 34 with small cross sectional area placed below beam keel 33, perpendicular to and fixed with beam keel 33 through welding, with the top surfaces being attached to the bottom faces of beam keel 33, both ends of which are flush with the outer side faces of the corresponding outermost beam Minor Keel 34; The beam framework unit also comprises Two-end Plates 35 respectively placed at both ends of beam keel 33, and the two-end plates are respectively fixed with both ends of beam keel 33 and the outer side faces of the corresponding outermost beam Minor Keel 34 through welding. The beam template comprises Bottom Plate 36 parallel to the horizontal plane and an outer side plate 37 perpendicular to Bottom Plate 36, Bottom Plate 36 and Outer Side Plate 37 form an L shape, the top face of Bottom Plate 36 is attached to the bottom faces of beam Minor Keel 34, the beam template is fixed with beam Minor Keel 34 and beam keel 33 through welding, and the top face of Outer Side Plate 37 is higher than the top faces of beam Minor Keel 33.

As shown in FIG. 2, beam Unit 17 has the structural difference from beam Unit 11 in that beam Unit 17 comprises six square tube type section steel beam minor keels (not shown) with small cross sectional area, the maim beam keels 38 and the beam template 39 of beam Unit 17 are shorter than the beam keel and beam template of beam Unit 17, and the installation relation rotates by 90°.

As shown in FIG. 2 and FIG. 4, beam Unit 16 is a middle beam unit and has the structural difference from beam Unit 18 in that beam Template 40 of beam Unit 16 is only a flat plate placed on the same horizontal plane with Bottom Plate 36 of beam Unit 18 and flush with both ends of Bottom Plate 36.

As shown in FIG. 2 and FIG. 4, beam Unit 19 is a middle beam unit and has the structural difference from beam Unit 17 in that the beam template 41 of beam Unit 19 is only a flat plate placed on the same horizontal plane with the bottom plate of beam Template 39 of beam Unit 17 and flush with both ends of the bottom plate of beam Template 39.

As shown in FIG. 2, beam Unit 10 and beam Unit 14 have the same structure, beam Unit 20 and beam Unit 18 have the same structure, and beam Unit 20 and beam Unit 10 are symmetrical about the vertical plane in the central position; beam Unit 13 and beam Unit 21 have the same structure, beam Unit 15 and beam Unit 17 have the same structure, and beam Unit 15 and beam Unit 13 are symmetrical about the vertical plane in the central position; beam Unit 12 and beam Unit 16 have the same structure. beam Unit 12 and beam Unit 16 have the same structure. beam Unit 11 and beam Unit 19 have the same structure.

As shown in FIG. 2 and FIG. 3, Floor Slab Unit 24 comprises meshed Floor Slab Framework Unit 42 and six pieces of Floor Slab Template Unit 43 with the same structure. The Floor Slab Framework Unit 42 comprises multiple evenly arrayed longitudinal load-bearing square tube type section steel major keels 44 with large cross sectional area, upper transverse square tube type section steel keels 45 fixed on the top faces of the longitudinal section steel major keels 44 and lower transverse square tube type section steel keels 46 fixed on the bottom faces of the longitudinal section steel major keels 44; suspension parts are arranged at the face of both ends of the longitudinal section steel major keel 44 and comprise Angle Bracket 47 fixed at the end faces of the both ends of the longitudinal section steel major keel 44 through welding and transverse square tube type section steel connecting strips 48 connected on the bottom faces of the horizontal parts of Angle Bracket 47; The side faces of Transverse Connecting Strip 48 are flush with the side faces of the Angle Bracket 47. The upper Transverse Connecting Strip 45 and the lower Transverse Connecting Strip 46 are staggered; The end faces of Transverse Connecting Strip 46 are flush with the corresponding side faces of the floor slab templates, and the outer side faces of two outermost Transverse Connecting Strip 46 are flush with the corresponding side faces of the floor slab templates; The floor slab framework units are placed the cell and only supported on the beam framework units via Transverse Connecting Strip 48 of connecting Angle Bracket 47, and two opposite sides of connecting Angle Bracket 47 fixed on the same longitudinal section steel keel 44 are stopped by the beam framework units;

The bottom faces of the lower transverse section steel keels 46 are attached to the top faces of the floor slab templates. Both ends of Upper Transverse Section Steel Keel 45 protrude out of the floor slab templates, and longitudinal section steel connecting strips 49 are connected on the bottom faces of Upper Transverse Section Steel Keel 45 through welding; The end faces of Upper Transverse Section Steel Keel 45 are flush with the corresponding side faces of the longitudinal connecting strips 49, and the bottom faces of the longitudinal connecting strips 49 and the transverse connecting strips 48 are flush with each other. The bottom faces of the transverse connecting strips 48 connecting the Angle Bracket 47 at both ends of the longitudinal section steel major keel 44 are respectively supported on the beam keels of beam Unit 16 and beam Unit 18, and two opposite sides of connecting Angle Bracket 47 fixed on the same longitudinal section steel keel 44 are stopped by the beam framework units. The bottom faces of Longitudinal Connecting Strip 49 at both ends of Transverse Section Steel Major Keel 45 are respectively supported on the beam keels of beam Unit 17 and beam Unit 19. The floor slab templates 43 are fixed with the lower transverse section steel keels 46 through welding.

As shown in FIG. 1 to FIG. 4, the peripheries of the floor slab templates of Floor Slab Unit 22, Floor Slab Unit 23, Floor Slab Unit 24 and Floor Slab Unit 25 and the bottom plates of the beam templates of the corresponding beam units are placed on the same horizontal plane and spliced together. Combined all pillar units, beam templates of the beam units and floor slab templates of the floor slab units are spliced together to form a concave cavity with an upward opening, Concrete 52 is poured into the concave cavity, with all the beam keels, partial beam minor keels, all the longitudinal section steel major keels, all the upper transverse section steel keels and partial lower transverse section steel keels being embedded into the concrete, and integral floor slabs and beams are formed by all the beam framework units, the floor slab framework units and the Concrete 52.

A construction method of the building structure, the building structure comprises pillar units, beam units including main beam units and floor slab units, the construction method includes the following steps:

1) All the pillar framework units, the beam units and the floor slab units are assembled according to design requirements or in a standardized way in a factory;

Assemble Floor Slab Units:

The Angle Bracket 47 are fixed at both ends of Longitudinal Section Steel Major Keel 44 through welding in the factory, the transverse square tube type section steel connecting strips 48 are connected on the bottom faces of the horizontal parts of the Angle Bracket 47 through welding to form the suspension parts of Floor Slab Unit 24; Upper Transverse Section Steel Keel 45 are welded on the top faces of the longitudinal section steel major keels 44, and Longitudinal Connecting Strip 49 is connected on the bottom faces of Upper Transverse Section Steel Keel 45 through welding; Lower Transverse Section Steel Keel 46 is welded on the bottom faces of Longitudinal Section Steel Major Keel 44; Floor Slab Template 50 is fixed with Lower Transverse Section Steel Keel 46 through welding; so all components of Floor Slab Unit 24 form an integral structure fixed together in the factory; all the other floor slab units are also fixed together in the factory in the same way; thus all the floor units are assembled into a module structure in the factory.

Assemble Beam Units:

All the beam minor keels 34 are evenly welded on the bottom faces of the beam keels 33 in the factory, two-end plates 35 are respectively welded at both ends of beam keel 33, and Bottom Plate 36 and Outer Side Plate 37 of the beam template are fixed with the beam minor keels 34 through welding; so all components of beam Unit 18 form an integral structure fixed together in the factory; all the other beam units are also fixed together in the factory in the same way; thus beam Units are assembled into a module structure in the factory.

Assemble Pillar Framework Units:

Bearing Plate 30 is welded on Fixed Plate 29 in the factory, with Bearing Plate 30 forming a 90° angle with Fixed Plate 29; Two-rib Plate 31 is placed below Bearing Plate 30 and welded with Fixed Plate 29 and Bearing Plate 30, and Fixed Plate 29 is welded on the side face of Pillar Keel 26; Fixed Plate 29, Bearing Plate 30 and Two-rib Plate 31 form Support Leg 27; Support Leg 28 is fixed on Pillar Keel 26 in the same way; so all components of the pillar framework unit of Pillar Unit 3 form an integral structure fixed together in the factory; all the pillar framework units of other pillar units are also fixed together in the factory in the same way; thus all beam Units are assembled into a module structure in the factory.

2) Position and install pillar framework units, the pillar keel Units are kept perpendicular to the horizontal plane.

3) The beam units are hoisted and placed on the support legs of the pillar framework units; The beam units and the pillar framework units are spliced together to form cells after the installation of the beam units is completed; the cells are formed between the two two adjacent beam units;

4) The floor slab units are hoisted and placed into the cells, with the transverse connecting strips welded on the bottom faces of the angle brackets of the floor slab units being supported on the beam keels of the corresponding beam units; combined pillar units, beam templates of the beam units and floor slab templates of the floor slab units are spliced together to form a concave cavity with an upward opening;

5) Concrete 52 is poured into the concave cavity, with the all the beam keels, partial the beam minor keels, all the longitudinal section steel major keels, all the upper transverse section steel keels and partial lower transverse section steel keels being embedded into the Concrete 52; after the Concrete 52 is set, integral floor slabs and beams are formed by the beam framework units, the floor slab framework units and the Concrete 52.

The construction of the upper storey of floor slabs is completed in this way. The connection between pillars is the same to the existing way and will not be discussed in the invention.

In the embodiment, after concrete is set, the floor slab templates and the beam templates become one part of the building structure without removal, so no support frame or scaffold is needed during construction, and the construction efficiency is maximized Because beams in this structure do not protrude out of floor slabs, the hidden beam type slab-pillar building structure is formed.

Embodiment 2

Figure 5:
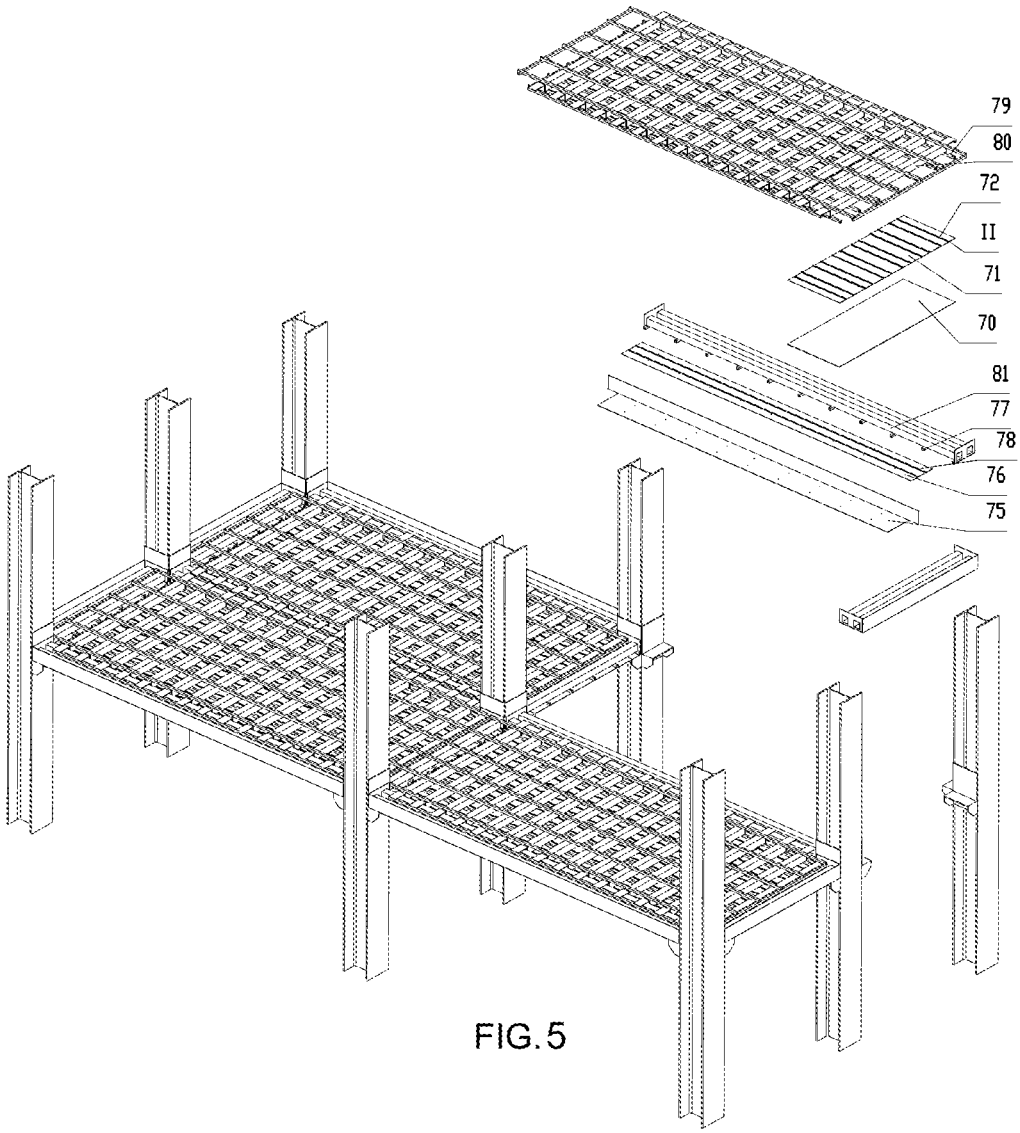
FIG. 5 is the solid breakdown view of Embodiment 2 of the invention with concrete removed.

As shown in FIG. 5, the difference from Embodiment 1 is that each floor slab comprises Floor Slab Template 70 and Floor Slab Decorative Panel 71, and Floor Slab Template 70 is a metal template to be removed; Floor Slab Decorative Panel 71 is placed between Lower Transverse Section Steel Keel 79 and a bottom plate of Floor Slab Template 70; The periphery of the Floor Slab Decorative Panel 71 is flush with the periphery of the bottom plate of Floor Slab Template 70, the bottom face of the Floor Slab Decorative Panel 71 is attached to the top face of Floor Slab Template 70, and the top face is attached to the bottom face of Lower Transverse Section Steel Keel 79; Reverse Hook Type Rib 72 integrally formed with Floor Slab Decorative Panel 71 is arranged on the upward face of Floor Slab Decorative Panel 71 and embedded into concrete (not shown).

Figure 6:
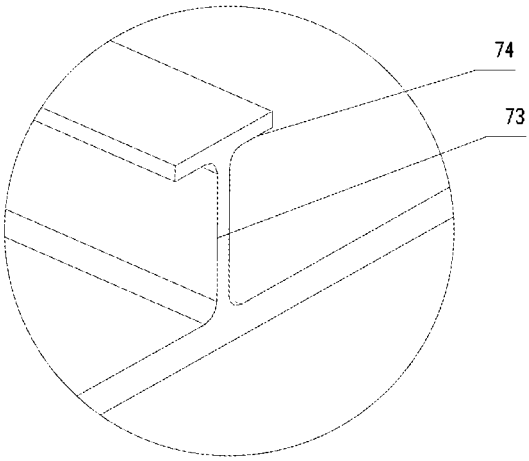
FIG. 6 is the enlarged view of the Part II of FIG. 5.

As shown in FIG. 6, Reverse Hook Type Rib 72 comprises Vertical Part 73 extending in perpendicular to the top face of the Floor Slab Decorative Panel 71 and Parallel Part 74 extending in perpendicular to two sides of the decorative part.

As shown in FIG. 5, each beam comprises beam Template 75 and beam Decorative Panel 76, with the former as a metal template to be removed; beam Decorative Panel 76 is placed between beam Minor Keel 77 and a bottom plate of beam Template 75; The periphery of beam Decorative Panel 76 is flush with the periphery of the bottom plate of beam Template 75, the bottom face of beam Decorative Panel 76 is attached to the top face of beam Template 75, and the top face is attached to the bottom face of beam Minor Keel 77; Reverse Hook Type Rib 78 integrally formed with beam Decorative Panel 76 is arranged on the upward face of beam Decorative Panel 76 and embedded into concrete (not shown).

As shown in FIG. 5, Floor Template 70 and the Floor Slab Decorative Panel 71 are fixed with Lower Transverse Section Steel Keel 79 and Longitudinal Section Steel Keel 80 of the floor slab framework unit from below via fasteners (not shown). Floor slab templates and decorative panels of all floor slab units are fixed with lower transverse section steel keels and longitudinal section steel keels of floor slab framework units of corresponding floor slab units from below via fasteners (not shown). beam Template 75 is fixed with beam Minor Keel 77 and beam keel 81 of the beam framework unit from below via fasteners (not shown). All beam templates are fixed with beam minor keels and beam keels of main the beam framework units from below via fasteners (not shown).

As shown in FIG. 5, the difference from Embodiment 1 is that the construction method of the building structure in this embodiment also comprises the following steps: after concrete setting, all fasteners used for fixing the floor slab templates and the floor slab decorative panels are separated from the lower transverse section steel keels and the longitudinal section steel keels of the floor slab framework units of corresponding floor slab units, the floor slab framework units of the floor slab units are removed, and Reverse Hook Type Rib 72 of the floor slab decorative panels is embedded into concrete so that the floor slab decorative panels become one part of the building structure; after concrete setting, all fasteners used for fixing the beam templates and the beam decorative panels are separated from the beam minor keels and the beam keels of the corresponding beam units, the beam templates of the beam units are removed, and the reverse hook type ribs 78 of the beam decorative panels are embedded into concrete so that the beam decorative panels become one part of the building structure Embodiment 3

Figure 7:
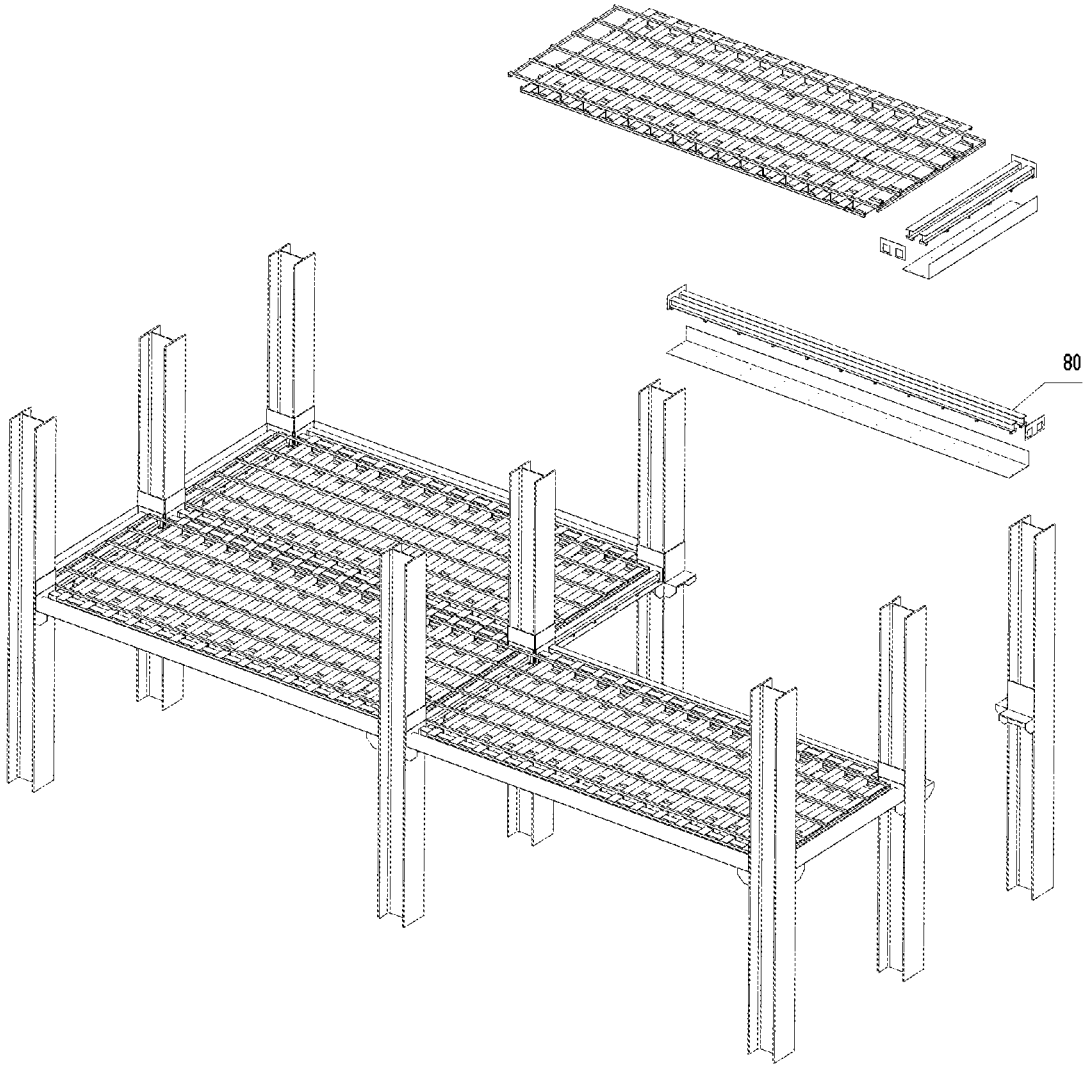
FIG. 7 is the solid breakdown view of Embodiment 3 of the invention with concrete removed.

As shown in FIG. 7, the difference from embodiment 1 is that beam keel 80 of all main the beam framework units is load-bearing H-section steel with large cross sectional area.

Embodiment 4

Figure 8:
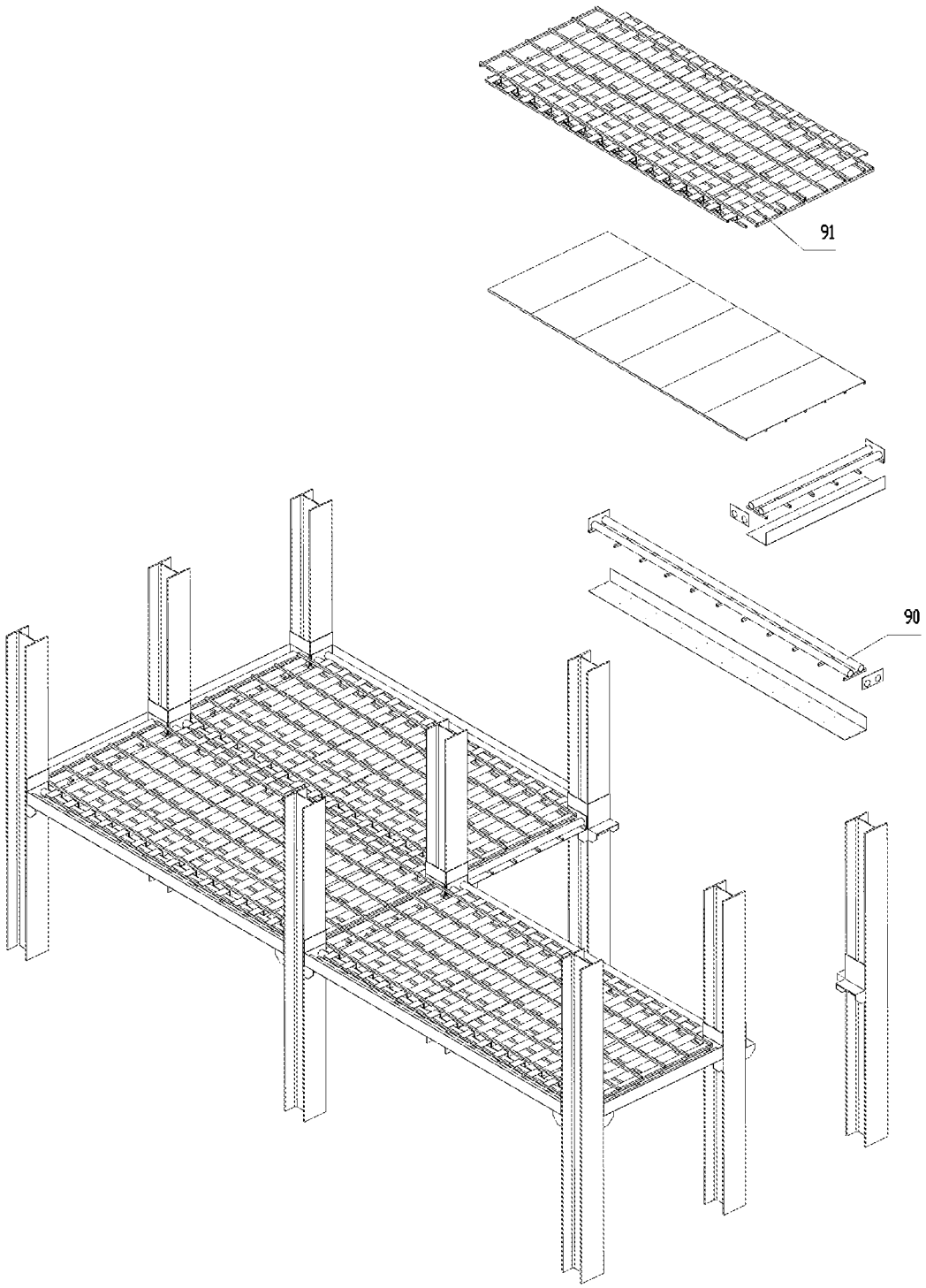
FIG. 8 is the solid breakdown view of Embodiment 4 of the invention with concrete removed.

As shown in FIG. 8, the difference from embodiment 1 is that all pieces of beam keel 90 of all main the beam framework units are load-bearing round tube type section steel with large cross sectional area. Longitudinal load-bearing section steel major keels 91 with large cross sectional area of all floor slab units are round tube type section steel.

Embodiment 5

Figure 9:
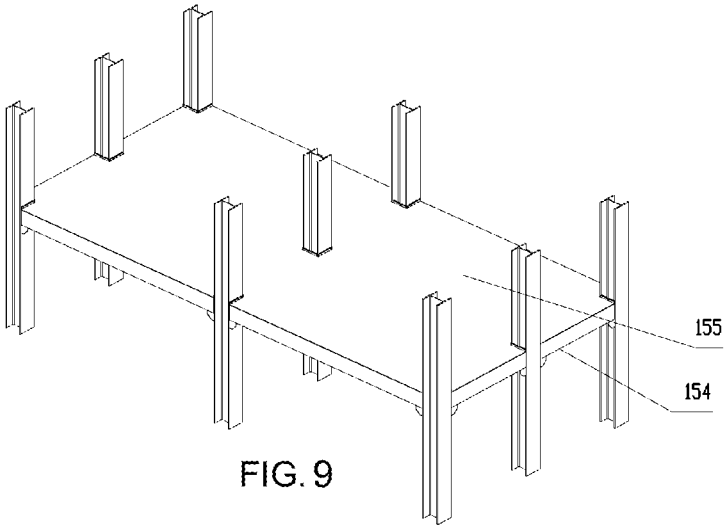
FIG. 9 is the solid view of Embodiment 5 of the invention.
Figure 10:
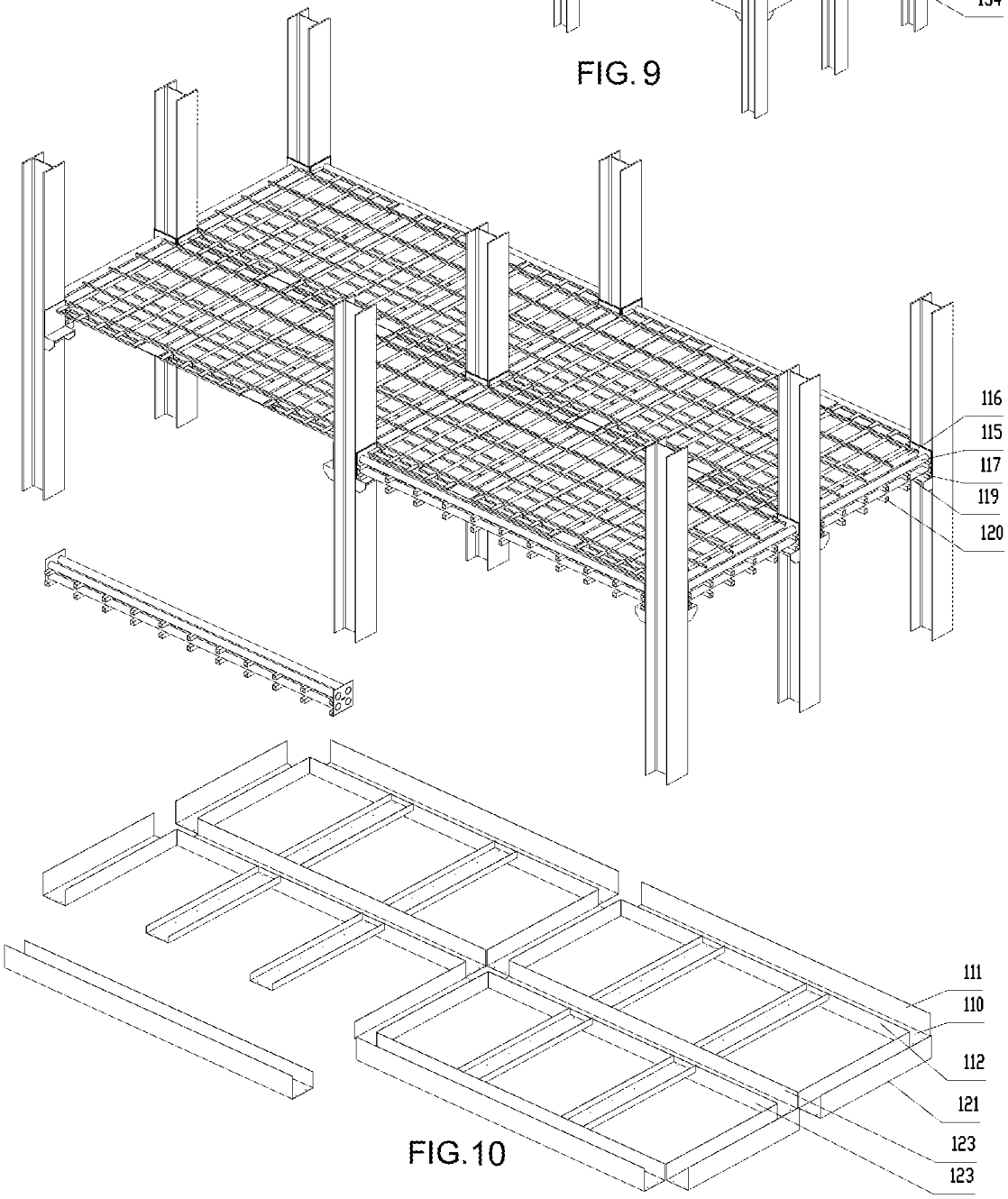
FIG. 10 is the solid breakdown view of Embodiment 5 of the invention with concrete removed.
Figure 11:
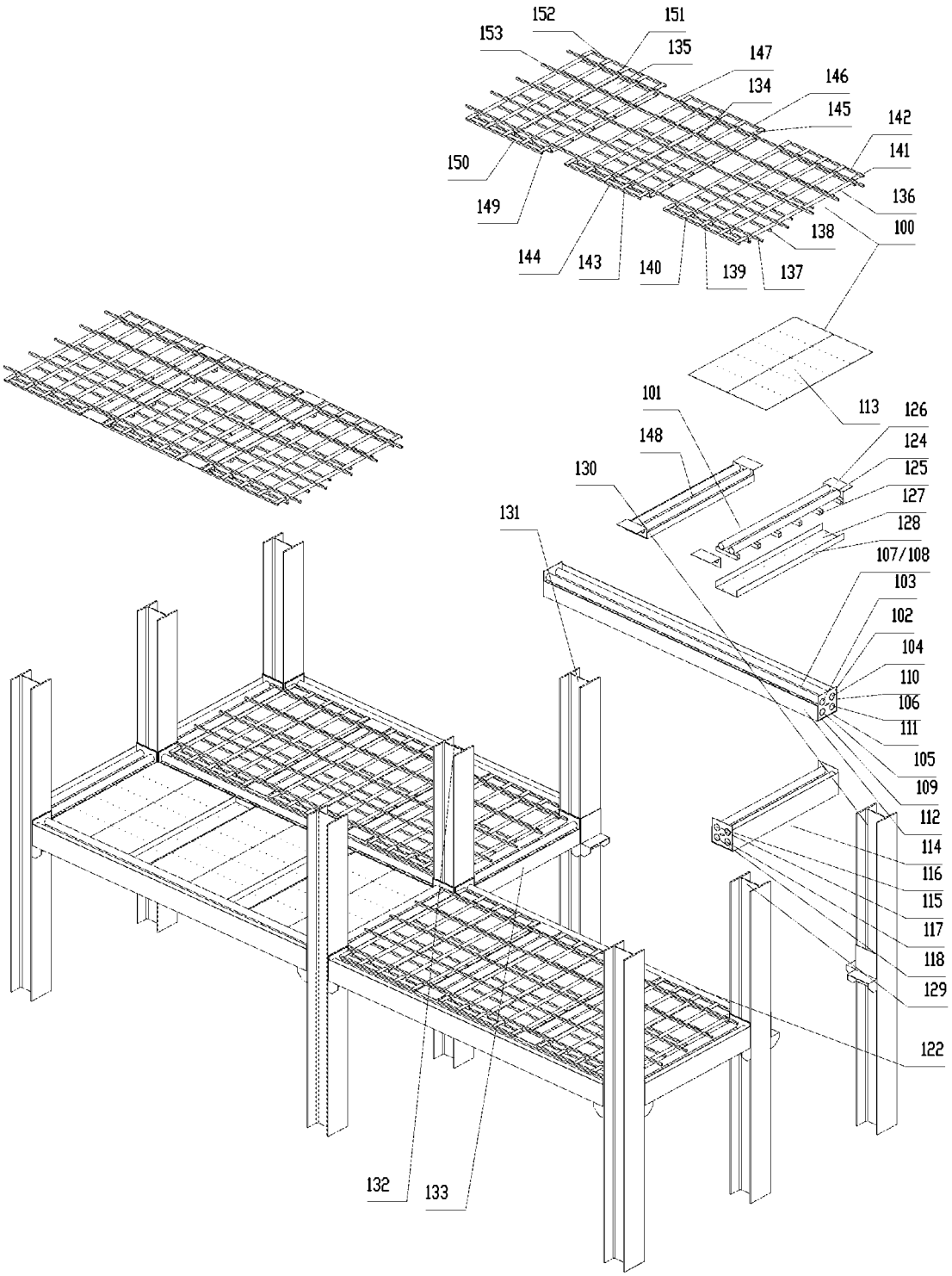
FIG. 11 is another solid breakdown view of Embodiment 5 of the invention with concrete removed.

As shown in FIG. 9 to FIG. 11, the difference from Embodiment 1 is that two secondary beam unit 101 and 148 parallel to the beam units are installed between every two adjacent longitudinal beam units. The structure of all main the beam framework units is different from that in embodiment 1.

As shown in FIG. 10 and FIG. 11, the beam template also comprises Bottom Plate 110 parallel to the horizontal plane and Outer Side Plate 111 and Inner Side Plate 112 perpendicular to Bottom Plate 110. beam Unit 102 is a side beam unit and comprises a main the beam framework unit and a beam template fixed on the beam framework unit. The beam framework unit comprise four load-bearing round tube type section steel beam keels 103, 104, 105 and 106 with completely the same structure and large cross sectional area, wherein beam keels 103 and 104 are arrayed in the horizontal direction, and beam keels 105 and 106 are respectively located in the same horizontal position right below beam keels 103 and 104; The beam framework unit also comprises eleven evenly arrayed square tube type section steel beam minor keels 107 with small cross sectional area perpendicular to beam keels 103 and 104, with the top surfaces being fixed with the bottom parts of beam keels 103 and 104 through welding and bottom surfaces being fixed with the top parts of beam keels 105 and 106 through welding, and both ends of each of beam keels 103, 104, 105 and 106 are flush with the outer side faces of the outermost beam minor keels 107; The beam framework unit also comprises eleven evenly arrayed square tube type section steel beam minor keels 108 with small cross sectional area respectively located right below the beam minor keels 107 and perpendicular to beam keels 103 and 104, with the top surfaces being fixed with the bottom parts of beam keels 105 and 106 through welding and bottom surfaces being fixed with Bottom Plate 110 of the beam template through welding, and both ends of each of beam keels 105 and 106 are flush with the outer side faces of the corresponding outermost beam minor keels 108; The beam framework unit also comprises Two-end Plate 109 respectively placed at both ends of beam keel 103, and the Two-end Plate 109 are respectively fixed with both ends of each of beam keels 103, 104, 105 and 106 and the outer side faces of the corresponding outermost beam minor keels 107 and 108 through welding. The top face of Bottom Plate 110 is attached to the bottom face of the beam minor keels 108, Inner Side Plate 112 is attached to Floor Slab Template 113, the top face of the inner side plate 112 is flush with the top face of Bottom Plate 110, the bottom plate is fixed with the beam minor keels 108 through welding, and the top face of the outer side plate 111 is higher than the top faces of beam keels 103 and 104.

As shown in FIG. 10 and FIG. 11, beam Unit 114 has the structural difference from beam Unit 102 in that the quantity of beam Minor Keel 119 placed below beam keels 115 and 116 and above beam keels 117 and 118 is six, and the quantity of beam minor keels 120 placed below beam keels 117 and 118 is six; beam Template 121 and beam keels 115, 116, 117 and 118 of beam Unit 114 are shorter than the beam template and beam keels 103, 104, 105 and 106 of beam Unit 102, and the installation relation rotates by 90°.

As shown in FIG. 10 and FIG. 11, beam Unit 122 is a middle beam unit and has the structural difference from beam Unit 102 in that the top faces of the Two-side Plate 123 of the beam template of beam Unit 122 are flush with each other, the top faces of Two-side Plate 123 are flush with the top faces of all floor slab templates 113, and Two-side Plate 123 is attached to Floor Slab Template 113.

As shown in FIG. 10 and FIG. 11, the secondary beam unit 101 comprises a secondary beam framework unit and a secondary beam template; The secondary beam framework unit comprise two arrayed round tube type section steel beam keels 124 and also comprises two arrayed square tube type section steel secondary beam minor keels 125 with small cross sectional area placed below the beam keels 124 and perpendicular to and fixed with the beam keels 124; The secondary beam unit 101 also comprises angle brackets 126 respectively placed at both ends of the secondary beam keel 124, the vertical parts of Angle Bracket 126 are fixed with the corresponding end parts of the beam keels 124 and the outer side faces of the outermost secondary beam minor keels 125 through welding, the horizontal parts of Angle Bracket 126 are suspension parts, and the secondary beam framework unit is supported on the transverse main the beam framework units 102 and 122 the horizontal parts of Angle Bracket 126. The secondary beam framework comprises a bottom plate 127 parallel to the horizontal plane and Two-side Plate 128 perpendicular to Bottom Plate 127, the top faces of the Two-side Plate 128 of the secondary beam framework are flush with each other, the top faces of the Two-side Plate 128 are flush with the top faces of the floor slab templates 113, and the side plates 128 are attached to the floor slab templates 113.

As shown in FIG. 11, three floor slab units 100, 134 and 135 are arranged in cells formed by four pillars 129, 130, 131 and 132 and beam units 114, 102, 133 and 122 successively connected with the pillars 129, 130, 131, 132 and 129, with every two of the four pillars 129, 130, 131 and 132 being adjacent. The floor slab unit 100 has the structural difference from the floor slab unit in Embodiment 1 in that the floor slab unit 100 comprises a meshed floor slab framework unit and two floor slab templates 113 with the same structure. The floor slab framework unit comprise multiple evenly arrayed longitudinal load-bearing round tube type section steel major keels 136 with large cross sectional area, upper transverse square tube type section steel keels 137 fixed on the top parts of the longitudinal section steel major keels 136 and lower transverse square tube type section steel keels 138 fixed on the bottom parts of the longitudinal section steel major keels 136; suspension parts are arranged at the end faces of the both ends of the longitudinal section steel major keel 136 and comprise Angle Bracket 139 fixed at one end of the longitudinal section steel major keel 136 through welding, transverse square tube type section steel connecting strips 140 connected on the bottom parts of the horizontal parts of Angle Bracket 139, Angle Bracket 141 fixed at the other end, and transverse square tube type section steel connecting strips 142 connected on the bottom parts of the horizontal parts of Angle Bracket 141; The side faces of the transverse connecting strips 140 are flush with the side faces of Angle Bracket 139, and the side faces of the transverse connecting strips 142 are flush with the side faces of Angle Bracket 141. The upper transverse section steel keels 137 and the lower transverse section steel keels 138 are staggered; The end faces of the lower transverse section steel keels 138 are flush with the side faces of the floor slab templates, and the outer side faces of two outermost lower transverse section steel keels are flush with the corresponding side faces of the floor slab templates; The bottom faces of the lower transverse section steel keels 138 are attached to the top faces of the floor slab templates 113. Both ends of the upper transverse section steel keel 137 protrude out of the floor slab templates. The floor slab unit 100 is supported on the beam keels of Main the beam framework unit 122 the transverse connecting strips 140 connecting Angle Bracket 139 and is supported on the beam keels of Main the beam framework unit 102 the transverse connecting strips 142 connecting Angle Bracket 141; one end of the upper transverse section steel keel 137 is supported on the beam keels of beam Unit 114, and the other end is supported on the beam keels of the secondary beam unit 101.

The floor slab unit 134 is supported on the beam keels of Main the beam framework unit 122 via transverse connecting strips 144 connecting angle brackets 143 and is supported on the beam keels of Main the beam framework unit 102 via transverse connecting strips 146 connecting angle brackets 145; one end of the transverse section steel keel 147 is supported on the beam keels of the secondary beam unit 101, and the other end is supported on the beam keels of the secondary beam unit 148.

Floor Slab Framework Unit 135 is supported on the beam keels of Main the beam framework unit 122 via transverse connecting strips 150 connecting angle brackets 149 and is supported on the beam keels of Main the beam framework unit 102 via transverse connecting strips 152 connecting angle brackets 151; one end of the transverse section steel keel 153 is supported on the beam keels of the secondary beam unit 148, and the other end is supported on the beam keels of the secondary beam unit 133.

The construction method has the difference the embodiment in that after beam units in the same cell are installed, secondary beam units are installed on corresponding beam units, and then template units are installed.

beam 154 in this building structure protrudes out of Floor Slab 155 to form the exposed beam type slab-pillar-beam building structure.

Embodiment 6

Figure 12:
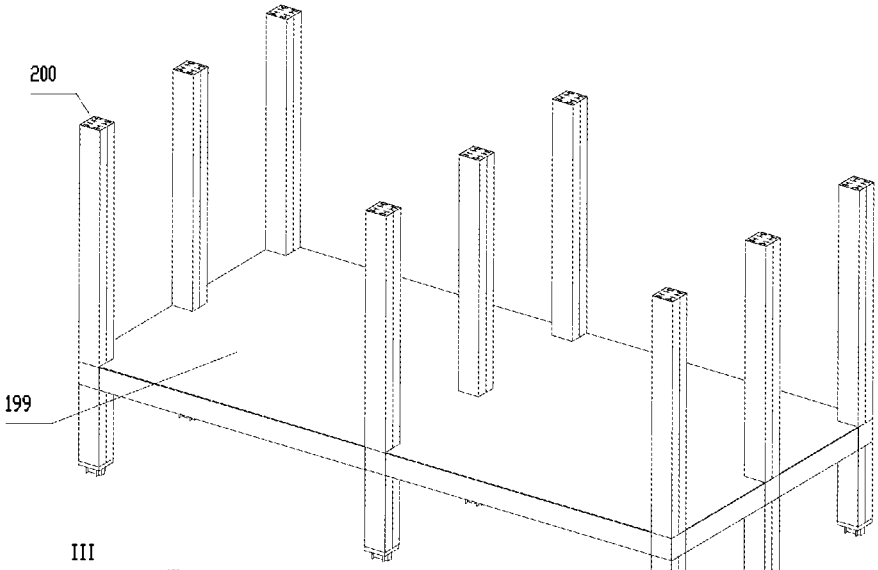
FIG. 12 is the solid view of Embodiment 6 of the invention.
Figure 13:
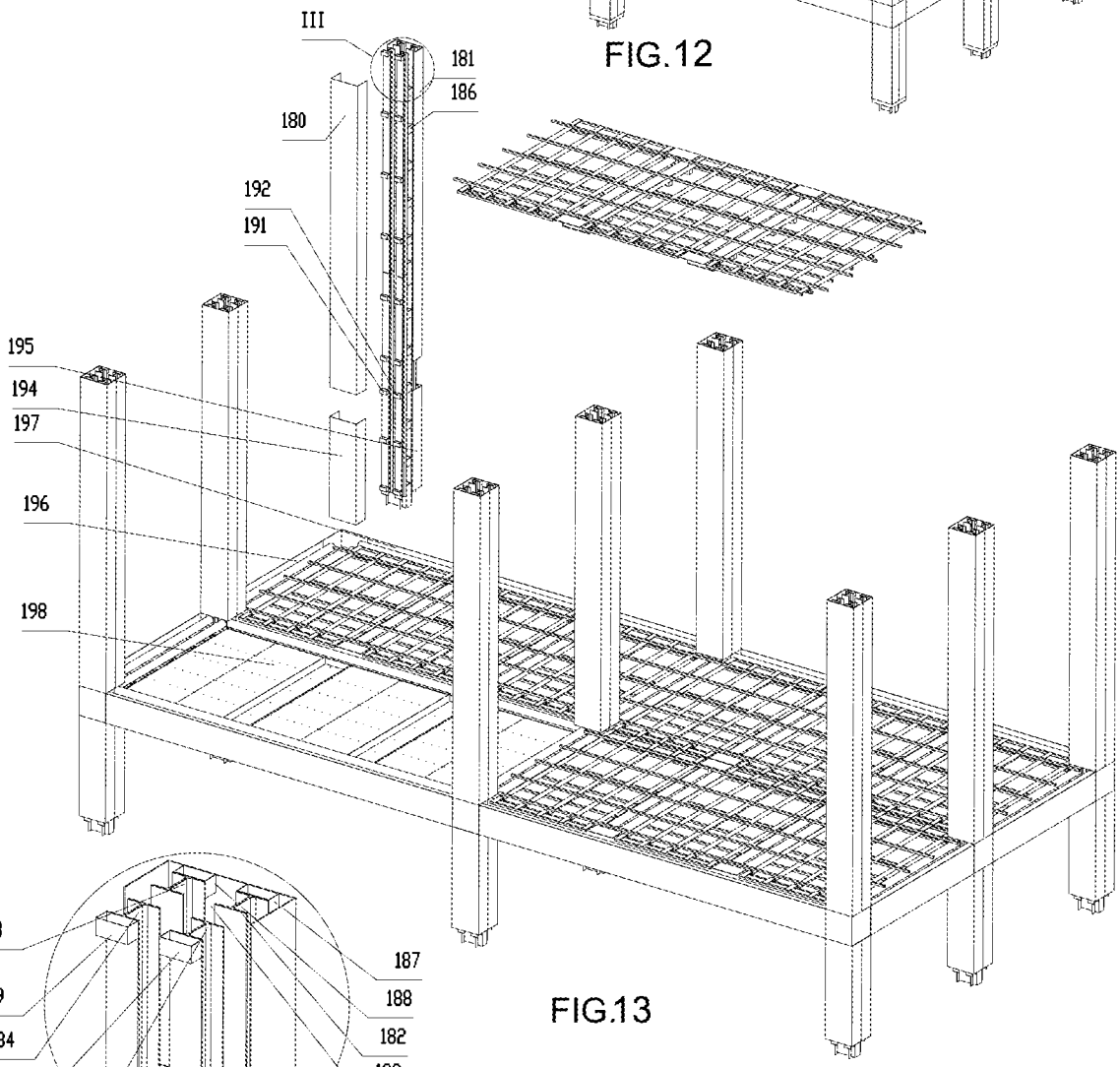
FIG. 13 is the solid breakdown view of Embodiment 6 of the invention with concrete removed.
Figure 14:
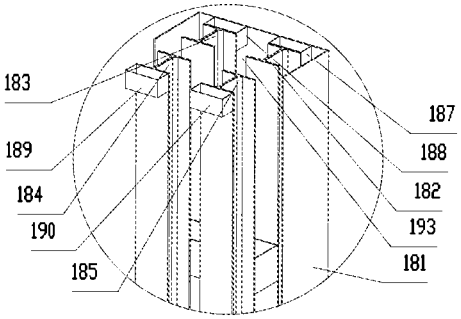
FIG. 14 is the enlarged view of the Part III of FIG. 13.

As shown in FIG. 12 to FIG. 14, the difference from Embodiment 5 is that Pillar Unit comprises a pillar framework unit and pillar templates. Two pillar templates 180 and 181 are arranged at the same height.

The pillar framework unit comprise a pillar keel unit and support legs fixed on the pillar keel units and used for supporting main the beam framework units. The pillar keel unit comprise four vertical load-bearing pillar major keels 182, 183, 184 and 185 distributed at four corners of a rectangle.

The pillar framework unit also comprises multiple vertically arrayed short connecting tubes 186 with vertical axes, multiple vertically arrayed short spacing tubes 187 and 188 with vertical axes and short spacing tubes 189 and 190, the short connecting tubes 186 are installed between the pillar major keel 182 and the pillar major keel 183 and between the pillar major keel 185 and the pillar major keel 184 and used for spacing the pillar major keel 182 and the pillar major keel 183 as well as the pillar major keel 185 and the pillar major keel 184 and fixing the pillar major keels 182, 183, 184 and 185 of the same pillar at the same height together, the short spacing tubes 187 and 188 are respectively welded on the outer side faces of the pillar major keels 182 and 183 opposite to the pillar major keels 185 and 184, and the short spacing tubes 189 and 190 are respectively welded on the outer side faces of the pillar major keels 184 and 185 opposite to the pillar major keels 183 and 182 and are symmetrical to the short spacing tubes 188 and 187 about the vertical plane in the central position; The support legs are short spacing tubes 191 and 192 fixed on the pillar major keels 184 and 185; The pillar template 180 penetrates through the short spacing tube 189 to be fixed with the pillar major keel 184 and penetrates through the short spacing tube 190 to be fixed with the pillar major keel 185 via fasteners (not shown); The pillar template 181 penetrates through the short spacing tube 187 to be fixed with the pillar major keel 182 and penetrates through the short spacing tube 188 to be fixed with the pillar major keel 183 via fasteners (not shown). A closed square tubular cavity 193 is formed by the pillar templates 180 and 181 at the same height, spaces are arranged between the pillar template 180 and the relative side faces of the pillar major keels 184 and 185, and spaces are arranged the pillar template 181 and the relative side faces of the pillar major keels 182 and 183. Pillar templates 194 and 195 with completely the same cross section structure with the pillar templates 180 and 181 are also arranged right below the templates 180 and 181. The pillar template 194 penetrates through the short spacing tube 189 to be fixed with the pillar major keel 184 and penetrates through the short spacing tube 190 to be fixed with the pillar major keel 185 via fasteners (not shown); The pillar template 195 penetrates through the short spacing tube 187 to be fixed with the pillar major keel 182 and penetrates through the short spacing tube 188 to be fixed with the pillar major keel 183 via fasteners (not shown). Empty avoiding spaces are arranged in the positions where the combined pillar templates 180, 181, 194 and 195 are matched with the beam units 196 and 197. The axes of all the short connecting tubes are vertical, and concrete will fill in the cavities of the short connecting tubes and the short spacing tubes; so the rigidity of the longitudinal short connecting tubes and the short spacing tubes and the binding force of concrete are enhanced, and the building structure is better, firmer and safer.

All combined pillar units, beam templates of the beam units and floor slab templates of the floor slab units are spliced together to form a concave cavity 198 with an upward opening, and the square tubular cavity 193 formed by the pillar templates of all pillars is intercommunicated with the concave cavity of corresponding storey. Concrete 199 is poured into the concave cavity 198, with all beam keels, partial beam minor keels, all longitudinal section steel major keels, all upper transverse section steel keels and partial lower transverse section steel keels of this storey being embedded into the concrete 199, concrete 200 is poured into the square tubular cavity 193, with all pillar major keels, short connecting tubes, short spacing tubes and major connecting tubes being embedded into the concrete 200, and the concrete 199 and the concrete 200 form an integral structure. Integral floor slabs, beams and pillars are formed by all main the beam framework units, floor slab framework units and concrete, as well as all pillar units and concrete.

The construction method of the building structure has the difference Embodiment 1 in this Embodiment pillar templates are installed after the installation of floor slab units: the pillar templates are fixed with the corresponding pillar framework units; The square tubular cavity 193 formed by the pillar templates is intercommunicated with Concave Cavity 198 of the corresponding storey; Concrete 199 is poured into Concave Cavity 198, and Concrete 200 is poured into the square tubular cavity 193; all beam keels, some or all of beam minor keels, all longitudinal section steel major keels and some or all of transverse section steel keels are embedded into the concrete 199 in the concave cavity 198; all pillar keel units are embedded into Concrete 200 in the square tubular cavity 193; after setting of Concrete 199 and the concrete 200, integral floor slabs, beams and pillars are formed by all main the beam framework units, floor slab framework units and concrete, as well as all pillar framework units and concrete.

Embodiment 7

Figure 15:
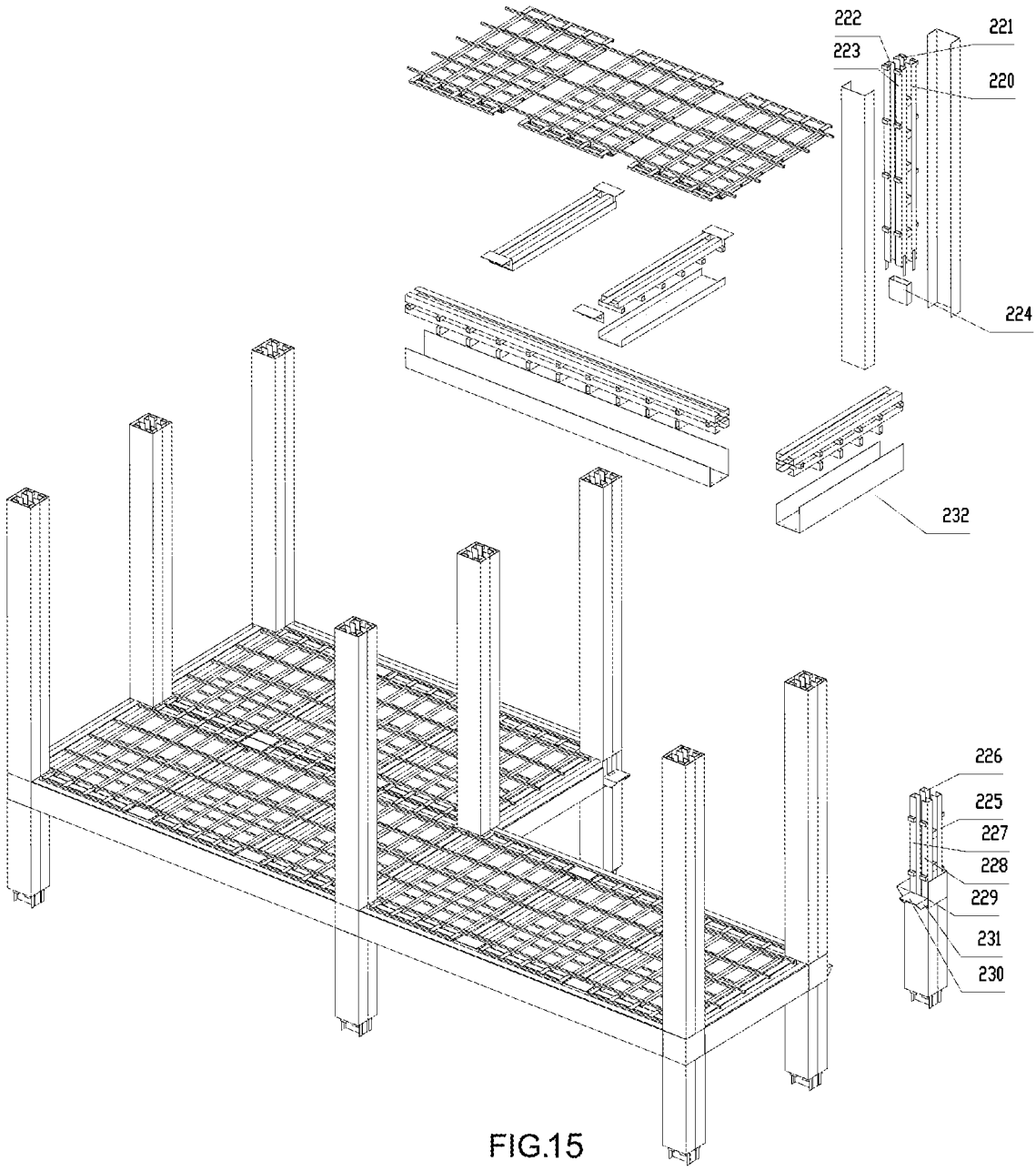
FIG. 15 is the solid breakdown view of Embodiment 7 of the invention with concrete removed.

As shown in FIG. 15, the difference from Embodiment 6 in that the longitudinal load-bearing section steel major keels of all floor slab units are square tube type section steel with large cross sectional area. The beam keels of all beam units are load-bearing channel steel with large cross sectional area, with the openings of two beam keels of the same main the beam framework unit in the same horizontal direction being relative to each other.

The pillar keel unit comprise four vertical load-bearing channel steel pillar major keels 220, 221, 222 and 223 with relative openings and the same structure distributed at four corners of a rectangle and four C-shaped pillar major keels 225, 226, 227 and 228 with the same cross section structure located right below the pillar major keels 220, 221, 222 and 223, and the pillar major keels 220, 221, 222 and 223 are attached, connected and fixed with the pillar major keels 225, 226, 227 and 228 through four side faces of a large connecting tube 224.

A support leg comprises a fixed plate 229, a bearing plate 230 and two rib plates 231, the bearing plate 230 is welded on Fixed Plate 229, with the bearing plate 230 forming a 90° angle with Fixed Plate 29, and the rib plates 231 are placed below the bearing plate 230 and welded with Fixed Plate 229 and the baring plate 230 together so as to increase the strength of the support leg. Fixed Plate 229 is welded on the side faces of the pillar major keels 227 and 228, and the bearing plate 230 is used for bearing a beam unit 232.

The construction method of the building structure has the difference Embodiment 6 in this Embodiment is that:

After position and install pillar framework units, install Pillar templates: The pillar templates are fixed with corresponding pillar framework units; A tubular cavity is formed by the pillar templates of the same height; The concrete is poured into tubular cavity; The pillar framework units above the faces of support legs supporting the beam keels are not embedded into the concrete in the concave cavity;

The beam units are hoisted;

The floor slab units are hoisted and placed into the cells; Combined pillar framework units, beam templates and floor slab templates are spliced together to form a concave cavity with an upward opening;

The concrete is poured into the concave cavity and tubular cavity which haven't been not poured into the concrete; The beam framework units and floor framework units are embedded into the concrete in the concave cavity; All the pillar keel units are embedded into the concrete in the tubular cavity, and an integral structure is formed by the concrete in the concave cavity and the concrete in the tubular cavity; After the concrete sets, the integral floor slabs, beams and pillars are formed by all the beam framework units, the floor slab framework units and the concrete and all the pillar framework units and the concrete.

Embodiment 8

Figure 16:
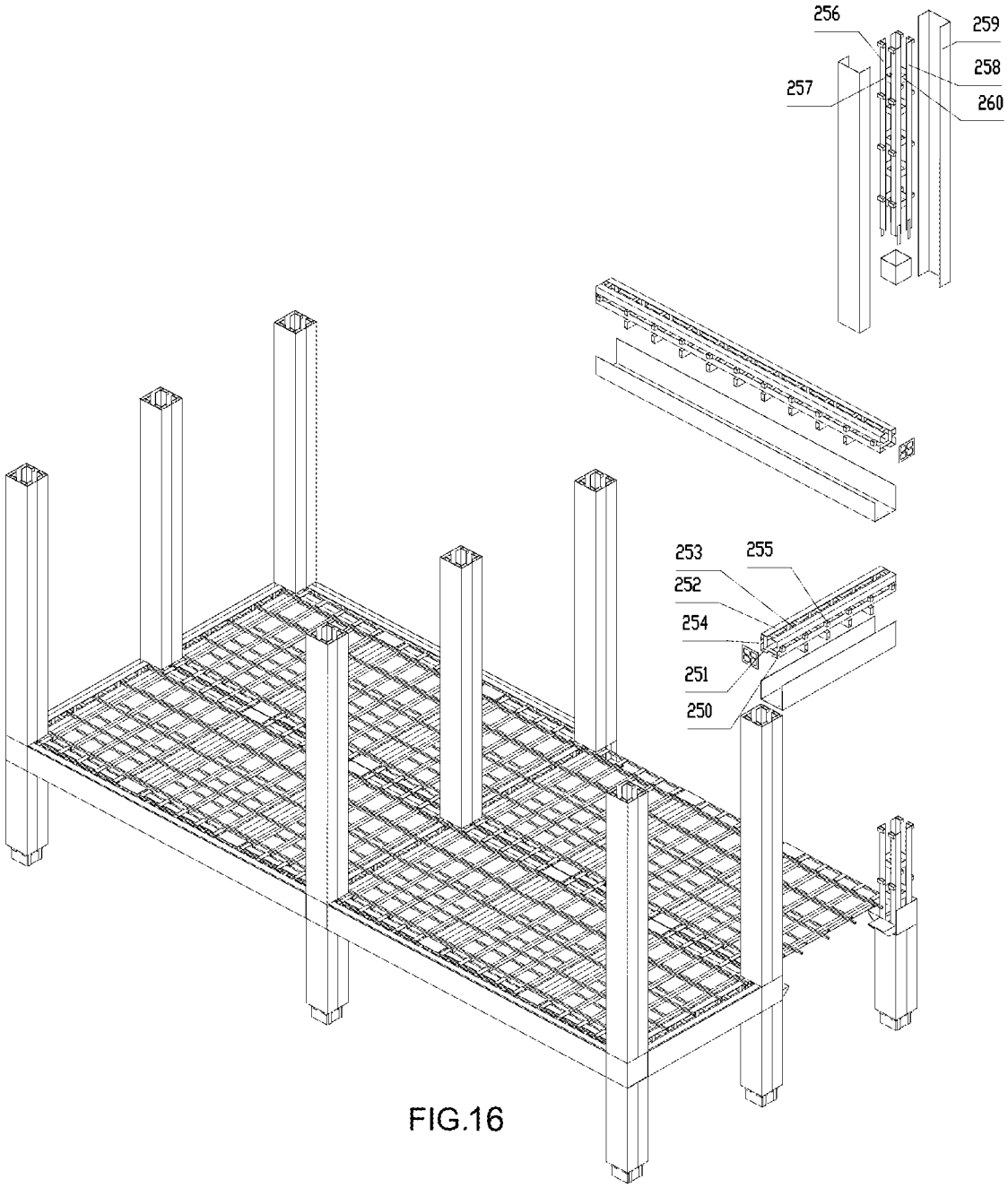
FIG. 16 is the solid breakdown view of Embodiment 8 of the invention with concrete removed.

As shown in FIG. 16, the difference from Embodiment 7 is that beam keels of all main the beam framework units are load-bearing L-shaped section steel with large cross sectional area. Four beam keels 250, 251, 252 and 253 of the same beam unit are arranged in opposite directions to form a rectangle, the four beam keels 250, 251, 252 and 253 are fixed through elongated L-shaped section steel 254, and the beam keel 253 is fixed with the L-shaped section steel 254 and the beam keel 251 through multiple short square tubes 255.

Pillar major keels of all pillar units are load-bearing L-shaped section steel. Four pillar major keels 256, 257, 258 and 259 of the same pillar unit are arranged in opposite directions to form a rectangle, and short connecting tubes 260 are attached and fixed with the pillar major keels 256, 257, 258 and 259.

Embodiment 9

Figure 17:
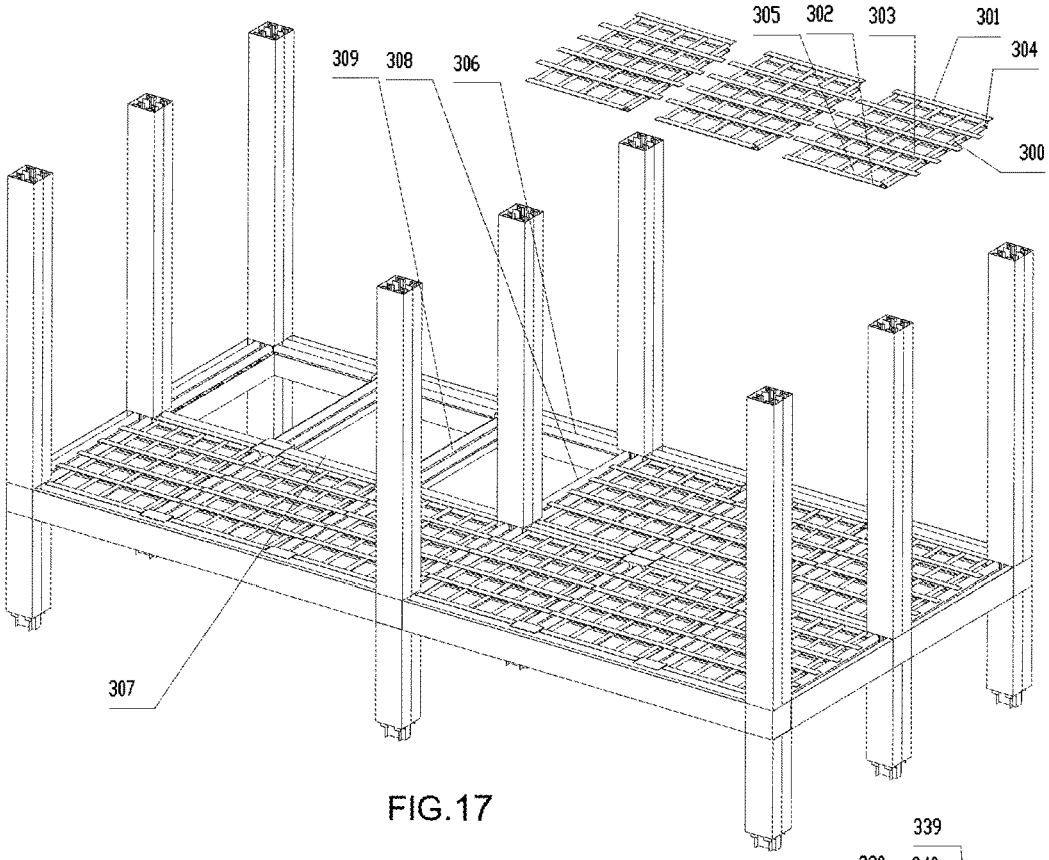
FIG. 17 is the solid breakdown view of Embodiment 9 of the invention with concrete removed.

As shown in FIG. 17, the difference from Embodiment 6 is that a floor slab framework unit comprise multiple evenly arrayed longitudinal load-bearing round tube type section steel major keels 300 with large cross sectional area, outermost elongated flat plates 301 and 302 and multiple horizontally arrayed middle flat plates 303 fixed at top parts of the longitudinal section steel major keels 300, and multiple lower transverse square tube type section steel keels 304 fixed at the bottom parts of the longitudinal section steel major keels 300; The outermost flat plates 301 and 302 protrude out of the end parts of the longitudinal section steel major keels 300 to form suspension parts. Both ends of the flat plate 303 protrude out of a floor template 305. A floor slab unit is supported on beam keels of a main the beam framework unit 306 through the outermost flat plate 301, and is supported on beam keels of a main the beam framework unit 307 through the outermost flat plate 302; one end of the flat plate 301 is supported on beam keels of a main the beam framework unit 308, and the other end is supported on the beam keels of a secondary beam unit 309.

Embodiment 10

Figure 18:
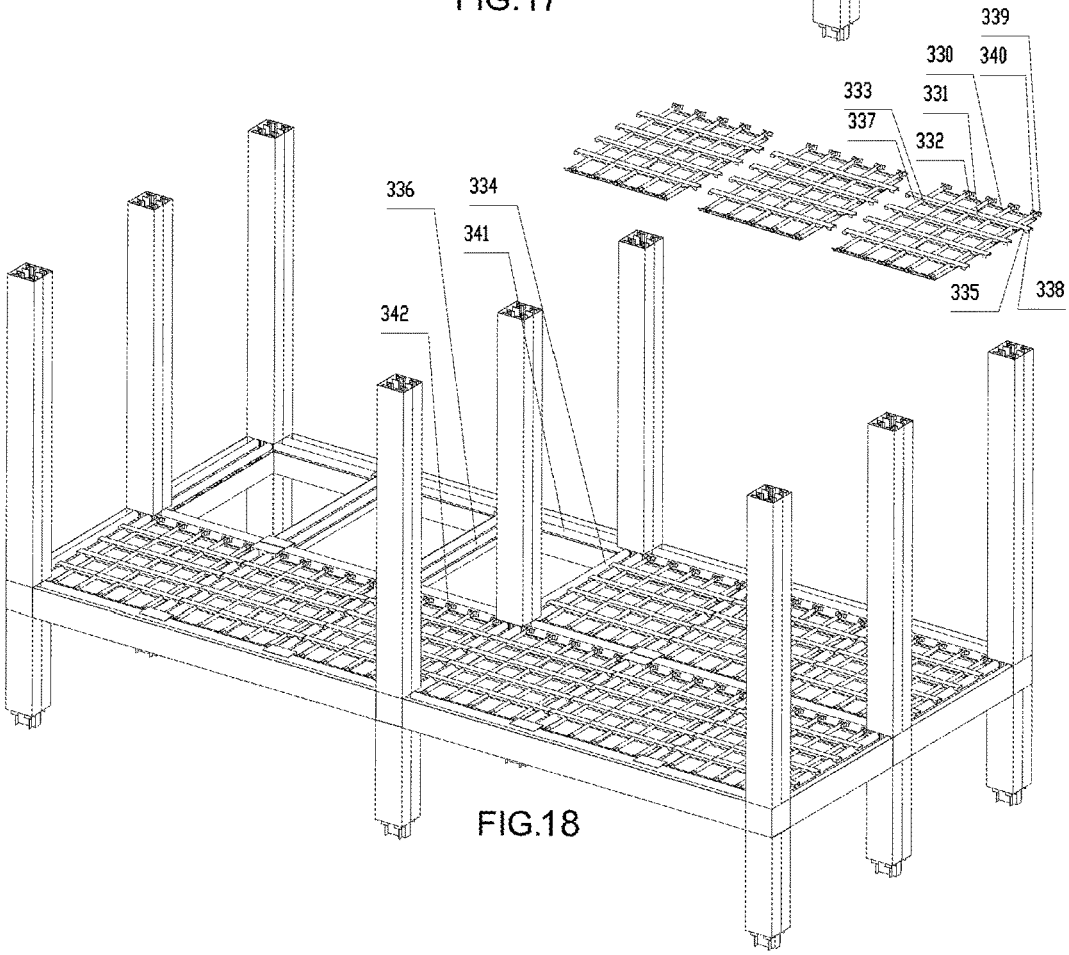
FIG. 18 is the solid breakdown view of Embodiment 10 of the invention with concrete removed.

As shown in FIG. 18, the difference from Embodiment 6 is that a floor slab framework unit comprise multiple evenly arrayed longitudinal load-bearing round tube type section steel major keels 330 with large cross sectional area, multiple pieces of horizontally arrayed middle channel steel 331 with downward openings fixed at top parts of the longitudinal section steel major keels 330, and multiple lower transverse square tube type section steel keels 332 fixed at the bottom parts of the longitudinal section steel major keels 330. Arc-shaped grooves 333 matched with the longitudinal section steel major keels 330, arc-shaped grooves 335 matched with the round tube type section steel beam keels 334 of the beam units and arc-shaped grooves 337 matched with the round tube type section steel the beam keels 336 of the secondary beam units are arranged on bottom parts of the channel steel 331, and both ends of the channel steel 331 protrude out of a floor slab template 338. Two special-shaped angle brackets 339 symmetrical about the vertical plane crossing the axis of the longitudinal section steel major keel 330 are welded at both ends of the longitudinal section steel major keel 330, and arc-shaped grooves 340 matched with the longitudinal section steel major keel 330 are arranged at the bottom parts of the special-shaped angle brackets 339. A floor slab unit is supported on round tube type section steel beam keels 341 of a main the beam framework unit through the special-shaped angle brackets 339 at one end of the longitudinal section steel major keel 330, and is supported on round tube type section steel beam keels 342 of the beam framework unit through the special-shaped angle brackets 339 at the other end of the longitudinal section steel major keel 330; one end of the channel steel 331 is supported on beam keels 334 of a beam unit, and the other end is supported on the beam keels 336 of a secondary beam unit.

Embodiment 11

Figure 19:
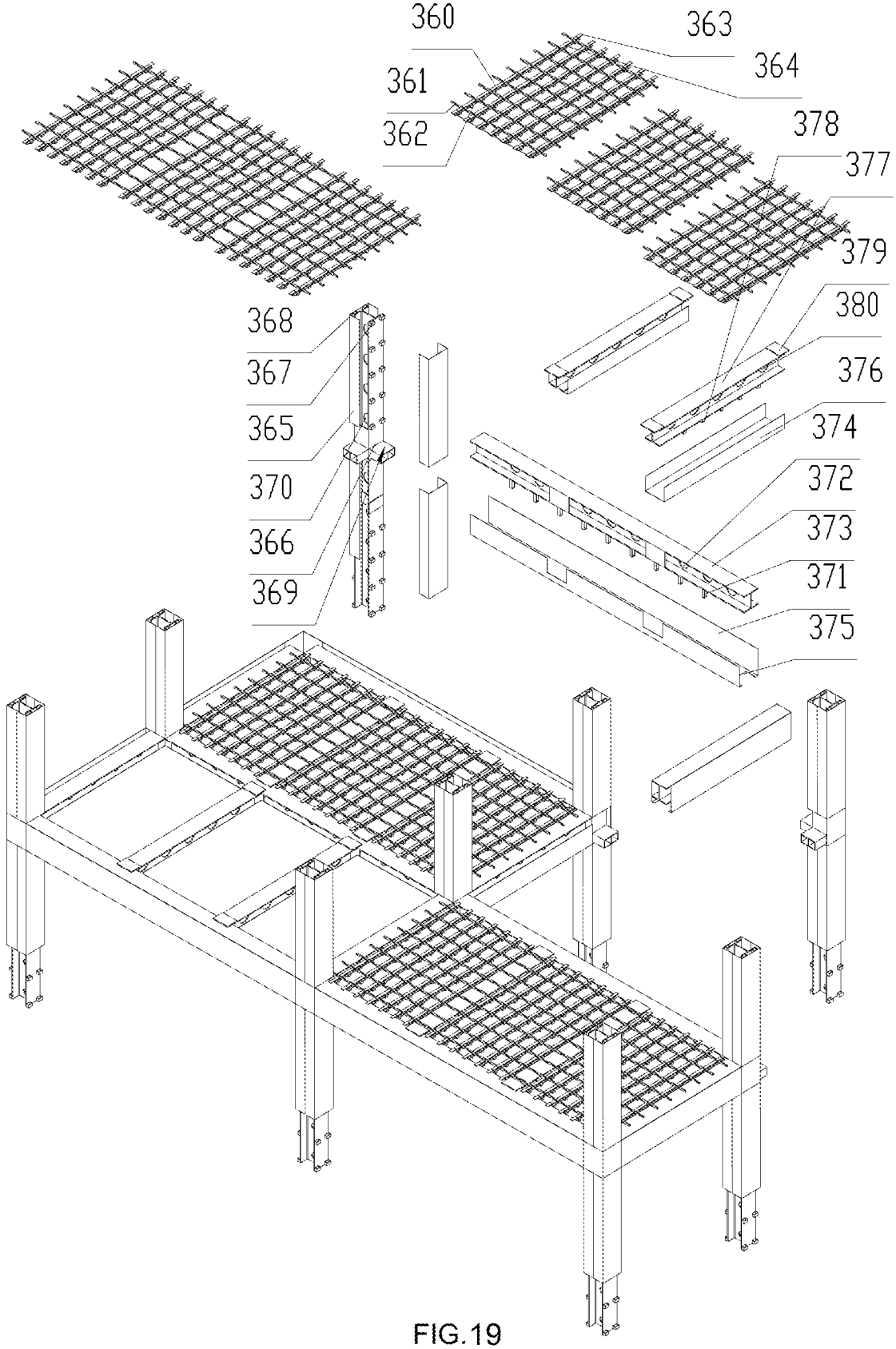
FIG. 19 is the solid breakdown view of Embodiment 11 of the invention with concrete removed.

As shown in FIG. 19, the difference from Embodiment 6 is that a floor slab framework unit comprise multiple evenly arrayed longitudinal load-bearing H type section steel major keels 360 with large cross sectional area, multiple upper transverse square tube type section steel keels 361 fixed at the top faces of the longitudinal section steel major keels 360 through welding, and multiple parallel short cushion tubes 362 with horizontal axes respectively fixed on the bottom face of each longitudinal section steel major keel 360 through welding, and small square steel plates 363 are welded at both ends of each longitudinal section steel major keel 360 to form suspension parts. Both ends of the upper transverse section steel keel 361 protrude out of a floor slab template 381. The bottom faces of the short cushion tubes 362 are attached to the top face of the floor slab template 381. The floor slab template 381 is fixed with the short cushion tubes 362 and the longitudinal section steel major keels 360 via fasteners (not shown). Multiple accommodating through holes 364 with horizontal axes are arranged on all webs of the longitudinal section steel major keels 360.

A pillar unit comprises a pillar framework unit and a pillar template 365. The pillar framework unit comprise one H type section steel pillar major keel 366, multiple vertically arrayed square tube type short spacing tubes 367 and 368 with vertical axes respectively welded on the outer side faces of opposite flanges of the pillar major keel 366, and a square tube type support leg 369 with horizontal axis welded on the pillar major keel 366 and used for supporting the beam framework unit. Multiple accommodating through holes 370 with horizontal axes are arranged on all webs of the pillar major keel 366. The pillar template 365 fixed with the short cushion tubes 368 and the pillar major keel 366 via fasteners (not shown).

A beam unit comprises a main the beam framework unit and a beam template 371 fixed on the beam framework unit. The beam framework unit comprises one horizontal load-bearing H type section steel beam keel 372 with large cross sectional area and also comprises multiple parallel square tube type short cushion tubes 373 with horizontal axes fixed on the bottom face of the beam keel 372 through welding and perpendicular to the beam keel 372. The bottom faces of the short cushion tubes 373 are attached to the top face of the beam template 371. The beam template 371 is fixed with the short cushion tubes 373 and the beam keel 372 via fasteners (not shown). Multiple accommodating through holes 374 with horizontal axes are arranged on all webs of the beam keel 372. An empty avoiding space 375 matched with Support Leg 369 of a pillar unit is arranged on a bottom plate of the beam template 371.

A secondary beam unit comprise a secondary beam framework unit and a secondary beam template 376; The secondary beam framework unit comprise one H type section steel secondary beam keel 377, multiple parallel square tube type short cushion tubes 378 with horizontal axes fixed on the bottom face of the secondary beam keel 377 through welding and perpendicular to the secondary beam keel 377; The secondary beam framework unit also comprises small square steel plates 379 respectively fixed on the top faces of the secondary beam keel 377 through welding, and the small square steel plates 379 form suspension parts. The bottom faces of the short cushion tubes 378 are attached to the top face of the secondary beam template 376. The secondary beam template 376 is fixed with the short cushion tubes 378 and the secondary beam keel 377 via fasteners (not shown). Multiple accommodating through holes 380 with horizontal axes are arranged on all webs of the secondary beam keel 377.

The axes of the short cushion tubes 362, 373 and 378 are horizontal. During concrete pouring, concrete will fill in the short cushion tubes; accommodating through holes are arranged on webs of the longitudinal section steel major keels 360, the pillar major keel 366, the beam keel 372 and the beam keels 377, and concrete will fill in the accommodating through holes during concrete pouring; so the binding force between the longitudinal section steel major keels 360, the pillar major keel 366, the beam keel 372 and the beam keels 377 and the concrete is enhanced, and the building structure is better, firmer and safer.

Embodiment 12

Figure 20:
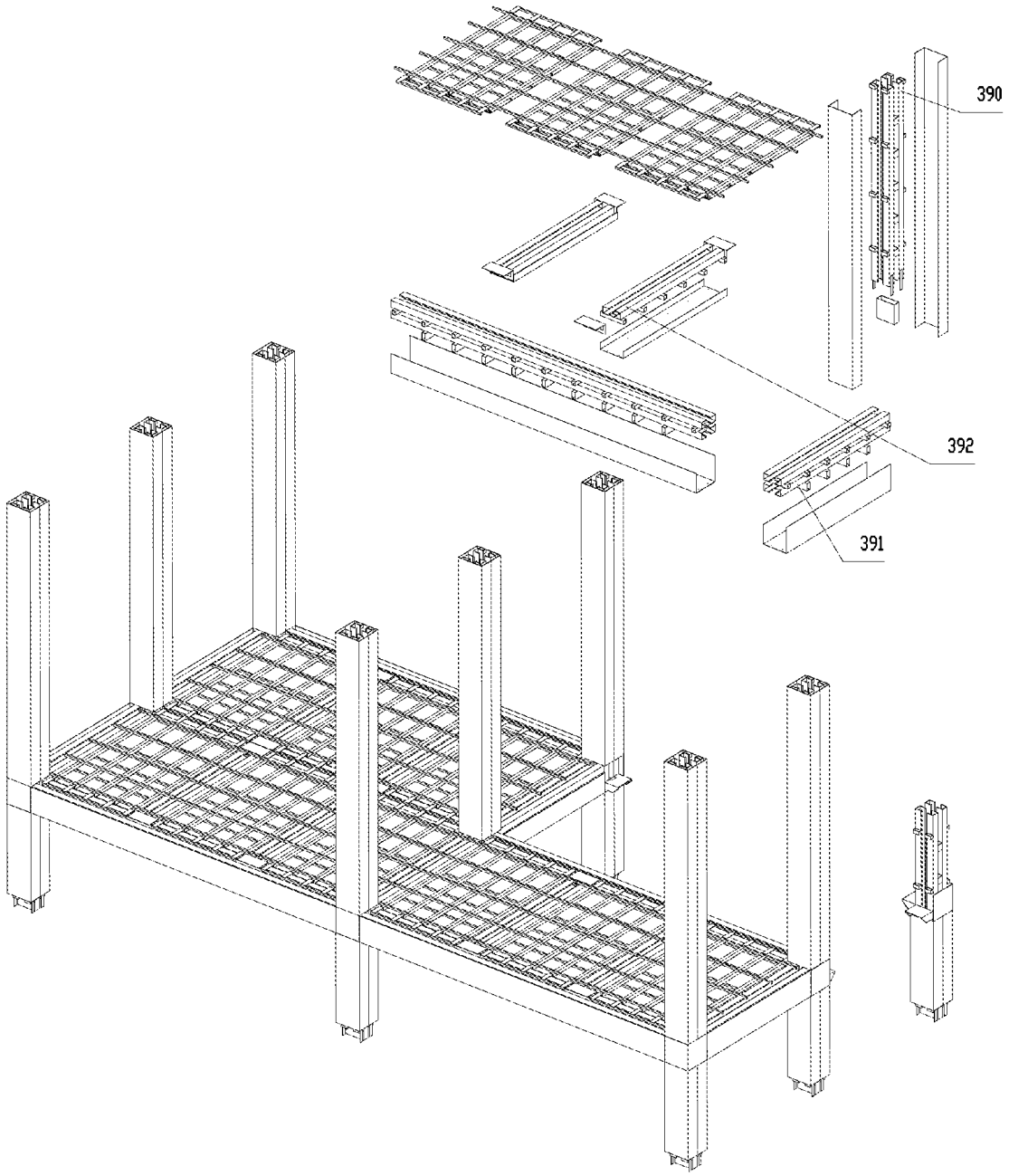
FIG. 20 is the solid breakdown view of Embodiment 12 of the invention with concrete removed.

As shown in FIG. 20, the difference from Embodiment 7 in that all pillar major keels 390 and all beam keels 391 are C-shaped section steel.

The structure diagram of only one storey is shown in the invention. Other unstated parts, such as connections and fixings between pillars of different stories, fixings between pillars and the foundation, etc., are the same to the prior art.

Embodiment 13

Figure 21:
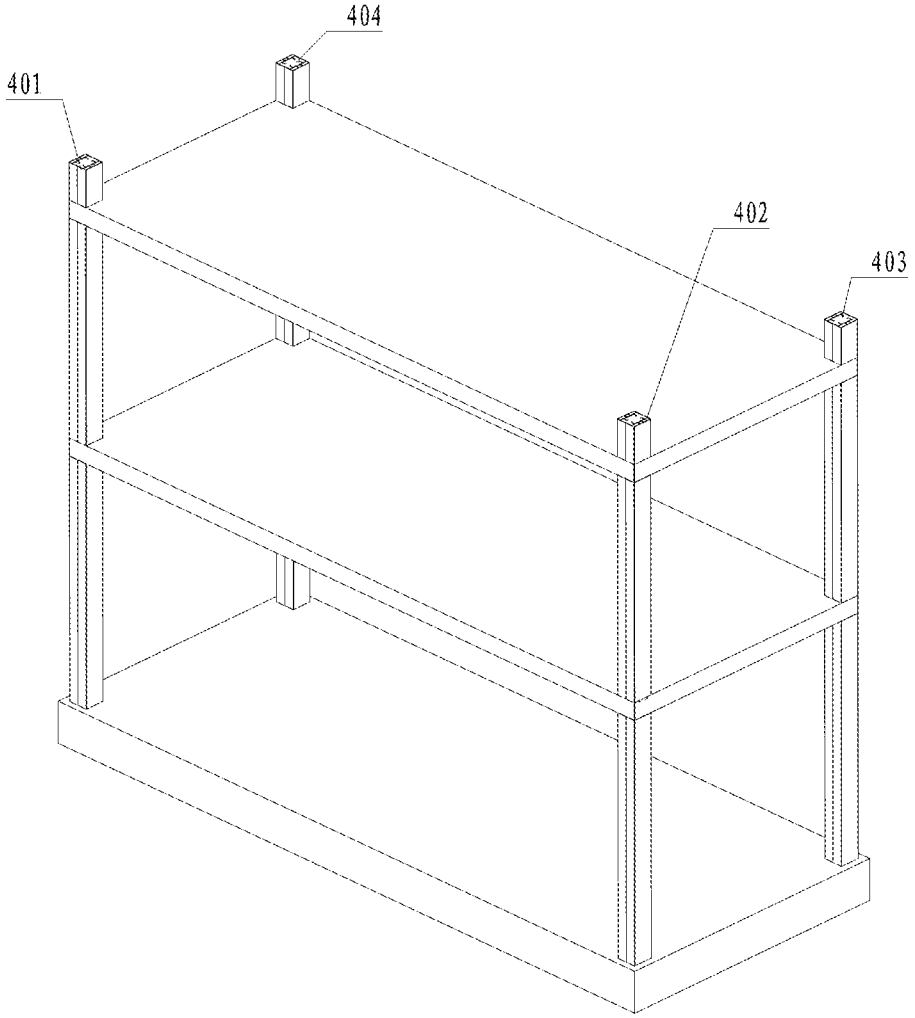
FIG. 21 is the solid view of Embodiment 13 of the invention.
Figure 22:
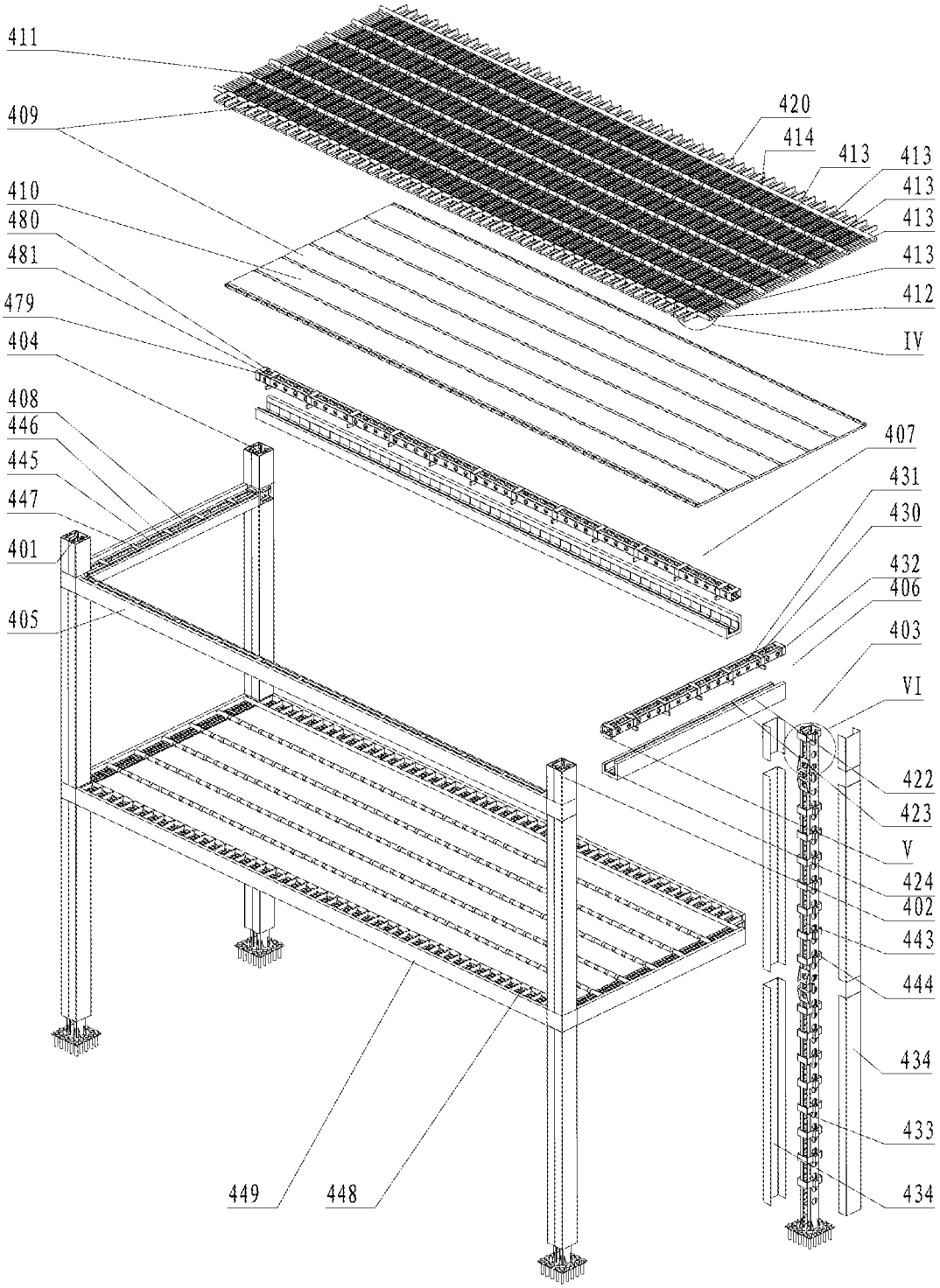
FIG. 22 is the solid breakdown view of Embodiment 13 of the invention before concrete is poured.

As shown in FIG. 21 and FIG. 22, a slab-pillar building structure comprises pairwise symmetrical pillar units 401, 402, 403 and 404 distributed at four corners of a rectangle; each storey also comprises a beam unit 405 installed between Pillar Unit 401 and Pillar Unit 402, a beam unit 406 installed between Pillar Unit 402 and Pillar Unit 403, a beam unit 407 installed between Pillar Unit 403 and Pillar Unit 404 and a beam unit 408 installed between Pillar Unit 404 and pillar unit 401; each storey also comprises a floor slab unit 409.

Figure 23:
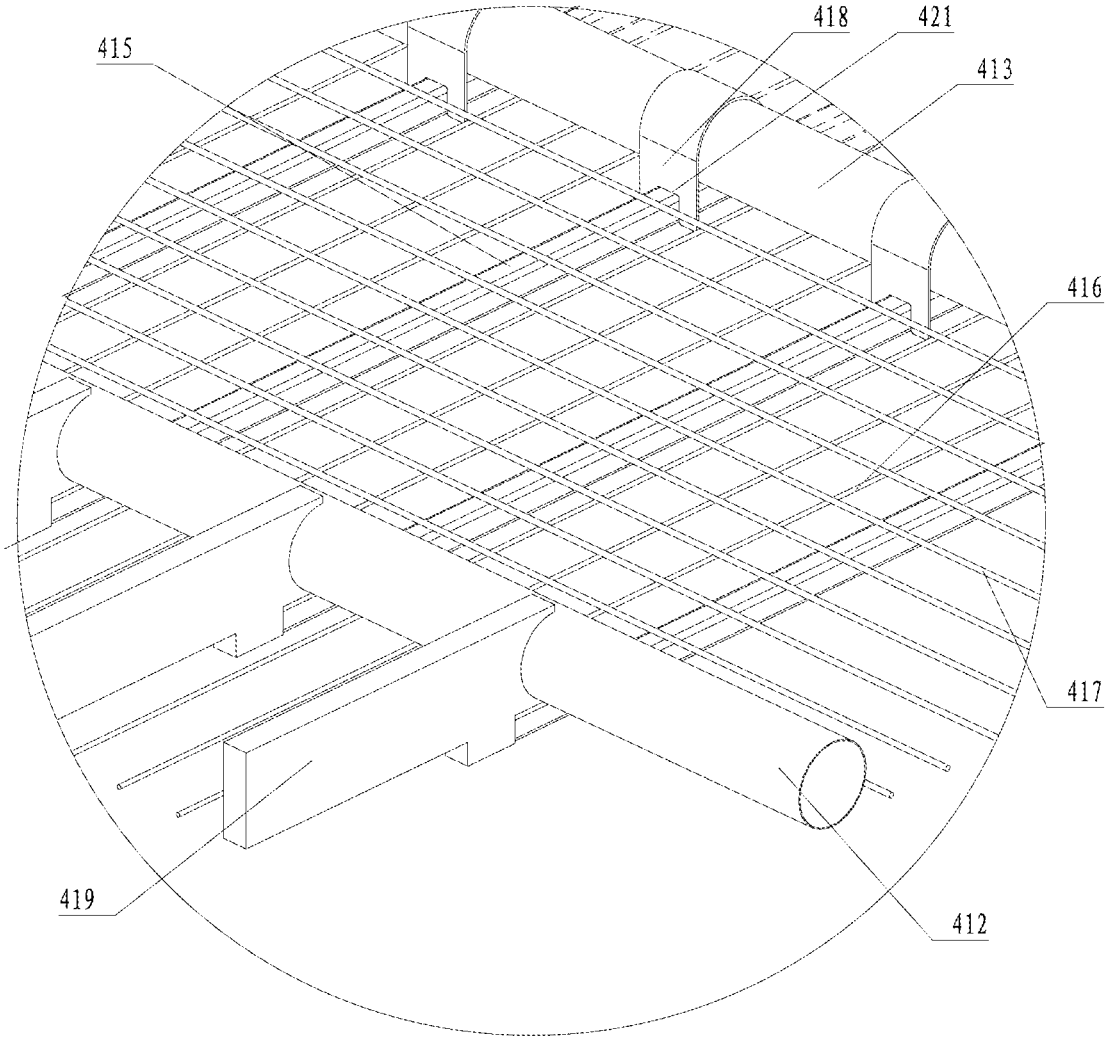
FIG. 23 is the enlarged view of the Part IV of FIG. 22.

As shown in FIG. 22 and FIG. 23, Floor Slab unit 409 comprises a flat plate type semi-precast floor slab template layer 410 of concrete and a Floor Slab Framework Unit 411 partially embedded into the semi-precast floor slab template layer 410. The Floor Slab Framework Unit 411 comprises multiple evenly arrayed outer longitudinal load-bearing round tube type section steel major keels 412 with large cross sectional area, five middle longitudinal section steel major keels 413, outer longitudinal section steel major keels 414, transverse square tube type section steel keels 415, first transverse steel bars 416, first longitudinal steel bars 417, U-shaped connectors 418, suspension parts 419 fixed at the outer sides of the longitudinal section steel major keels 412 through welding and suspension parts 420 fixed at the outer sides of the longitudinal section steel major keels 414 through welding.

U-shaped grooves 421 matched with the transverse section steel keels 415 are arranged on the U-shaped connectors 418. The first transverse steel bars 416 and the first longitudinal steel bars 417 are fixed together to form a steel bar mesh, the first longitudinal steel bars 417 are supported on the transverse section steel keels 415, the first transverse steel bars 416 are placed between two adjacent transverse section steel keels 415, and the first longitudinal steel bars 417 are placed between two connected longitudinal section steel major keels. The U-shaped connectors 418 are suspended to the middle longitudinal section steel major keels 413, and the transverse section steel keels 415 are placed below the longitudinal section steel major keels 412, installed in the U-shaped grooves 421 of the U-shaped connectors 418 and fixed with the longitudinal section steel major keels 413 and the U-shaped connectors 418 together through welding.

Figure 26:
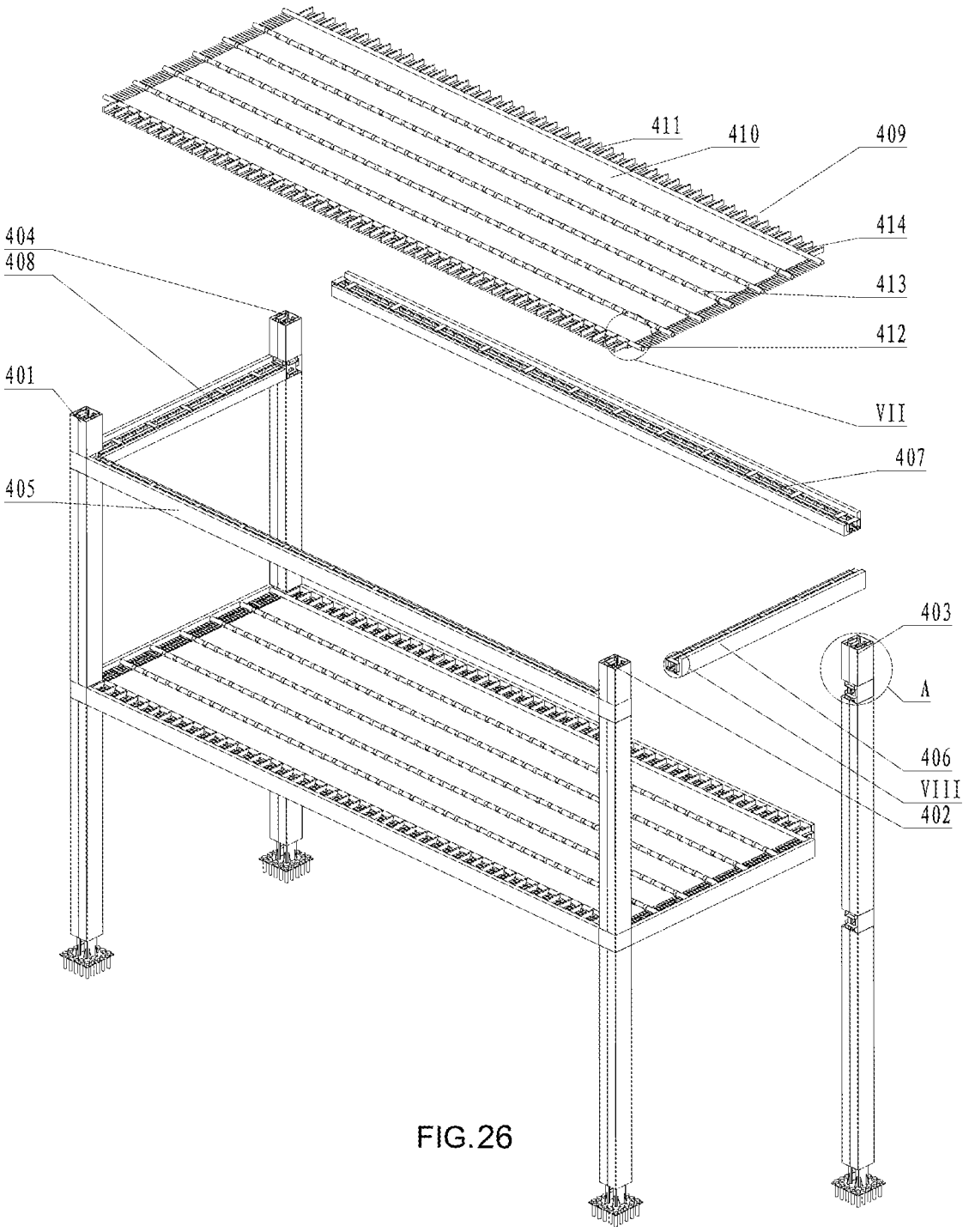
FIG. 26 is another solid breakdown view Embodiment 13 of the invention before concrete is cast.
Figure 27:
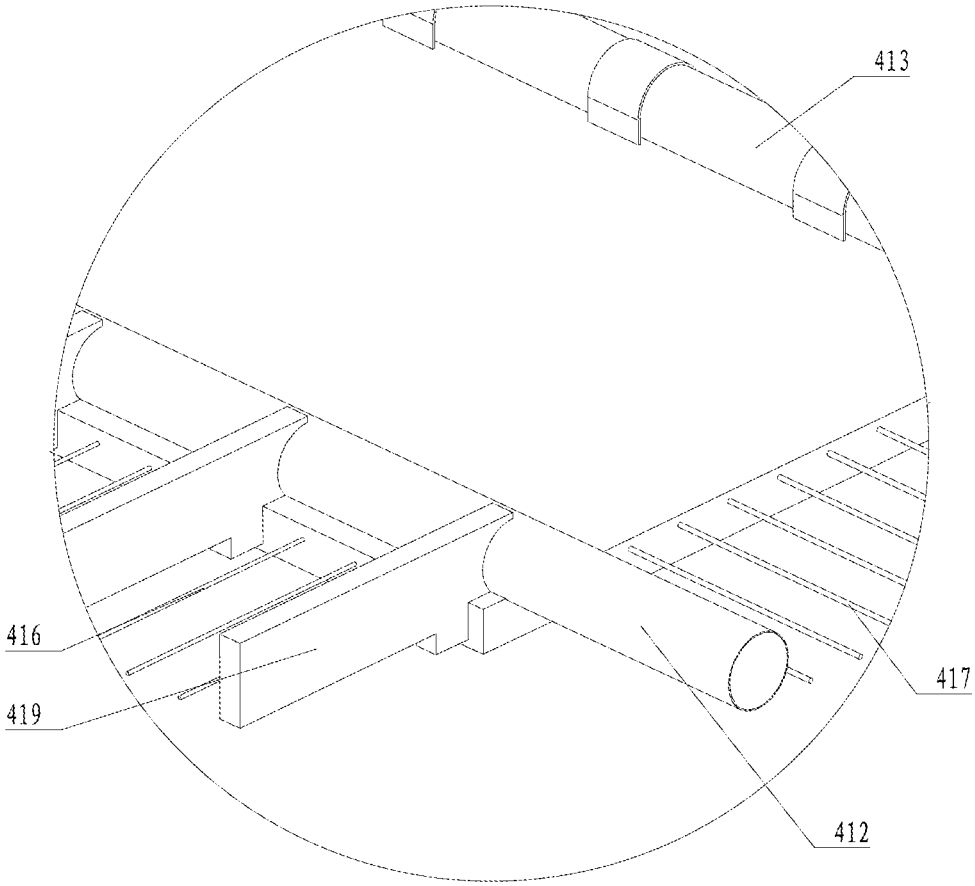
FIG. 27 is the enlarged view of the Part VII of FIG. 26.

As shown in FIG. 26 and FIG. 27, the Floor Slab Framework Unit 411 is partially embedded into the semi-precast floor slab template layer 410, the first transverse steel bars 416 and the first longitudinal steel bars 417 protrude out of the semi-precast floor slab template layer 410 only in the side direction, and the transverse section steel keels 415 are completely embedded into the semi-precast floor slab template layer 410; The longitudinal load-bearing section steel major keels 412 and the longitudinal section steel major keels 413 and 414 protrude out of the semi-precast floor slab template layer 410 only in the side direction and upward side, the U-shaped connectors 418 protrude out of the semi-precast floor slab template layer 410 only in the upward side, and the suspension parts 419 and 420 protrude out of the semi-precast floor slab template layer 410 only in the side direction and upward side.

Figure 24:
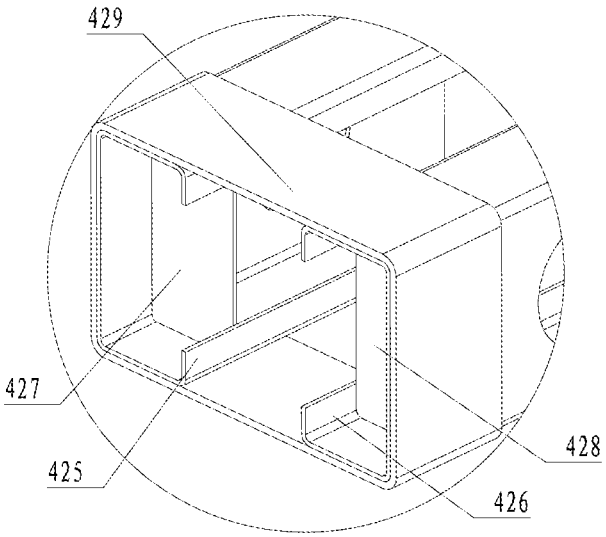
FIG. 24 is the enlarged view of the Part V of FIG. 22.
Figure 25:
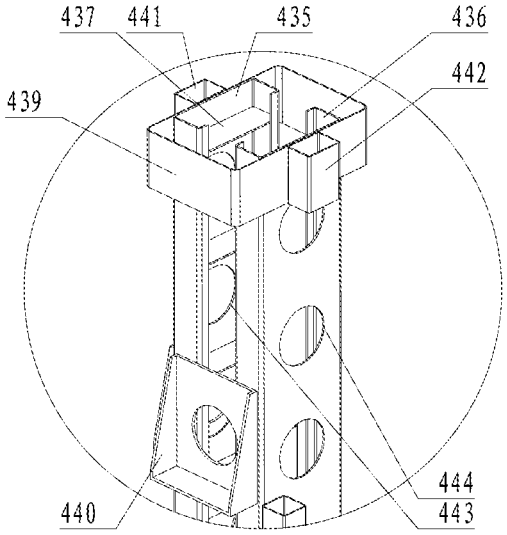
FIG. 25 is the enlarged view of the Part VI of FIG. 22.

As shown in FIG. 22 and FIG. 24, the beam unit 406 comprises a U-shaped semi-precast beam template layer 424 of concrete with high outer side wall 422 and low inner side wall 423 and a main the beam framework unit 430 partially embedded into the semi-precast beam template layer 424. The beam framework unit 430 two horizontally arranged C-shaped section steel beam keels 425 and 426 with relative openings, reinforces 427 vertically installed in the beam keel 425, reinforces 428 vertically installed in the beam keel 426, as well as square tube type sleeves 429. The two beam keels 425 and 426 penetrate through the square tube type sleeves 429, and the square tube type sleeves 429 are fixed and connected with the two beam keels 425 and 426 through welding.

Round holes 431 with horizontal axes are arranged on the beam keel 425, round holes 432 with horizontal axes are arranged on the beam keel 426, so that the binding force between the beam keels 425 and 426 and concrete is enhanced, and the building structure is better, firmer and safer.

Figure 28:
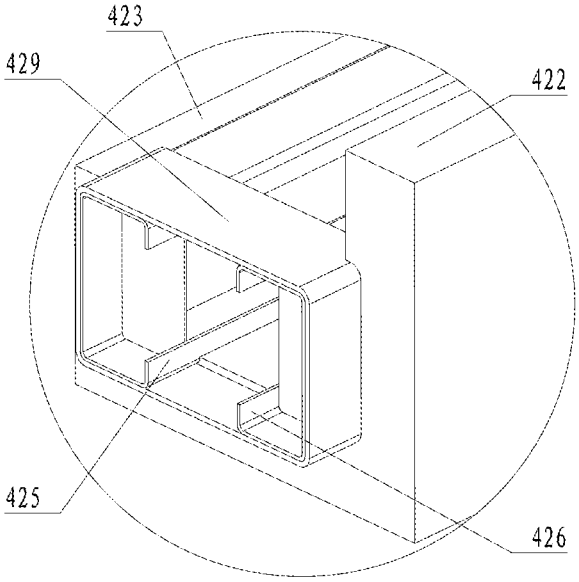
FIG. 28 is the enlarged view of the Part VIII of FIG. 26.
Figure 29:
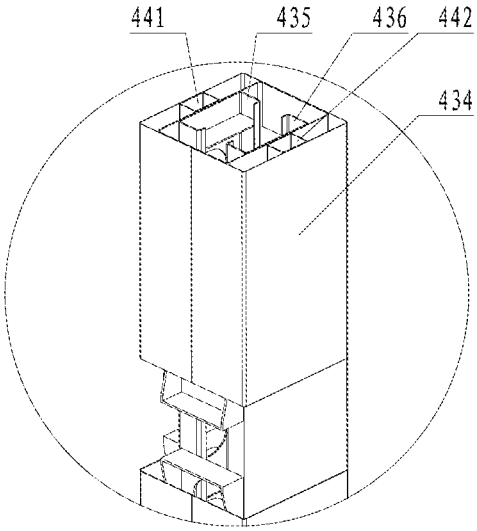
FIG. 29 is the enlarged view of the Part A of FIG. 26.
Figure 30:
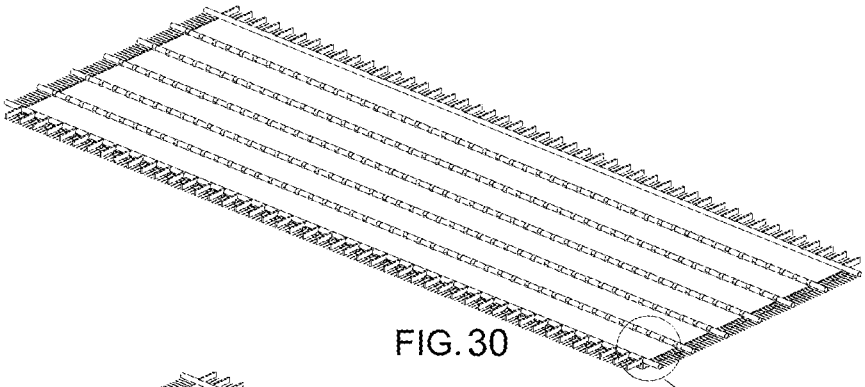
FIG. 30 is the solid view of the floor slab mold and the floor slab unit of Embodiment 13 of the invention.
Figure 31:
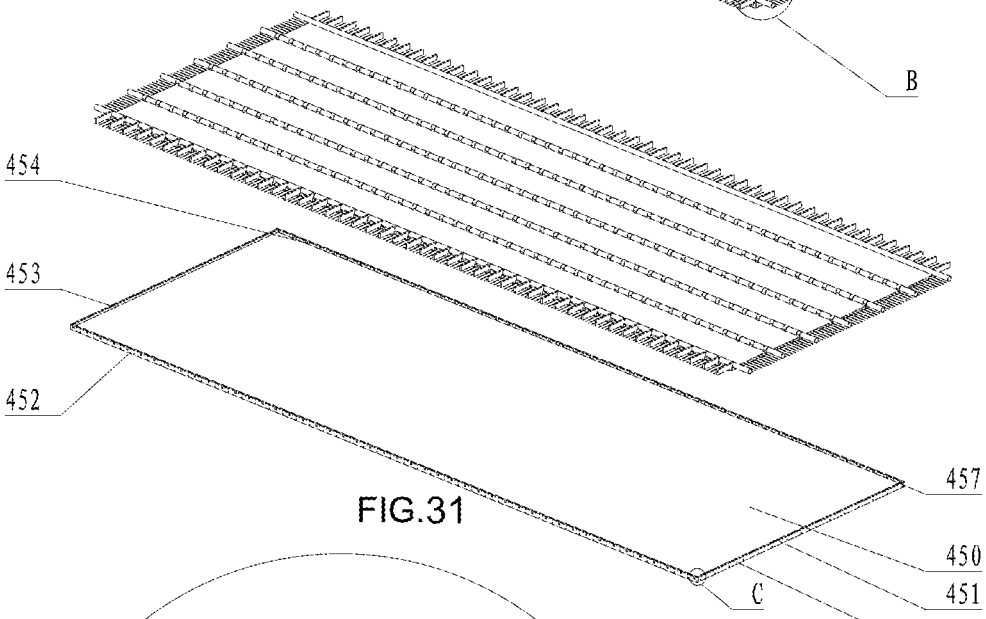
FIG. 31 is the solid breakdown view of the floor slab mold and the floor slab unit of Embodiment 13 of the invention.
Figure 32:
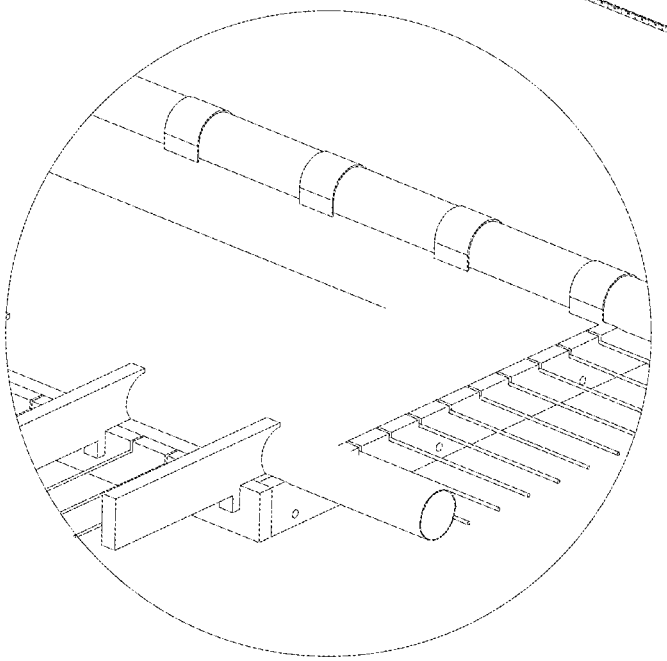
FIG. 32 is the enlarged view of the Part B of FIG. 30.
Figure 33:
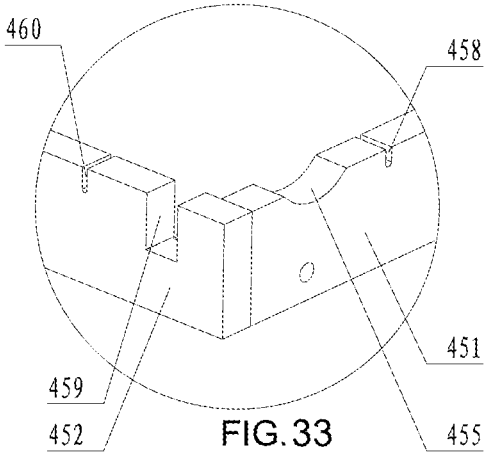
FIG. 33 is the enlarged view of the Part C of FIG. 31.
Figure 34:
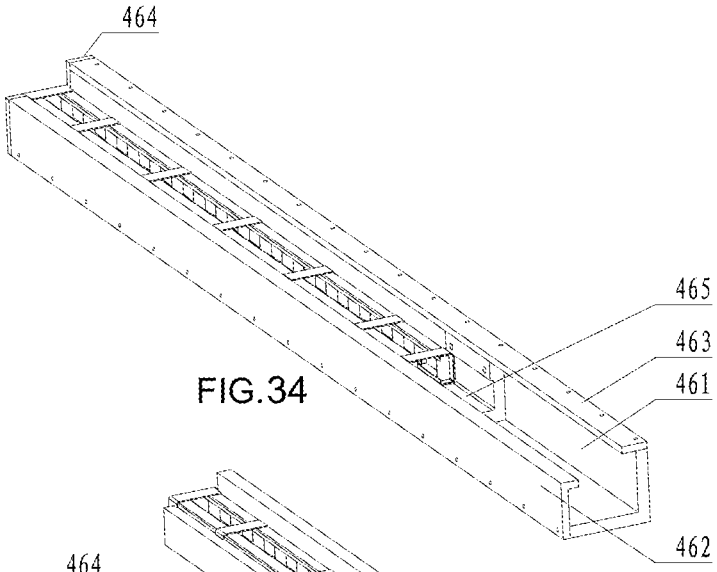
FIG. 34 is the solid view of the beam mold and the beam unit of Embodiment 13 of the invention.
Figure 35:
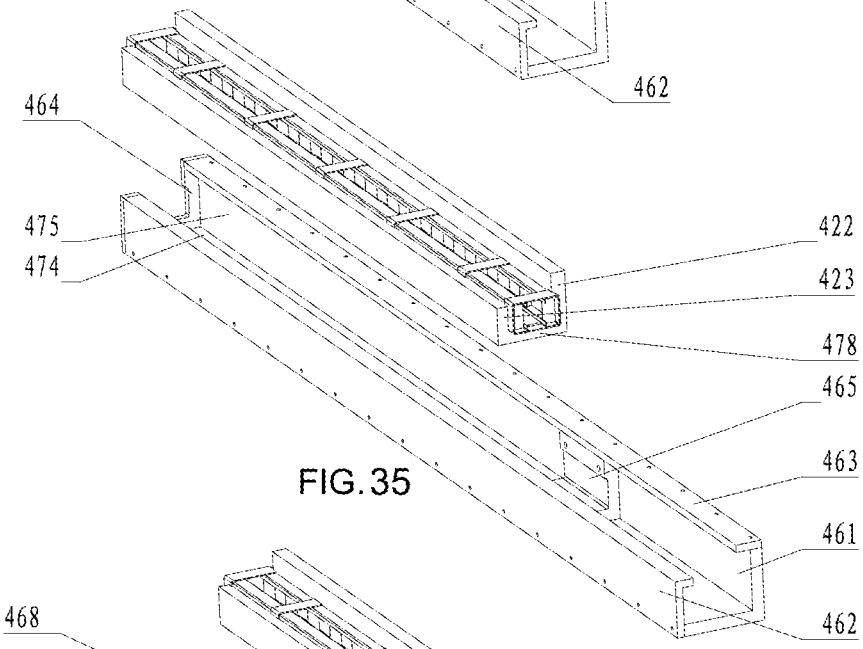
FIG. 35 the solid breakdown view of the beam mold and the beam unit of Embodiment 13 of the invention.
Figure 36:
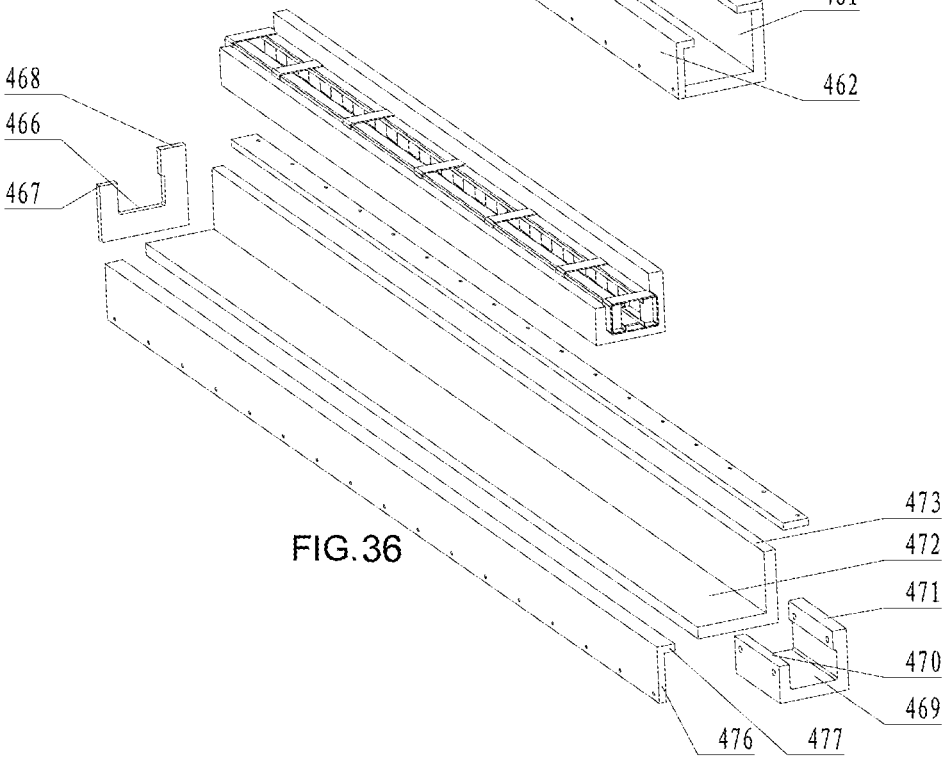
FIG. 36 is another solid breakdown view of the beam mold and the beam unit of Embodiment 13 of the invention.

As shown in FIG. 26 and FIG. 28, the lower parts of the beam keels 425 and 426 and the square tube type sleeves 429 are embedded into the semi-precast beam template layer 424, the upper parts are exposed out of the semi-precast beam template layer 424, the reinforces 427 and 428 are completely exposed out of the semi-precast beam template layer 424, the top faces of the beam keels 425 and 426 and the square tube type sleeves 429 are higher than the top face of the inner side wall 423 of the semi-precast beam template layer 424, the top face of the outer side wall 422 of the semi-precast beam template layer 424 is higher than the top faces of the beam keels 425 and 426 and the square tube type sleeves 429, and the end parts of the beam keels 425 and 426 and the square tube type sleeves 429 at both ends protrude out of the end face of the semi-precast beam template layer 424.

As shown in FIG. 22, FIG. 25, FIG. 26 and FIG. 29, Pillar Unit 403 comprises a pillar framework unit 433 and a pillar template 434. The pillar framework unit 433 comprises two relatively arranged open C-shaped section steel pillar major keels 435 and 436, reinforces transversely installed in the pillar major keel 435, reinforces (not shown) transversely installed in the pillar major keel 436, square tube type sleeves 439, and support legs 440 and short spacing tubes 441 and 442 corresponding to the storey. The two pillar major keels 435 and 436 penetrate through the square tube type sleeves 439, and the square tube type sleeves 439 are fixed and connected with the two pillar major keels 435 and 436 through welding. The support legs 440 are respectively welded on the side faces of the pillar major keels 435 and 436 facing towards Pillar Unit 402. The short spacing tubes 441 are vertically arrayed and welded on the outer side face of the pillar major keel 435 opposite to the pillar major keel 436, and the short spacing tubes 442 are vertically arrayed and welded on the outer side face of the pillar major keel 436 opposite to the pillar major keel 435.

The pillar template 434 penetrates through the short spacing tubes 441 to be fixed with the pillar major keel 435 and penetrates through the short spacing tubes 442 to be fixed with the pillar major keel 436 via fasteners (not shown). Round holes 443 with horizontal axes are arranged on the pillar major keel 435, round holes 444 with horizontal axes are arranged on the pillar major keel 436, the axes of all the short connecting tubes 441 and 442 are vertical, and concrete will fill in the cavities of the short connecting tubes 441 and 442, the round holes 443 of the pillar major keel 435 and the round holes 444 of the pillar major keel 436; so the rigidity of the short spacing tubes 441 and 442 and the binding force of concrete are enhanced, the binding force between the pillar major keels 435 and 436 and concrete is enhanced, and the building structure is better, firmer and safer.

As shown in FIG. 22 to FIG. 29, one end of the beam unit 406 is supported on the support leg 440 of Pillar Unit 403 in relative to Pillar Unit 402 through the square tube type sleeves 429 installed at one end of each of the beam keels 425 and 426 and is fixed with the support legs 440; The other end of the beam unit 406 is supported on a support leg (not shown) of Pillar Unit 402 in relative to Pillar Unit 403 through the square tube type sleeves 429 installed at the other end of each of the beam keels 425 and 426 and is fixed with the support leg.

The structure of the beam unit 408 and the structure of the beam unit 406 are symmetrical about the vertical plane in the central position. One end of each of beam keels 445 and 446 of the beam unit 408 is supported on a support leg (not shown) of Pillar Unit 401 through square tube type sleeves 447 and is fixed with the support leg, and the other end is supported on a support leg (not shown) of Pillar Unit 401 through square tube type sleeves 447 and is fixed with the support leg.

The structure of the beam unit 405 has the difference from the structure of the main bean unit 406 in that only the lengths of two beam keels 448 and a semi-precast beam template layer 449 are different, the quantities of reinforces (not shown) and square tube type sleeves (not shown) are different, and the installation relations are different. One end of each of the two beam keels 448 of the beam unit 405 is supported on a support leg (not shown) of Pillar Unit 401 through a square tube type sleeve and is fixed with the support leg, and the other end is supported on a support leg (not shown) of Pillar Unit 402 through square tube type sleeves and is fixed with the support leg.

The structure of the beam unit 407 and the structure of the beam unit 405 are symmetrical about the vertical plane in the central position. One end of each of beam keels 479 and 480 of the beam unit 407 is supported on a support leg (not shown) of Pillar Unit 403 through square tube type sleeves 481 and is fixed with the support leg, and the other end is supported on a support leg (not shown) of Pillar Unit 404 through square tube type sleeves 481 and is fixed with the support leg.

One end of each of the longitudinal section steel major keels 412, 413 and 414 is supported on the beam keels 445 and 446 of the beam unit 408, and the other end is supported on the beam keels 425 and 426 of the beam unit 406. One end of each of the first longitudinal steel bars 417 protruding out of the semi-precast floor slab template layer 410 is located above the beam framework unit 408, and the other end is located above the beam framework unit 406.

The suspension parts 419 of the longitudinal section steel major keels 412 are supported on the two beam keels of the beam unit 405, the suspension parts 420 of the longitudinal section steel major keels 414 are supported on the two beam keels 479 and 480 of the beam unit 407, one end of each of the first transverse steel bars 416 protruding out of the semi-precast floor slab template layer 410 is located above the beam framework unit 405, and the other end is located above the beam framework unit 407.

Floor Slab Unit 409 is installed in a cell formed by Pillar Units 401, 402, 403 and 404 and the beam units 405, 406, 407 and 408.

Combined pillar units 401, 402, 403 and 404, semi-precast floor slab template layer 410 and semi-precast beam template layers of four beam units are spliced together to form a concave cavity with an upward opening, concrete is poured into the concave cavity, the floor slab framework units and the beam framework units are completely embedded into the concave cavity, and integral floor slabs and beams are formed by the beam units, the floor slab units and the concrete.

A construction method of the building structure, the building structure comprises pillar units, beam units including main beam units and floor slab units, the construction method includes the following steps:

1) All pillar units, all main the beam framework units and all floor slab framework units are assembled according to design requirements or in a standardized way in a factory, and all pillar units, all the beam framework units and all the floor slab framework units are completely assembled and fixed together in the factory;

2) Precasting of a semi-precast floor slab template layer and precasting of a semi-precast beam template layer;

Precasting of a semi-precast floor slab template layer comprises the following process steps:

Installation of a floor slab mold:

The floor slab mold comprises flat plate type floor slab bottom die 450 and floor slab side dies 451, 452, 453 and 454;

Arc-shaped empty avoiding grooves 455 with upward openings matched with the longitudinal section steel major keels 412, five arc-shaped empty avoiding grooves 456 with upward openings respectively matched with the five longitudinal section steel major keels 413, arc-shaped empty avoiding grooves 457 with upward openings respectively matched with the longitudinal section steel major keels 414 and multiple U-shaped empty avoiding grooves 458 with upward openings matched with the first longitudinal steel bars 417 are arranged on the floor slab side die 451; The floor slab side die 453 is symmetrical to the floor slab side die 451, and its length is equal to the width of the floor slab bottom side 450;

Multiple U-shaped empty avoiding grooves 459 with upward openings respectively matched with the suspension parts 419 and multiple U-shaped empty avoiding grooves 460 with upward openings respectively matched with the first transverse steel bars 416 are arranged on the floor slab side die 452; The floor slab side die 454 is symmetrical to the floor slab side die 452, and its length is equal to the length of the floor slab bottom side 450 plus the thickness of the floor slab side dies 451 and 453;

Firstly, the floor slab side die 453 is fixed at the left side of the floor slab bottom side 450 via fasteners, and the floor slab side die 451 is fixed at the right side of the floor slab bottom side 450 via fasteners, with the front and rear two side faces of each of the floor slab side dies 451 and 452 being flush with the front and rear two side faces of the floor slab bottom side 450; secondly, the floor slab side die 452 is fixed at the front side of the floor slab bottom side 450 via fasteners, and the floor slab side die 454 is fixed at the rear side of the floor slab bottom side 450 via fasteners, with the left side faces of the floor slab side dies 452 and 454 being flush with the left side face of the floor slab side die 453 and the right side faces of the floor slab side dies 452 and 454 being flush with the right side face of the floor slab side die 451;

The floor slab bottom die 450 and the floor slab side dies 451, 452, 453 and 454 installed together form the floor slab mold, and the floor slab mold forms a concave cavity with an upward opening;

Floor Slab Framework Unit 411 is installed in the concave cavity of the floor slab mold; The longitudinal section steel major keels 412, 413 and 414 of Floor Slab Framework Unit 411 respectively penetrate through the corresponding empty avoiding grooves in the side direction and are supported on the floor slab side dies 451 and 453, with the left sides protruding out of the floor slab side die 453 and the right sides protruding out of the floor slab side die 451; The first longitudinal steel bars 417 penetrate through the corresponding empty avoiding grooves, with the left sides protruding out of the floor slab side die 453 and the right sides protruding out of the floor slab side die 451; The suspension parts 419 fixed with the longitudinal section steel major keels 412 penetrate through the empty avoiding grooves 459 in the side direction and are supported on the floor slab side die 452, with the front sides protruding out of the floor slab side die 452; The suspension parts 420 fixed with the longitudinal section steel major keels 414 penetrate through the empty avoiding grooves in the side direction and are supported on the floor slab side die 454, with the rear sides protruding out of the floor slab side die 454; The first transverse steel bars 416 penetrate through the corresponding empty avoiding grooves, with the front sides protruding out of the floor slab side die 452 and the rear sides protruding out of the floor slab side die 454;

Concrete is poured into the concave cavity of the floor slab mold to form the semi-precast floor slab template layer 410, with Floor Slab Framework Unit 411 being partially embedded into the semi-precast floor slab template layer 410;

After the semi-precast floor slab template layer 410 is dried, the floor slab side dies 451, 452, 453 and 454 are first separated from the floor slab bottom die 450, and then the semi-precast floor slab template layer 410 is separated from the floor slab bottom die 450;

The precasting method of semi-precast floor slab template layers of other floor slab units is the same to the precasting method of the semi-precast floor slab template layer 410;

Precasting of the semi-precast beam template layer 424 comprises the following process steps:

Installation of a Beam Mold:

The beam mold comprises an L-shaped main die 461, a reverse L-shaped front side die 462, a flat plate type top die 463, a left side die 464 and a movable right side die 465; The lengths of the main die 461, the front side die 462 and the top die 463 are the same; The left side die 464 comprises a bottom wall 466 as well as a front side wall 467 and a rear side wall 468 protruding out of the bottom wall 466; The height of the rear side wall 468 is greater than the height of the front side wall 467; The movable right side die 465 comprises a bottom wall 469 as well as a front side wall 470 and a rear side wall 471 protruding out of the bottom wall; The height of the rear side wall 471 is greater than the height of the front side wall 470; The front side die 462 comprises a front side wall 476 and a rear side wall 477; The L-shaped opening of the main die 461 faces forwards and upwards, the wall of the main die 461 parallel to the horizontal plane is the bottom wall 472, and the wall perpendicular to the bottom wall 472 is the side wall 473;

The left side wall 464 is fixed on the left side face of the main die 461, with the bottom face being flush with the bottom face of the main die, the front side face protruding out of the front side face of the bottom wall 472 of the main die 461, the rear side face being flush with the rear side face of the side wall 473 of the main die 461, and the top face of the bottom wall 466 protruding out of the top face of the bottom wall 472 of the main die 461;

The movable right side die 465 is fixed in the L-shaped opening of the main die 461, with the front side face of the front side wall 470 of the movable right side die 465 being flush with the front side face of the bottom wall 472 of the main die 461, and the position of the movable right side die 465 is adjustable in the main die 461, so different lengths of semi-precast beam template layer can be precasted;

The beam framework unit 430 is installed in the L-shaped opening of the main die 461, one end of each of the beam keels 425 and 426 is supported on the bottom wall 466 of the left side die 464 through the square tube type sleeves 429 installed at end parts of the beam keels 425 and 426, and the other end is supported the bottom wall 469 of the right side die 465 through other square tube type sleeves 429 installed at the end parts of the beam keels 425 and 426;

The front side die 462 is fixed at the front side of the bottom wall 472 of the main die 461, with both ends of the front side die 462 and the bottom face of the front side wall 476 being flush with both ends and the bottom face of the bottom wall 472 of the main die 461, the top face protruding of the top face of the bottom wall 472 of the main die 461, and the front side face of the front side wall 476 being flush with the front side face of the front side wall 467 of the left side die 464;

The top die 463 is fixed on the top face of the side wall 473 of the main die 461, with both ends and the rear side face of the top die 463 being respectively flush with both ends and the rear side face of the main die 461, and the front side face being flush with the front side face of the side wall 473 of the main die 461;

An upward concave cavity 474 with an upward opening is formed by the main die 461, the left side die 464, the front side die 462 and the movable right side die 465 installed together;

Concrete is first poured into the upward concave cavity 474 with an upward opening of the beam mold to form the bottom wall 478 of the semi-precast beam template layer 424; a sideward concave cavity 475 with a forward opening intercommunicated with the upward concave cavity 474 is formed by the main die 461, the top die 463, the left side die 464 and the movable right side die 465 installed together, the beam mold is rotated to make the opening of the sideward concave cavity 475 face upwards, and concrete is poured into the sideward concave cavity of the beam mold to form the side wall 422 of the semi-precast beam template layer 424; a sideward concave cavity (not shown) with a backward opening intercommunicated with the upward concave cavity 474 is formed by the main die 461, the left side die 464, the front side die 462 and the movable right side die 465 installed together, the beam mold is rotated to make the opening of the sideward concave cavity face upwards, and concrete is poured into the sideward concave cavity of the beam mold to form the side wall 423 of the semi-precast beam template layer 424;

The beam framework unit 430 is partially embedded into the semi-precast beam template layer 424;

After the semi-precast beam template layer 424 is dried, the front side die 462, the top die 463, the left side die 464 and the movable right side die 465 are separated from the main die 461, and then semi-precast beam template layer 424 is separated from the main die 461 to complete the precasting of the semi-precast beam template layer 424;

All components of the beam framework unit 430 protrude out of the beam framework layer 424 in the upward side, both ends of each of the beam keels 425 and 426 of the beam framework unit 430 protrude out of the beam framework layer 424, and the two outermost square tube type sleeves 429 protrude out of the beam framework layer 424 in the side direction;

The precasting method of semi-precast beam template layers of other beam units is the same to the precasting method of the semi-precast beam template layer 424;

3) Positioning and installation of pillar framework units of Pillar Units 401, 402, 403 and 404;

4) Hoisting of the beam unit 406: The end parts of the beam keels 425 and 426 of the beam unit 406 are respectively supported on the corresponding support legs of Pillar Units 402 and 403 through the square tube type sleeves 429 installed at the end parts of the beam keels 425 and 426 and are fixed with the two support legs; The beam units 405, 407 and 408 are hoisted in the same way;

After the installation of the beam units is completed, the beam units and pillar units form a cell;

5) Floor Slab Unit 409 is hoisted and placed in the cell, the left ends of the longitudinal section steel major keels 412, 413 and 414 of Floor Slab Unit 409 are supported on the beam keels of the beam unit 406, and the right ends are supported on the beam keels of the beam unit 408; suspension parts fixed on the longitudinal section steel major keels 412 are supported on the beam keels of the beam unit 405; suspension parts fixed on the longitudinal section steel major keels 414 are supported on the beam keels of the beam unit 407;

Combined four pillar units, semi-precast beam template layers of four beam units and semi-precast floor slab template layer 410 of Floor Slab Unit 409 are spliced together to form a concave cavity with an upward opening;

6) Concrete is poured into the concave cavity, with the floor slab framework units and the beam framework units being completely embedded into the concrete; after concrete setting, integral floor slabs and beams are formed by the main bean units, the floor slab units and the concrete.

When the semi-precast floor slab template layers and the semi-precast beam template layers are precasted, the mold keeps vibrating, so that the semi-precast floor slab template layers and the semi-precast beam template layers have uniform thickness and smooth surfaces.

The construction of the upper storey of floor slabs is completed in this way. The connection between pillars is the same to the existing way and will not be discussed in the invention.

Embodiment 14

Figure 37:
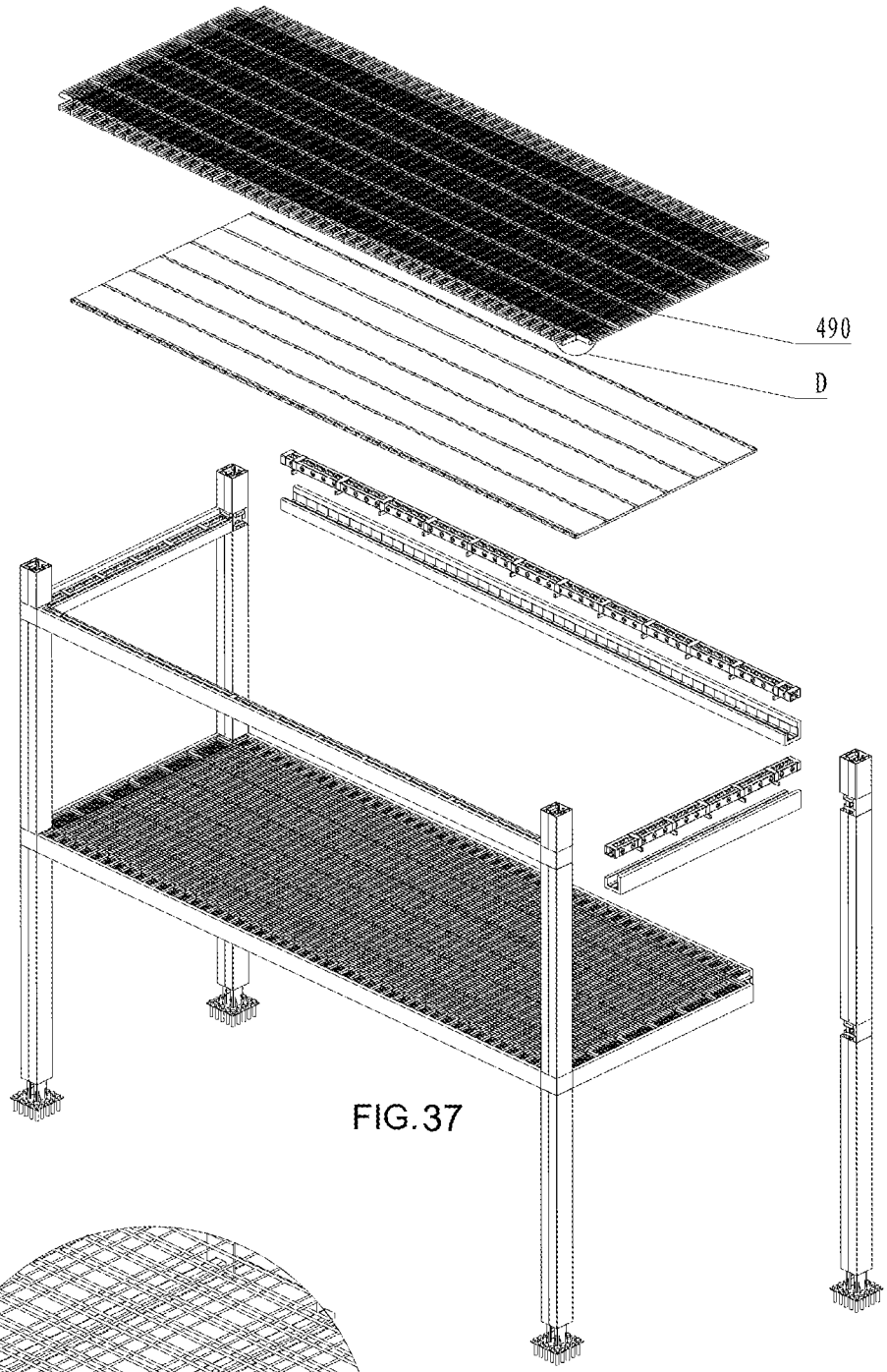
FIG. 37 is the solid breakdown view of Embodiment 14 of the invention before concrete is poured.
Figure 38:
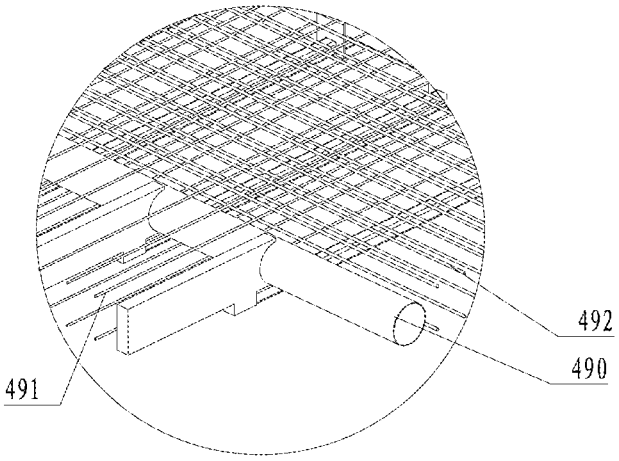
FIG. 38 is the enlarged view of the Part D of FIG. 37.

As shown in FIG. 37 and FIG. 38, the difference from Embodiment 13 is that second transverse steel bars 491 are fixed on longitudinal section steel major keels 490, and second longitudinal steel bars 492 are fixed on the second transverse steel bars 491.

Embodiment 15

Figure 39:
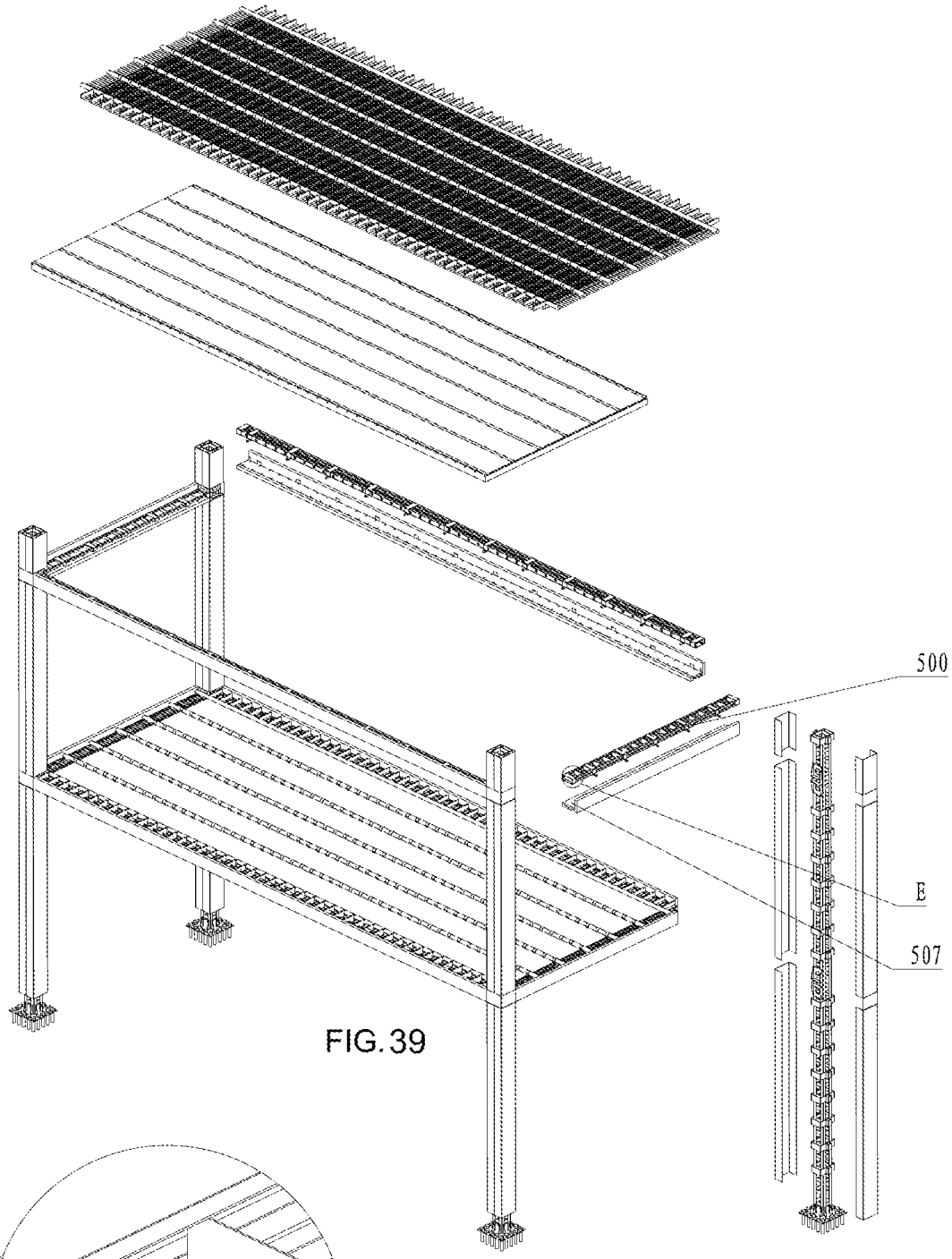
FIG. 39 is the solid breakdown view of Embodiment 15 of the invention before concrete is poured.
Figure 40:
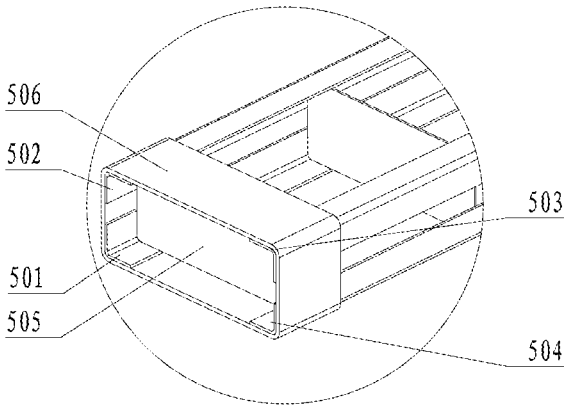
FIG. 40 is the enlarged view of the Part E of FIG. 39.
Figure 41:
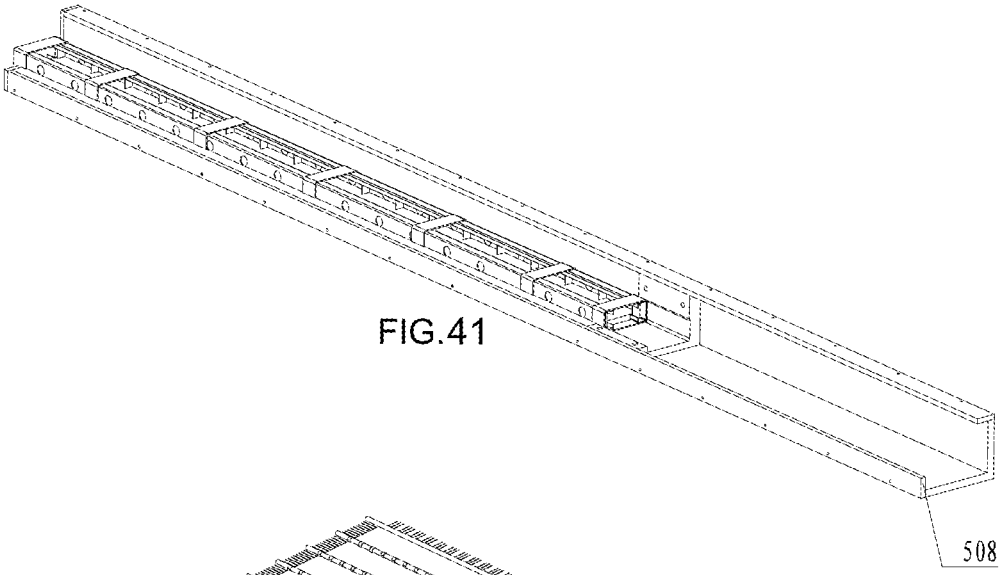
FIG. 41 is the solid view of the beam mold and the beam unit of Embodiment 15 of the invention.

As shown in FIG. 39 to FIG. 41, the difference from Embodiment 13 is that beam keels of each main the beam framework unit 500 are four pieces of relatively arranged L-shaped section steel 501, 502, 503 and 504; reinforces 505 are installed between every two of the four pieces of L-shaped section steel 501, 502, 503 and 504, the four pieces of L-shaped section steel 501, 502, 503 and 504 penetrates through square tube type sleeves 506, and the square tube type sleeves 506 connect and fix the four pieces of L-shaped section steel 501, 502, 503 and 504 together through welding. A semi-precast beam template layer 507 is of an L-shaped.

The construction method of the building structure has the difference from Embodiment 13 in that a front side die 508 of a beam mold is of a flat plate type.

Embodiment 16

Figure 42:
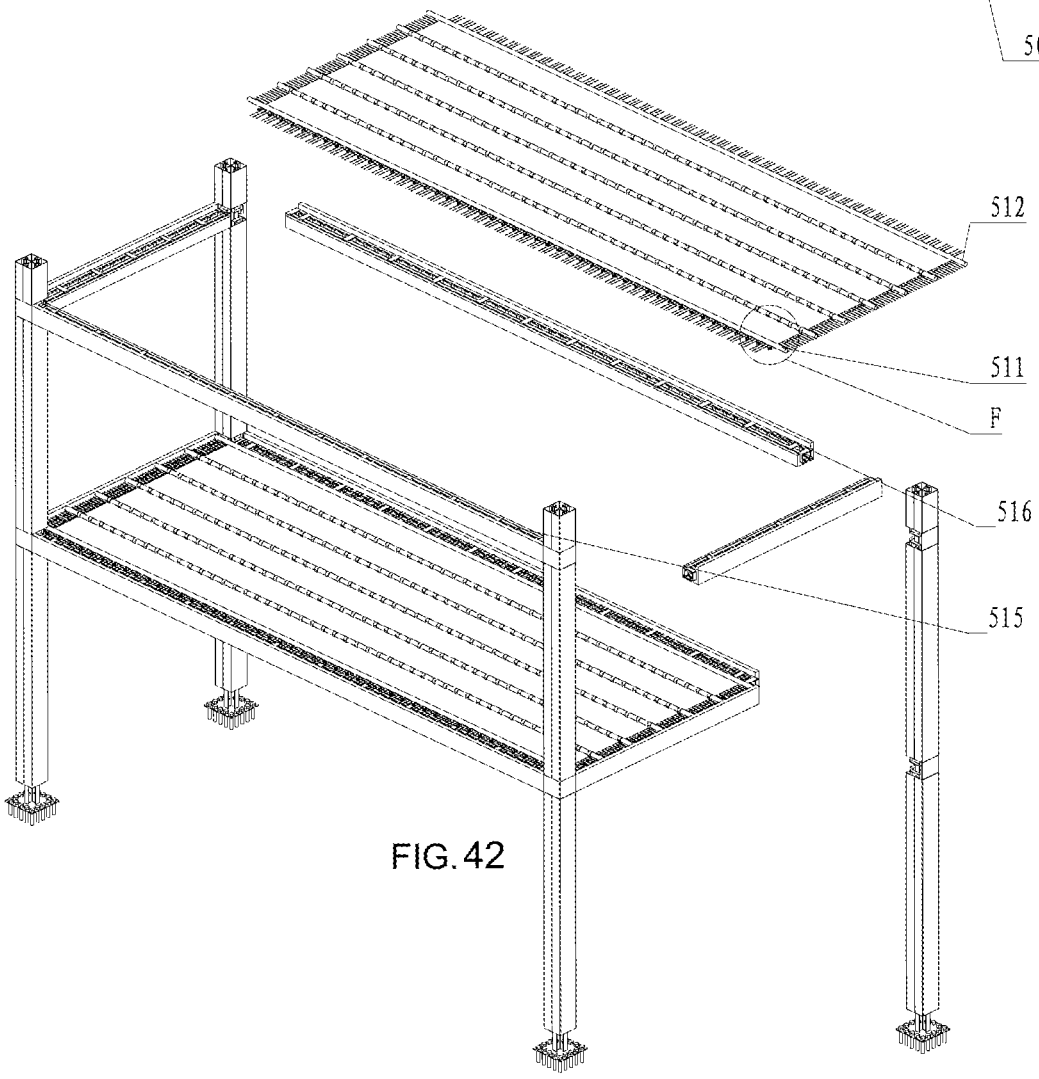
FIG. 42 is the solid breakdown view of Embodiment 16 of the invention before concrete is poured.
Figure 43:
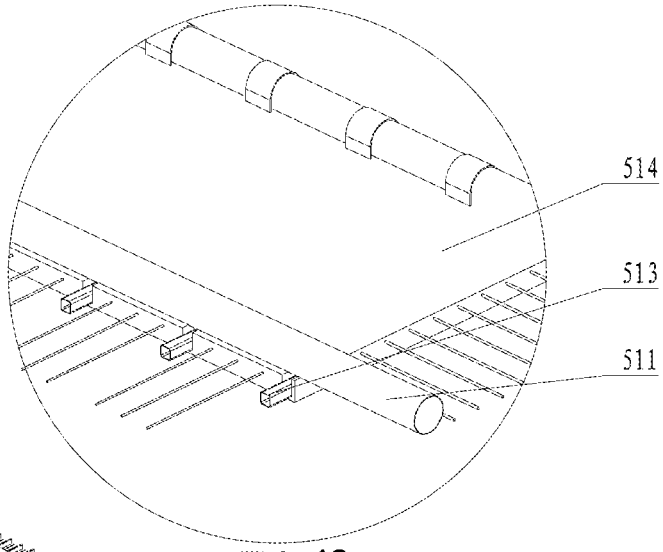
FIG. 43 is the enlarged view of the Part F of FIG. 42.

As shown in FIG. 42 and FIG. 43, the difference from Embodiment 13 is that no suspension part is arranged on the two outermost longitudinal section steel major keels 511 and 512.

A transverse section steel keel 513 protrudes out of a semi-precast floor slab template layer 514 in the side direction, one end reaches to be above a beam unit 515, and the other end reaches to be above a beam unit 516. Empty avoiding grooves formerly matched with suspension parts on a floor slab mold are changed into empty avoiding grooves matched with the transverse section steel keel 513.

Embodiment 17

Figure 44:
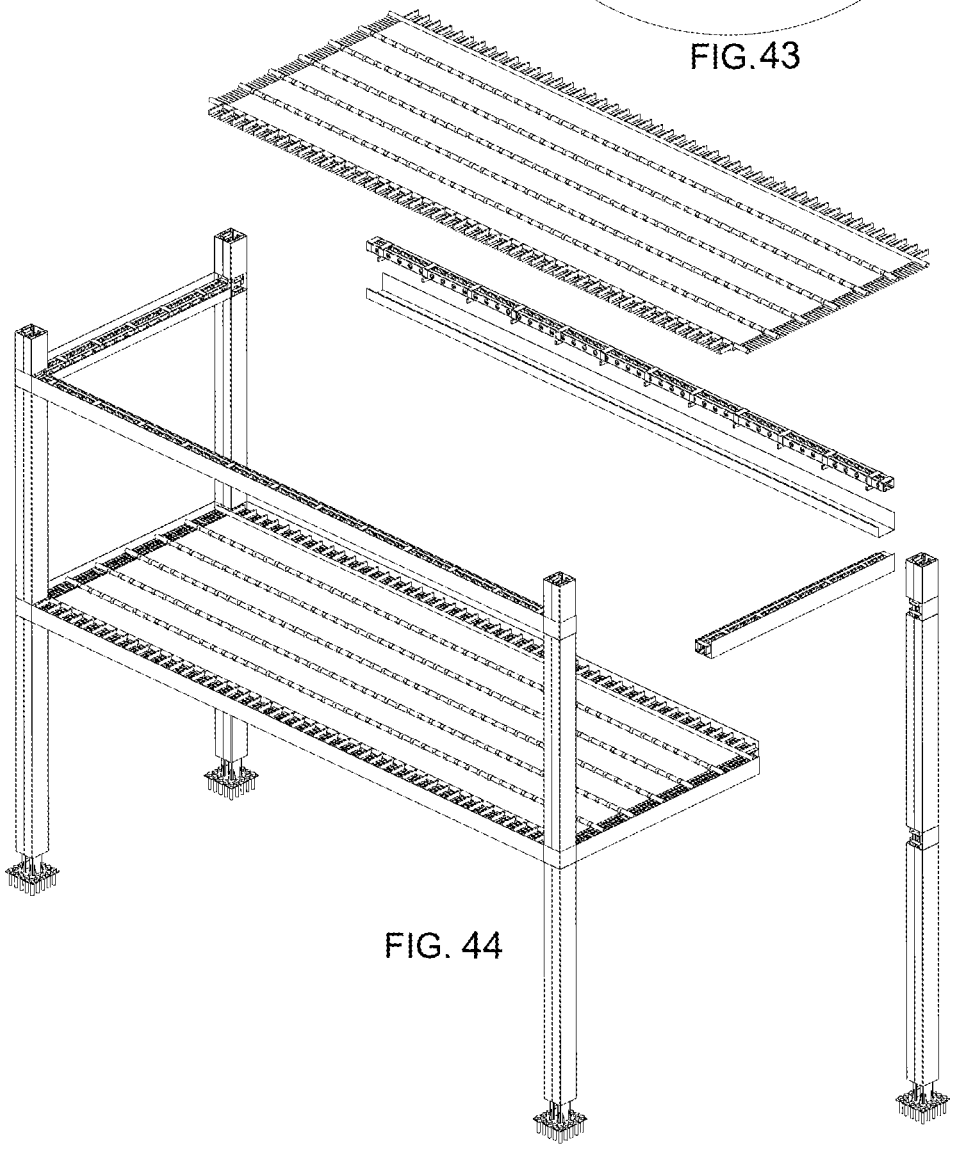
FIG. 44 is the solid breakdown view of Embodiment 17 of the invention before concrete is poured.

As shown in FIG. 44, the difference from Embodiment 13 is that a beam unit comprise a main the beam framework unit 521 and a beam template 522.

The beam template 522 is an integral structure and comprises a bottom die 523 and side dies 524 and 525 protruding out of the bottom die 523, and the top face of the side die 525 is higher than that of the side die 524. The beam framework unit 521 and the beam template 522 are fixed together in a factory.

The construction method of the building structure has the difference from Embodiment 13 in that the beam template 522 is fixed on the beam framework unit 521 in the factory, no semi-precast beam template layer is arranged, and thus, there is no procedure for precasting the semi-precast beam template layer.

Embodiment 18

Figure 45:
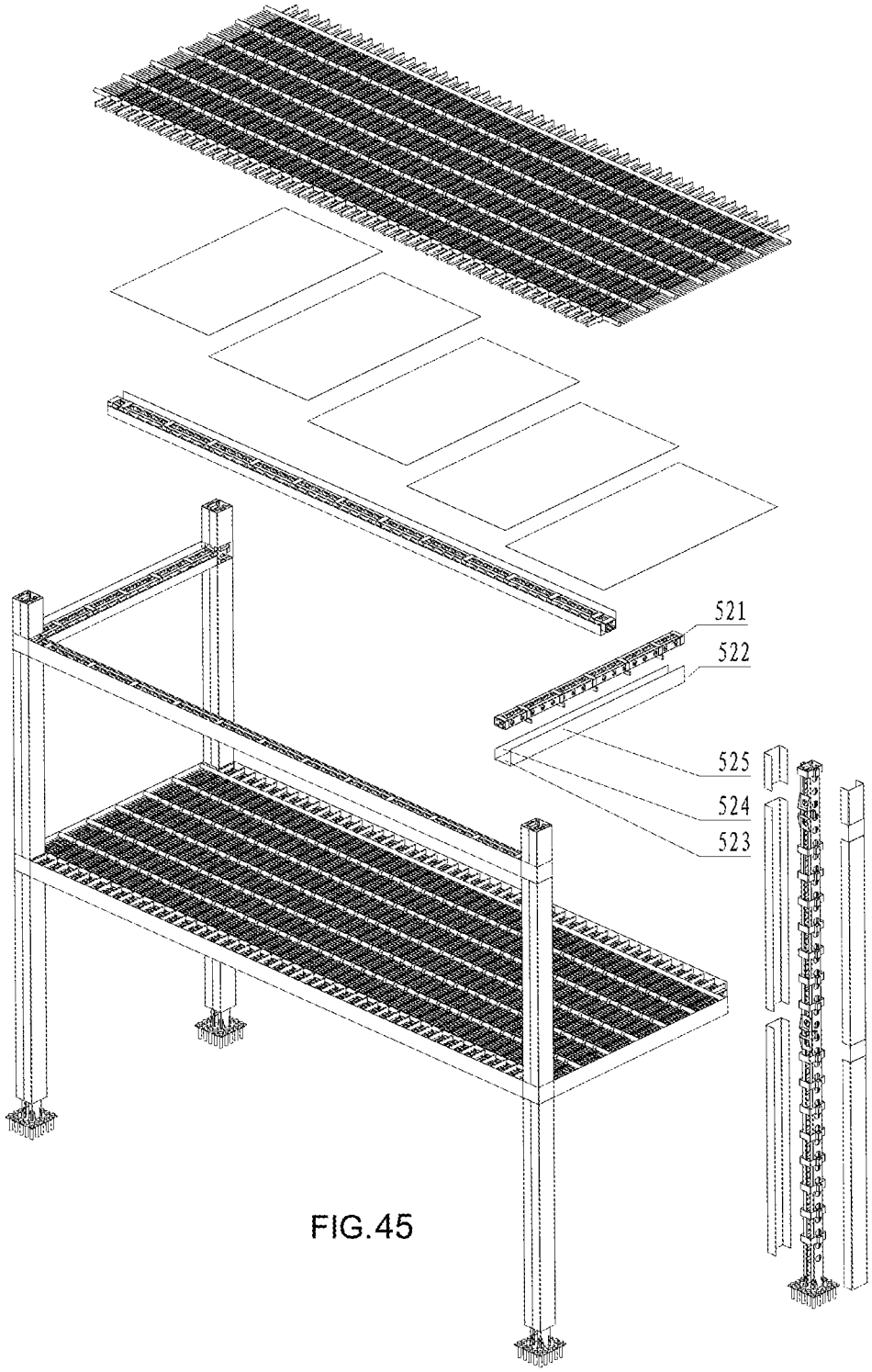
FIG. 45 is the solid breakdown view of Embodiment 18 of the invention before concrete is poured.

As shown in FIG. 45, the difference from Embodiment 13 is that a beam unit comprise a main the beam framework unit 621 and a beam template 622. The beam template 622 is an integral structure and comprises a bottom die 623 and side dies 624 and 625 protruding out of the bottom die 623, and the top face of the side die 625 is higher than that of the side die 624. The beam framework unit 621 and the beam template 622 are fixed together in a factory.

A floor slab unit comprises a floor slab framework unit 626 and multiple floor slab templates 627 fixed below the floor slab framework unit 626.

The construction method of the building structure has the difference from Embodiment 13 in that the beam template 622 is fixed on the beam framework unit 621 in the factory, no semi-precast beam template layer is arranged, and thus, there is no procedure for precasting the semi-precast beam template layer. The floor slab templates 627 are fixed on the floor slab framework unit 626 in the factory, no semi-precast floor slab template layer is arranged, and thus, there is no procedure for precasting the semi-precast floor slab template layer.

Singular and plural expression about the English translation of this patent is not accurate. Unless otherwise stated, in general, nouns and pronouns in the patent can be singular, plural also available. If ambiguity occurs, the interpretation of the description, claims and drawings in Chinese shall prevail.

What is claimed is:

1. A building structure, comprising pillar units, beam units including main beam units and floor slab units, characterized in that:

each floor slab unit comprises a meshed floor slab framework unit and floor slab templates wherein the meshed floor slab framework unit comprises longitudinal section steel major keels for load-bearing and arrayed transverse section steel keels fixed with the longitudinal section steel major keels, and the floor slab templates are fixed with the meshed floor slab framework unit with a gap between a top surface of the floor slab templates and a bottom surface of the longitudinal section steel major keels;

each beam unit comprises a beam framework unit and beam templates fixed on the beam framework unit, wherein the beam framework unit comprises section steel beam keels for load-bearing, and a space is set between top surfaces of the beam templates and bottom surfaces of the longitudinal section steel major keels;

each pillar unit comprises a pillar framework unit, wherein the pillar framework unit comprises a pillar keel unit and support legs fixed on the pillar keel unit and the pillar frame work unit is used for supporting the beam framework unit of the beam units;

suspension parts are arranged at end faces of both ends of the longitudinal section steel major keels, wherein the suspension parts are of inverted L shape or reversed inverted L shape, the pillar units, the beam units and the floor slab units are pre-assembled modular structures, both ends of the beam units are placed on two corresponding support legs of two adjacent pillar units and fixed with the support legs; and a cell is formed between any two adjacent beam units, wherein plural floor slab units are installed in each cell, wherein the floor slab units are supported on the beam framework unit, wherein two opposite sides of two suspension parts fixed on the same longitudinal section steel major keel are stopped by the beam framework unit;

wherein the pillar units, the beam unit templates and the floor slab templates are spliced together to form a concave cavity with an upward opening, and concrete is poured into the concave cavity; and wherein the beam framework unit and the meshed floor slab framework unit are embedded into the concave cavity with concrete to form integral floor slabs and beams.

2. The building structure according to claim 1, characterized in that:

the building structure is a slab-pillar structure;

each beam unit comprises side beam units;

a beam framework unit of each side beam unit comprises more than two arrayed beam keels and also comprises arrayed section steel beam minor keels with small cross sectional area placed below the beam keels and perpendicular side and fixed with the beam keels;

each side beam unit also comprises end plates, and the end plates are fixed at both ends of the beam keel;

the beam templates of each side beam unit comprises a bottom plate parallel to a horizontal plane and an outer side plate perpendicular to the bottom plate, the bottom plate and the outer side plate form an L shape, a top face of the bottom plate is attached to the bottom faces of the beam minor keels, a top face of the outer side plate is higher than a top face of the beam framework unit, and the bottom plate is flush with and attached to the floor slab templates.

3. The building structure according to claim 1, characterized in that:

each beam unit also comprises a middle beam unit;

a beam framework unit of the middle beam unit comprises more than two arrayed beam keels and also comprises arrayed section steel beam minor keels with small cross sectional area placed below the beam keels and perpendicular and fixed with the beam keels; and the middle beam unit also comprises end plates, and the end plates are fixed at both ends of the beam keel, wherein top faces of the beam templates of the middle beam units are attached to bottom faces of the beam minor keels and are flush with and attached to the floor slab templates.

4. The building structure according to claim 1, characterized in that:

the building structure is a slab-pillar-beam structure;

beam unit comprises side beam units;

a beam framework unit of the side beam unit comprises more than two arrayed beam keels and also comprises arrayed section steel beam minor keels with small cross sectional area placed below the beam keels and perpendicular and fixed with the beam keels;

the beam unit also comprises end plates, and the end plates are fixed at both ends of the beam keel; and a beam template of the side beam unit comprises a bottom plate parallel to the horizontal plane, an outer side plate, and an inner side plate perpendicular to the bottom plate, a top face of the bottom plate is attached to bottom faces of beam minor keels, a top face of the outer side plate is higher than the top face of the beam framework unit, a top face of the inner side plate is flush with the top face of the floor slab template, and the inner side plate is attached to the floor slab template.

5. The building structure according to claim 4, characterized in that:

the beam framework unit of the middle beam unit comprises more than two arrayed beam keels and also comprises arrayed section steel beam minor keels with small cross sectional area placed below the beam keels and perpendicular and fixed with the beam keels;

each beam unit also comprises end plates, and the end plates are fixed at both ends of the beam keel; and a beam template of the middle beam unit comprises a bottom plate parallel to the horizontal plane and two side plates perpendicular to the bottom plate, the top face of the bottom plate is attached to the bottom faces of the beam minor keels, top faces of the side plates are flush with the top face of the floor slab template, and the side plates are attached to the floor slab template.

6. The building structure according to claim 1, characterized in that:

each floor slab unit also comprises a floor slab decorative panel, and a floor slab template is a metal template to be removed;

the floor slab decorative panel is placed between the meshed floor slab framework unit and the floor slab template;

spaces for avoiding emptiness matched with support legs are arranged on the floor slab decorative panel and the floor slab template, with the beam framework unit being supported on the support legs; the floor slab decorative panel and the floor slab template are fixed on the corresponding meshed floor slab framework unit from below via fasteners; and reverse hooks are arranged on a upward face of the floor slab decorative panel and are embedded into concrete.

7. The building structure according to claim 1, characterized in that:

the transverse section steel keels comprise upper transverse section steel keels fixed on top faces of the longitudinal section steel major keels and lower transverse section steel keels fixed on the bottom faces of the longitudinal section steel major keels;

the suspension part comprises angle brackets fixed at both ends of the longitudinal section steel major keel;

the upper transverse section steel keels and the lower transverse section steel keels are staggered, wherein end faces of the lower transverse section steel keels are flush with the corresponding side faces of the floor slab templates, and outer side faces of two outermost lower transverse section steel keels are flush with the corresponding side faces of the floor slab templates;

the meshed floor slab framework unit is supported on the beam framework unit via horizontal parts of the angle brackets; and the bottom faces of the lower transverse section steel keels are attached to the top faces of the floor slab templates.

8. The building structure according to claim 7, characterized in that:

the suspension part also comprises transverse section steel connecting strips connected on the bottom faces of the horizontal parts of the angle brackets;

both ends of the upper transverse section steel keel protrude out of the floor slab templates, and longitudinal section steel connecting strips are connected on bottom faces of all the upper transverse section steel keels; and bottom faces of the longitudinal section steel connecting strips and the transverse section steel connecting strips are flush with each other; the bottom faces of the longitudinal section steel connecting strips and the transverse connecting strips are supported on the corresponding beam framework unit.

9. The building structure according to claim 7, characterized in that:

the floor slab templates are removable templates and fixed on the meshed floor slab framework unit from below via fasteners; and the floor slab template unit comprises one of the floor slab templates and stiffeners fixed at a bottom face of the floor slab template.

10. The building structure according to claim 1, characterized in that:

the building structure also comprises secondary beam units;

the beam framework unit of the secondary beam units comprises more than two arrayed beam keels and also comprises arrayed section steel secondary beam minor keels placed below the beam keels and perpendicular and fixed with the beam keels, wherein the secondary beam unit also comprises end plates, and the end plates are fixed at both ends of the secondary beam keel;

supporting parts are arranged on the beam framework units or suspension parts are arranged on secondary beam framework units, the secondary beam framework units are supported on the supporting parts of the beam framework units or supported on the beam framework units; and secondary beam templates are spliced together with the corresponding floor slab templates, and top planes of the secondary beam templates are flush with top planes of the floor slab templates.

11. The building structure according to claim 1, characterized in that:

accommodating through holes for accommodating concrete are arranged in the longitudinal section steel major keels.

12. The building structure according to claim 1, characterized in that:

the pillar unit also comprises pillar templates, with more than two templates being arranged at same height the pillar keel unit comprises more than two vertical arrayed load-bearing pillar major keels;

the pillar keel unit also comprises short connecting tubes with vertical axes and short spacing tubes with the vertical axes, the short connecting tubes are installed between the pillar major keels and are used for spacing the pillar major keels and fixing the pillar major keels for the same pillar unit at the same height together, and the short spacing tubes are fixed on two relative outer side faces of different pillar major keels; support legs are fixed on the pillar major keels;

the pillar templates are attached to and fixed with the short spacing tubes, a closed tubular cavity is formed by the pillar templates of the same height, and a space is set between the pillar templates and relative outer side faces of the pillar major keels; and spaces for avoiding emptiness are arranged in positions where the pillar templates are matched with the beam units, and the tubular cavity formed by the pillar templates are intercommunicated with the concave cavity.

13. The building structure according to claim 1, characterized in that:

the meshed floor slab framework unit also comprises steel bars fixed with the transverse section steel keels, and the steel bars comprise longitudinal steel bars alone, or, longitudinal steel bars and transverse steel bars together.

14. A construction method of the building structure, the building structure comprises pillar units, beam units including main beam units and floor slab units, the construction method includes following steps:

1) pillar framework units, the beam units including main beam units and floor slab units are assembled according to design requirements or in a standardized way in a factory;

assemble the floor slab units: each floor slab unit comprises a net-shaped floor slab framework unit and a floor slab template, suspension units are fixed at both ends of longitudinal section steel major keel, the longitudinal section steel major keels are fixed with transverse section steel major keels, and the floor slab templates are fixed with the net-shaped floor slab framework unit, thus floor units are assembled into a module structure in the factory;

assemble the beam units: assemble beam framework units, and fix beam templates on the beam framework units, thus the beam units are assembled into a module structure in the factory; and assemble the pillar framework units: fix support legs on pillar keel units, the faces of support legs supporting the beam keels are kept perpendicular to the pillar keel units, thus the pillar framework units are assembled into a module structure in the factory;

2) position and install the pillar framework units, the pillar keel units are kept perpendicular to a horizontal plane;

3) the beam units are hoisted, placed and fixed on the support legs of the pillar framework units, a cell is formed between two adjacent beam units;

4) the floor slab units are hoisted and placed into the cells, with suspension parts of the floor slab units being supported on the beam framework units, and two opposite sides of two suspension parts fixed on same longitudinal section steel keel are stopped by the beam framework units; pillar framework units, the beam templates and the floor slab templates are spliced together to form a concave cavity with an upward opening; and 5) the concrete is poured into the concave cavity, with the beam framework units and the net-shaped floor slab framework unit embedded into the concrete; after the concrete setting, integral floor slabs and beams are formed by the said beam framework units, the net-shaped floor slab framework unit and the concrete.

15. A construction method of the building structure, the building structure comprises pillar units, beam units including main beam units and floor slab units, the construction method includes the following steps:

1) pillar framework units, beam units including main beam units and floor slab units are assembled according to design requirements or in a standardized way in a factory;

assemble floor slab units: each floor slab unit comprises a net-shaped floor slab framework unit and a floor slab template, suspension units are fixed at both ends of longitudinal section steel major keel, the longitudinal section steel major keels are fixed with transverse section steel major keels, and the floor slab templates are fixed with the net-shaped floor slab framework unit, thus the floor units are assembled into a module structure in the factory;

assemble the beam units: assemble beam framework units, and fix beam templates on the beam framework units, thus the beam units are assembled into a module structure in the factory; and assemble pillar framework units: fix support legs on pillar keel units, the faces of support legs supporting the beam keels are kept perpendicular to the pillar keel units, thus pillar framework units are assembled into a module structure in the factory;

2) position and install pillar framework units, the pillar keel units are kept perpendicular to a horizontal plane;

3) installation of pillar templates: the pillar templates are fixed with corresponding pillar framework units; a tubular cavity is formed by the pillar templates of the same height; concrete is poured into tubular cavity; pillar framework units above the faces of support legs supporting the beam keels are not embedded into the concrete in the concave cavity;

4) the beam units are hoisted, placed and fixed on the support legs of the pillar framework units; the cell is formed between two adjacent beam units after the installation of the beam units are completed;

5) the floor slab units are hoisted and placed into the cells, with suspension parts of the floor slab units being supported on the said beam framework units; combined pillar framework units, the beam templates and the floor slab templates are spliced together to form a concave cavity with an upward opening are spliced together to form a concave cavity with an upward opening; and 6) the concrete is poured into the concave cavity; the beam framework units and floor framework units are embedded into the concrete in the concave cavity; all the pillar keel units are embedded into the concrete in the tubular cavity, and an integral structure is formed by the concrete in the concave cavity and the concrete in the tubular cavity; after concrete setting, integral floor slabs, beams and pillars are formed by all the said beam framework units, the net-shaped floor slab framework unit and concrete and all the pillar framework units and concrete.

16. A building structure, which comprises pillar units, beam units including main beam units and floor slab units, characterized in that:

each floor slab unit comprises a semi-precast floor slab template layer and a floor slab framework unit partially embedded into the semi-precast floor slab template layer;

floor framework unit comprises arrayed longitudinal load-bearing section steel major keels with large cross sectional area and transverse section steel keels installed below the longitudinal section steel major keels, as well as steel bars installed with the transverse section steel keels together, wherein the steel bars comprise either first longitudinal steel bars alone, or, first transverse steel bars plus first longitudinal steel bars together;

the steel bars and the transverse section steel keels are embedded into the semi-precast floor slab template layer, the steel bars protrude out of the semi-precast floor slab template layer in side direction, the transverse section steel keels protrude out of the semi-precast floor slab template layer in the side direction or are completely embedded into the semi-precast floor slab template layer, wherein the longitudinal load-bearing section steel major keels protrude out of the semi-precast floor slab template layer only in the side and upward side direction;

each beam unit comprises a semi-precast beam template layer of concrete and a beam framework unit partially embedded into the semi-precast beam template layer; the beam framework unit comprises section steel major keels for load-bearing; end parts of the beam keels protrude out of end faces of the semi-precast beam template layer;

the pillar units comprise a pillar framework unit, and the pillar framework unit comprises a pillar keel unit and support legs fixed on the pillar keel unit and used for supporting the beam framework unit;

the floor slab units, the beam units, the pillar framework units are pre-assembled modular structures, both ends of each beam unit are supported on two corresponding support legs of two adjacent pillar units and fixed with the two support legs;

a cell is formed between two adjacent beam units, wherein more than one floor slab units are installed in each of the cells formed by the pillar units and the beam units;

the longitudinal section steel major keels are supported on the beam keels, wherein the longitudinal section steel major keels and the steel bars protruding out of the semi-precast floor slab template layer in the side direction are placed above the beam units;

more than one floor slab units are installed in each of the cells formed by the pillar units and the beam units; and wherein the pillar units, the semi-precast floor slab template layer and the semi-precast beam template layer are spliced together to form a concave cavity with an upward opening, concrete is poured into the concave cavity, with the floor slab framework unit and the beam framework unit being completely embedded into the concrete, and integral floor slabs and beams are formed by the beam units, the floor slab units and the concrete.

17. The building structure according to claim 14, characterized in that:

the suspension parts are fixed at outermost longitudinal section steel major keels, and the longitudinal section steel keels are supported on the beam keels.

18. The building structure according to claim 14, characterized in that:

the transverse section steel keels protrude out of the semi-precast floor slab template layer; the transverse section steel keels protrude out of the semi-precast floor slab template layer in the side direction, and the first transverse steel bars are placed above the beam units.

19. The building structure according to claim 14, characterized in that:

the longitudinal section steel major keels are round tube type section steel, and the transverse section steel keels are square tube type section steel with small cross sectional area;

the building structure also comprises U-shaped connectors matched with the longitudinal section steel major keels, with U-shaped grooves matched with the transverse section steel keels being arranged on the U-shaped connectors;

the first transverse steel bars and the first longitudinal steel bars are fixed together to form a steel bar mesh, the first longitudinal steel bars are supported on the transverse section steel keels, the first transverse steel bars are placed between two adjacent transverse section steel keels, and the first longitudinal steel bars are placed between two connected longitudinal section steel major keels; and the U-shaped connectors are suspended to the longitudinal section steel major keels, and the transverse section steel keels are installed in the U-shaped grooves of the U-shaped connectors and are fixed with the longitudinal section steel major keels and the U-shaped connectors together through welding.

20. The building structure according to claim 14, characterized in that:

the beam framework unit also comprises reinforces and square tube type sleeves; and the beam keels of each beam unit are two pieces of relatively arranged open C-shaped section steel; the reinforces are vertically installed in the C-shaped section steel, the two pieces of C-shaped section steel penetrate through the square tube type sleeves, and the square tube type sleeves connect the two pieces of C-shaped section steel together.

21. The building structure according to claim 14, characterized in that:

the beam framework unit also comprises reinforces and square tube type sleeves; and the beam keels of each beam unit are four pieces of relatively arranged L-shaped section steel; the reinforces are installed among the four pieces of L-shaped section steel, the four pieces of L-shaped section steel penetrate through the square tube type sleeves, and the square tube type sleeves connect the four pieces of L-shaped section steel together.

22. The building structure according to claim 14, characterized in that:

second transverse steel bars and second longitudinal steel bars are installed on the longitudinal section steel major keels.

23. A building structure, which comprises pillar units, beam units including main beam units and floor slab units, characterized in that:

each floor slab unit comprises a semi-precast floor slab template layer and a floor slab framework unit partially embedded into the semi-precast floor slab template layer;

floor framework unit comprises arrayed longitudinal load-bearing section steel major keels with large cross sectional area and transverse section steel keels installed below the longitudinal section steel major keels, as well as steel bars installed with the transverse section steel keels together, and the steel bars comprise either first longitudinal steel bars alone, or, first transverse steel bars plus first longitudinal steel bars together;

the steel bars and the transverse section steel keels are embedded into the semi-precast floor slab template layer, the steel bars protrude out of the semi-precast floor slab template layer in the side direction, the transverse section steel keels protrude out of the semi-precast floor slab template layer in the side direction or are completely embedded into the semi-precast floor slab template layer;

the longitudinal load-bearing section steel major keels protrude out of the semi-precast floor slab template layer only in the side and upward side direction;

each beam unit comprises a beam framework unit and a beam template fixed on the beam framework unit; the beam framework unit comprises section steel major keels for load-bearing with large cross sectional area; end parts of the beam keels protrude out of end faces of the beam template;

the pillar unit comprises a pillar framework unit, and the pillar framework unit comprises a pillar keel unit and support legs fixed on the pillar keel unit and used for supporting the beam framework unit;

both ends of the beam keel are supported on two corresponding support legs of two adjacent pillar units and fixed with the two support legs;

the longitudinal section steel major keels are supported on the beam keels; the longitudinal section steel major keels and the steel bars protruding out of the semi-precast floor slab template layer in the side direction are placed above the beam units;

more than one floor slab units are installed in a cell formed by the pillar units and the beam units; and wherein the pillar units, semi-precast floor slab template layer and semi-precast beam template layer are spliced together to form a concave cavity with an upward opening, concrete is poured into the concave cavity, with the floor slab framework unit and the beam framework unit being completely embedded into the concrete, and integral floor slabs and beams are formed by the beam units, the floor slab units and the concrete.

* * * * *